US008534944B2

(12) United States Patent
Shim

(10) Patent No.: US 8,534,944 B2
(45) Date of Patent: Sep. 17, 2013

(54) MULTICOLOR WRITING TOOLS AND METHODS

(71) Applicant: Youngtack Shim, Port Moody (CA)

(72) Inventor: Youngtack Shim, Port Moody (CA)

( * ) Notice: Subject to any disclaimer, the term of this patent is extended or adjusted under 35 U.S.C. 154(b) by 0 days.

(21) Appl. No.: 13/670,534

(22) Filed: Nov. 7, 2012

(65) Prior Publication Data

US 2013/0061440 A1 Mar. 14, 2013

Related U.S. Application Data

(63) Continuation of application No. 13/093,033, filed on Apr. 25, 2011, now Pat. No. 8,322,938, which is a continuation of application No. 11/411,102, filed on May 26, 2006, now Pat. No. 7,950,862.

(51) Int. Cl.
*B43K 27/00* (2006.01)
*B43K 7/12* (2006.01)

(52) U.S. Cl.
USPC ..... 401/31; 401/107; 401/108

(58) Field of Classification Search
USPC ..... 401/16, 17, 19–22, 28–35, 55, 59, 401/60, 62, 81, 82, 87, 106–109, 112, 115, 401/116, 225
See application file for complete search history.

(56) References Cited

U.S. PATENT DOCUMENTS

| | | | |
|---|---|---|---|
| 2,494,202 | A | 1/1950 | Rem |
| 2,608,953 | A | 9/1952 | Kollsman |
| 2,676,570 | A | 4/1954 | Fahringer |
| 2,690,738 | A | 10/1954 | Andonov |
| 2,781,741 | A | 2/1957 | Tintner |
| 2,790,422 | A | 4/1957 | Grumbach, II |
| 2,837,057 | A | 6/1958 | Morlock et al. |
| 3,025,833 | A | 3/1962 | Fend |
| 3,039,436 | A | 6/1962 | Exner |
| 3,130,712 | A | 4/1964 | Kahn et al. |
| 3,225,747 | A | 12/1965 | Schmidt |
| 3,292,594 | A | 12/1966 | Ghislanzoni |

(Continued)

FOREIGN PATENT DOCUMENTS

| | | |
|---|---|---|
| DE | 3405543 | 8/1985 |

OTHER PUBLICATIONS

Office Action; Restriction Requirement, Mailing Date: Dec. 5, 2011, U.S. Appl. No. 13/093,033.

(Continued)

*Primary Examiner* — David Walczak
*Assistant Examiner* — Jennifer C Chiang
(74) *Attorney, Agent, or Firm* — Stein IP, LLC

(57) ABSTRACT

Various multicolor writing tools and methods for applying multiple volatile marking substances one at a time. The tool includes a case member, a cartridge member, a cap member, and an optional actuator member. The case member forms an interior in which is disposed the cartridge member with multiple cartridges each containing one of the marking substances and a tip through which the marking substance is applied. The cap member changes and restores its configuration, while the actuator member changes the configuration and exposes one of the tips selected by an user out of the interior when the tool is in use, and then restores the configuration and encloses all of the tips inside the interior when not in use. Thus, the tool opens the cap member in response to input force without requiring the user to engage in a separate maneuver to remove the cap member.

29 Claims, 19 Drawing Sheets

(56) References Cited

U.S. PATENT DOCUMENTS

| | | | | |
|---|---|---|---|---|
| 3,518,017 | A | 6/1970 | Schmidt | |
| 3,572,955 | A | 3/1971 | Andreka | |
| 3,586,451 | A | 6/1971 | Canton | |
| 3,586,453 | A | 6/1971 | Anderka | |
| 3,700,340 | A | 10/1972 | Terasaki | |
| 3,856,420 | A | 12/1974 | Oltmann | |
| 3,887,287 | A | 6/1975 | Rosh, Jr. | |
| 3,910,705 | A | 10/1975 | Schumacher | |
| 3,917,416 | A | 11/1975 | Steyer | |
| 3,944,371 | A | 3/1976 | Schenk | |
| 3,989,389 | A | 11/1976 | Hashimoto et al. | |
| 4,022,535 | A | 5/1977 | Ritter | |
| 4,080,077 | A | 3/1978 | Schumacher | |
| 4,115,015 | A | 9/1978 | Torii | |
| 4,227,823 | A | 10/1980 | Kitzerow | |
| 4,236,418 | A | 12/1980 | Lum | |
| 4,269,525 | A | 5/1981 | Melikian | |
| 4,272,206 | A | 6/1981 | Treen | |
| 4,274,102 | A | 6/1981 | Lum | |
| 4,343,559 | A | 8/1982 | Silver | |
| 4,359,291 | A | 11/1982 | Lum | |
| 4,378,171 | A | 3/1983 | Schmidt | |
| 4,405,931 | A | 9/1983 | Fujisawa | |
| 4,504,838 | A | 3/1985 | Tamai et al. | |
| 4,517,576 | A | 5/1985 | Sugawara | |
| 4,527,176 | A | 7/1985 | Fujiwara et al. | |
| 4,540,300 | A | 9/1985 | Midorikawa | |
| 4,545,819 | A | 10/1985 | Shioi et al. | |
| 4,560,298 | A | 12/1985 | Oki et al. | |
| 4,595,307 | A | 6/1986 | Heyden | |
| 4,614,952 | A | 9/1986 | Nara et al. | |
| 4,673,954 | A | 6/1987 | Sakai | |
| 4,692,046 | A | 9/1987 | Lan | |
| 4,702,633 | A | 10/1987 | Schmidt | |
| 4,711,592 | A | 12/1987 | Gregory | |
| 4,759,650 | A | 7/1988 | Granoff | |
| 4,872,027 | A | 10/1989 | Buskirk et al. | |
| 4,944,624 | A | 7/1990 | Garland | |
| 4,948,285 | A | 8/1990 | Schleif | |
| 4,969,764 | A | 11/1990 | Gregory | |
| 4,972,947 | A | 11/1990 | McCarthy | |
| 5,039,232 | A | 8/1991 | Kerzel et al. | |
| 5,091,005 | A | 2/1992 | Mueller et al. | |
| 5,174,814 | A | 12/1992 | Burwell et al. | |
| 5,203,638 | A | 4/1993 | Redmond, Jr. | |
| 5,206,190 | A | 4/1993 | Jean et al. | |
| 5,221,151 | A | 6/1993 | Kuo | |
| 5,293,184 | A | 3/1994 | Ishizuka | |
| 5,306,092 | A | 4/1994 | Jenq | |
| 5,354,140 | A | 10/1994 | Diakoulas | |
| 5,368,405 | A | 11/1994 | Sixiong | |
| 5,440,327 | A | 8/1995 | Stevens | |
| 5,518,330 | A | 5/1996 | Gervais et al. | |
| 5,518,534 | A | 5/1996 | Pearlstine et al. | |
| 5,564,849 | A | 10/1996 | Greer, Jr. | |
| 5,583,545 | A | 12/1996 | Pawlowski, Jr. et al. | |
| 5,599,122 | A | 2/1997 | Yu | |
| 5,602,574 | A | 2/1997 | Williams | |
| 5,659,345 | A | 8/1997 | Altendorf | |
| 5,673,996 | A | 10/1997 | Ducker | |
| 5,739,801 | A | 4/1998 | Sheridon | |
| 5,750,594 | A | 5/1998 | Page et al. | |
| 5,751,268 | A | 5/1998 | Sheridon | |
| 5,760,761 | A | 6/1998 | Sheridon | |
| 5,767,828 | A | 6/1998 | McKnight | |
| 5,812,165 | A | 9/1998 | Boyd et al. | |
| 5,841,455 | A | 11/1998 | Tanaka et al. | |
| 5,844,577 | A | 12/1998 | Pawlowski, Jr. | |
| 5,888,007 | A | 3/1999 | Nicoll et al. | |
| 5,913,629 | A | 6/1999 | Hazzard | |
| 5,967,684 | A | 10/1999 | Huang et al. | |
| 5,984,559 | A | 11/1999 | Shiobara et al. | |
| 5,997,204 | A | 12/1999 | Ducrocq | |
| 6,092,951 | A | 7/2000 | Greene et al. | |
| 6,155,733 | A | 12/2000 | Holbrook et al. | |
| 6,213,661 | B1 | 4/2001 | Coon | |
| 6,273,627 | B1 | 8/2001 | Mittersinker et al. | |
| 6,305,865 | B1 | 10/2001 | Yoshii et al. | |
| 6,379,068 | B1 | 4/2002 | Yu | |
| 6,540,422 | B2 | 4/2003 | Torii | |
| 6,609,846 | B1 | 8/2003 | Lai et al. | |
| 6,623,136 | B1 | 9/2003 | Kuo | |
| 6,752,557 | B1 | 6/2004 | Hsieh | |
| 6,773,185 | B1 | 8/2004 | Hsieh | |
| 6,830,402 | B2 | 12/2004 | Sunatori | |
| 7,059,796 | B2 * | 6/2006 | Lewis et al. | 401/107 |
| 7,220,073 | B2 | 5/2007 | Yoon | |
| 7,465,112 | B2 * | 12/2008 | Qiu | 401/107 |
| 7,537,405 | B2 * | 5/2009 | Breuer et al. | 401/108 |
| 2002/0192007 | A1 | 12/2002 | Lee | |
| 2007/0274764 | A1 * | 11/2007 | Shim | 401/108 |

OTHER PUBLICATIONS

Office Action; Non-Final Rejection, Mailing Date: Jan. 27, 2012, U.S. Appl. No. 13/093,033.

Office Action; Notice of Allowance, Mailing Date: Aug. 27, 2012, U.S. Appl. No. 13/093,033.

* cited by examiner

MULTICOLOR WRITING TOOLS AND METHODS

CROSS-REFERENCE TO RELATED APPLICATIONS

The present application is a continuation application of U.S. application Ser. No. 13/093,033 filed on Apr. 25, 2011, which is now U.S. Pat. No. 8,322,938, which in turn is a continuation application of U.S. application Ser. No. 11/441,102 filed on May 26, 2006 which is now U.S. Pat. No. 7,950,862, the disclosure of which are hereby incorporated by reference and for which priority is claimed under 35 U.S.C. Section 120. The present application claims a prior invention date of a Disclosure Document entitled "Capless Writing Tools and Methods" which was deposited in the USPTO on Sep. 7, 2004 under the Disclosure Document Deposit Program of the USPTO and which bears a Ser. No. 560,239, and also claims another prior invention date of another Disclosure Document entitled "Multicolor Writing Tools and Methods" which was deposited in the USPTO on Mar. 1, 2005 under the Program and which bears a Ser. No. 571,688, the disclosure of which are hereby incorporated by reference. All of the above applications and Documents are to be referred to as the "co-pending Applications" hereinafter.

BACKGROUND OF THE INVENTION

Field of the Invention

The present invention generally relates to various multicolor writing tools and methods thereof for applying multiple volatile marking substances one at a time. More particularly, the present invention relates to multicolor writing tools including a case member, a cartridge member, a cap member, and an actuator member. The case member forms an interior in which is disposed the cartridge member with the multiple cartridges each of which defines a body containing one of the marking substances therein and a tip through which such a marking substances is applied. The cap member varies and restores at least one configuration thereof, while the actuator member changes the configuration and exposes one of the tips selected by a user out of said interior when the tool is in use, and then restores such a configuration and encloses all of said tips inside the interior when the tool is not in use. Therefore, such writing tools preferably open the cap member in response to input force applied to other parts of the tools by the user, without having to require the user to engage in a separate maneuver to remove the cap member from such tools. In addition, such tools also close the cap member after the use as a response to the cartridge member which retracts into the interior of the case member, without having to require the user to engage in another separate maneuver to place the cap back to the tools. Thus, such tools of the present invention effectively prevent drying of tips of the cartridges when the tool is not in use. The present invention also relates to various methods of exposing tips of the cartridges of such tools out of the interior through various accesses provided in bottom ends of the tools, various methods of actuating such members of the tools, and various methods of moving multiple cartridges out of and into the interior of the tools. The present invention further relates to various processes for providing such multicolor writing tools and/or various members thereof.

Pens, pencils, and other writing instruments have been evolving with the history of mankind. With the advent of chemical technologies of synthesizing inks and dyes, current writing instruments allow a user to write or draw in numerous colors of his or her choice. Such writing instruments may be categorized into two groups based on physical characteristics of marking substances employed thereby, e.g., those employing volatile, less volatile or nonvolatile marking substances.

When the volatile marking substances are employed, they continuously evaporate through tips of such writing instruments and tend to form deposits or chunks of inks or dyes on such tips, which not only interfere with normal operation of the instruments but also shorten their life span. In order to prevent such evaporation, all conventional writing tools using such volatile marking substances come with caps capable of being disposed over and removed from the tips so that an user may remove the caps from the tips and write or draw. After use, the user may then put such caps back over the tips to enclose such tips and to prevent evaporation of the marking substances therethrough. Because such caps are generally provided as separate articles, the user has to keep track of whereabouts of such caps while he or she uses the writing instruments. When the caps are lost, the user has to find other caps or to ditch the entire instruments. In order to overcome this inconvenience, some caps are coupled to such instruments by string, chains, strips or other conventional couplers. Other caps are coupled to the instruments by forming unitary articles therewith. Regardless of detailed configurations thereof, such writing instruments still mandate the user to remove the caps before she or he uses the tools and to put the caps back after she or he is done with writing or drawing.

Compared with less- or nonvolatile marking substances, volatile marking substances generally employ water or volatile solvents as their base and includes inks or dyes mixed or suspended therein. In addition, such volatile marking substances tend to be applied through thicker and/or wider tips of the instruments for underlining or coloring purposes. Accordingly, conventional writing instruments using the volatile marking substances tend to last a shorter period of life than those tools using the less- or nonvolatile substances. For this reason, the conventional instruments generally has a single cartridge containing such a volatile marking substance and a single tip dispensing a single color, thus requiring the user to carry several different tools when she or he wants to mark or underline in several colors.

Multicolor writing instruments have been in use since 1950s. For example, some instruments include multiple sidebars each assigned to a different cartridge containing a marking substance with a different color, and others employ a case which rotates or otherwise moves along multiple directions each arranged to actuate a different cartridge. However, these multicolor writing instruments have been developed solely for those cartridges containing the less- or nonvolatile marking substances.

Accordingly, there is a strong need for multicolor writing tools which incorporate various cap members capable of exposing tips of different cartridges one at a time during use and then enclosing the tips before or after use for the purpose of minimizing evaporation of such substances through the tips. More importantly, there also is an urgent need for the multicolor writing tools capable of opening and closing the cap member by other parts of the tools, thereby obviating the user from engaging in a separate maneuver of manipulating such a cap member.

SUMMARY OF THE INVENTION

The present invention generally relates to various multicolor writing tools and methods thereof for applying multiple volatile marking substances one at a time. More particularly, the present invention relates to multicolor writing tools including a case member, a cartridge member, a cap member, and an actuator member. The case member forms an interior in which is disposed the cartridge member with the multiple cartridges each of which defines a body containing one of the marking substances therein and a tip through which such a marking substances is applied. The cap member varies and restores at least one configuration thereof, while the actuator member changes the configuration and exposes one of the tips selected by a user out of said interior when the tool is in use, and then restores such a configuration and encloses all of said tips inside the interior when the tool is not in use. Therefore, such writing tools preferably open the cap member in response to input force applied to other parts of the tools by the user, without having to require the user to engage in a separate maneuver to remove the cap member from such tools. In addition, such tools also close the cap member after the use as a response to the cartridge member which retracts into the interior of the case member, without having to require the user to engage in another separate maneuver to place the cap back to the tools. Thus, such tools of the present invention effectively prevent drying of tips of the cartridges when the tool is not in use.

Additional aspects and/or advantages of the invention will be set forth in part in the description which follows and, in part, will be obvious from the description, or may be learned by practice of the invention.

The present invention also relates to various methods of exposing tips of the cartridges of the writing tools out of the interior through various accesses provided in bottom ends of the tools, various methods of actuating various members of the tools, and various methods of moving multiple cartridges out of and into the interior of the tools. In addition, the present invention relates to various methods of preventing tips of such tools from drying without using conventional removable caps, various methods of incorporating various mobile caps into the writing tools so as to obstruct and clear openings and/or conduits of the writing tools when the tools are respectively in non-use and use, various methods of preventing or minimizing leaking of the marking substances out of the writing tools, various methods of enclosing and exposing the tips of such tools and obstructing and clearing various accesses of such tools by synchronizing or coupling operations of such tips with those of the caps, and the like.

The present invention further relates to various processes for providing and/or making various writing tools which have configurational and/or operational characteristics described in the above two previous paragraphs. More particularly, the present invention relates to various processes for making the writing tools for applying volatile marking substances onto articles from each of multiple cartridges but not requiring removable caps, thereby prevent drying of their tips when such tools are not in use. The present invention also relates to various processes for providing the tools incorporated with one or more caps configured to fixedly or movably couple with such tools, to operate between on-states and off-states, to obstruct openings and/or conduits of such tools for preventing drying of their tips in the off-states, and to clear the openings and/or conduits for exposing their tips therethrough in the on-states. The present invention further relates to various processes for providing such tools capable of synchronizing and/or coupling the caps with such tips so that the caps may clear the openings and/or conduits as the tips advance downwardly and become exposed out of the interior and that such caps may obstruct the openings and/or conduits when such tips retract back into the interior after use. The present invention also relates to various processes for providing various members of such tools (e.g., case members, cap members, cartridge members, actuator members, and so on) and/or various units of these members (e.g., absorber units, recoil units, dividers, separators, and the like).

The multicolor writing tools of the present invention offer various advantages. First of all, such tools carry multiple cartridges each containing different marking substances. Accordingly, such tools allow the user to carry a single multicolor writing tool instead of requiring her or him from carrying the same number of conventional writing instruments. Secondly, such tools incorporate the cap member coupling with various parts of the tools. Accordingly, the user has to neither remove the cap member during use nor put back the cap member after use. In addition, such tools of this invention may employ various actuating mechanisms so that input force applied to one part of the tools actuates one of the cartridges which then actuates the cap member or, conversely, such force actuates the cap member which than actuates one of the cartridges. Therefore, the user only has to apply the input force once and for all, without having to engage in separate maneuvers solely to open or close the cap member. The writing tools of the present invention also employ replaceable cartridges. Therefore, when one of the cartridges runs out of the marking substance, all she or he has to do is to replace the old cartridge with a new one. The cartridges of such writing tools may be actuated through various conventional technologies which are commonly employed in conventional multicolor writing instruments using less- or nonvolatile marking substances or through modifications of such technologies. Thus, such writing tools of this invention may be readily fabricated without having to spend enormous time and efforts to develop new technologies. The multicolor writing tools of this invention include various absorber units disposed in or around the interior or exterior of the tools and absorbing the marking substances which leak from the tips of the cartridges due to mechanical impacts, pressure gradients, suction, and so on. Thus, the user does not have to worry about leakage of such marking substances out of such tools. The multicolor writing tools also include various dividers disposed inside the interior and defining an enclosed space which is smaller than the interior and in which such tips are to be disposed when the tools are not in use. Accordingly, evaporation of the substances from the tips is reduced to a minimal amount. The multicolor writing tools further include various separators disposed between the tips and prevent contacts therebetween. Thus, different marking substances contained in different cartridges do not contaminate the tips before, during, and after use. Other benefits of the multicolor writing tools of this invention will be apparent from the following summary, detailed description, and claims.

Any conventional writing instruments using water as a base for their marking substances may be combined and converted into the multicolor writing tools of this invention, where examples of such instruments may typically include, but not be limited to, highlighters, fountain pens, roller pens, coloring pens, sign pens, and so on. Any conventional writing instruments employing more volatile solvents as bases of their marking substances may also be combined and converted to the multicolor writing tools of the present invention, where examples of those tools may include, but not be limited to, permanent marker pens, erasable marker pens, and so on. As described herein, the writing tools of the present invention may obviate use of the conventional removable caps, e.g., by enclosing tips of such tools in the interior thereof and through preventing evaporation of the water-based or solvent-based marking substances when the tools are not in use, and then by exposing such tips one at a time through the cap members during use of such tools. The writing tools of the present invention may include multiple cartridges each containing therein correction fluids, manicures, water-based paints, oil-based paints, other water-based and/or solvent-based marking substances, and so on, in order to be used as, e.g., correction fluid pens, manicure pens, paint pens, and the like. It is noted that such multiple cartridges may contain marking substances of the same type in order to form, e.g., a multicolor highlighter pen capable of applying highlighting substances of different colors one at a time. The multiple cartridges may also contain marking substances of different types with the same or different colors in order to form, e.g., a pen capable of applying a yellow highlighting marking substance through one tip but a red permanent marking substance through another tip.

Other conventional writing instruments using various marking substances which are generally less volatile than water may also be modified and/or converted into the multicolor writing tools of this invention, where examples of such instruments may include, but not be limited to, ball-point pens, oil-based pens, mechanical pencils, and other conventional pens employing less- or nonvolatile fluids as bases for their marking substances. Although such conventional instruments do not require any caps per se, some may incorporate various removable caps for various reasons such as, e.g., preventing evaporation of the marking substances, protecting their tips from mechanical damages, protecting the user and/or his or her cloths from damages caused by such tips, and the like. Therefore, such writing tools of the present invention may also include multiple cartridges which may contain correction fluids, oil-based paints, manicure solutions, mascara fluids, lipstick gels or sols, other liquid- or solid-phase cosmetic products, and so on, in order to be utilized as, e.g., correction fluid pens, paint brush pens, manicure pens, mascara pens, lipstick pens, and the like. It is noted that such multiple cartridges may contain marking substances of the same type but different colors in order to provide, e.g., a manicure pen capable of applying manicures of different colors one at a time. The multiple cartridges may also contain marking substances of different types with the same or different colors in order to form, e.g., a pen capable of applying a violet manicure solution by one of its tips but a black mascara solution by another of such tips.

Various writing tools of the present invention may also be provided by modifying or converting other conventional writing instruments which do not typically use any fluid or gel marking substances but which require various cap members in order to provide protect their tips and/or the user from their sharp tips, where examples of such instruments may include, but not be limited to, mechanical pencils, crayons, and so on. The writing tools of this invention may also include multiple cartridges which may be made of and/or contain therein pastels, lipstick gels or sols, other fluid or solid marking substances, various pharmaceutical or medical ingredients in order to be used as, e.g., pastel pens, lipstick pens, pharmaceutical or medical ingredient applicators, and the like. Such writing tools of this invention may be made of and/or include multiple cartridges containing various non-marking fluid or solid substances for various purposes such as, e.g., preventing evaporation of such fluids or solids, protecting tips of such tools, protecting the user from such non-writing fluids or solids and/or from such tips of the non-writing tools, and the like, where examples of such non-writing tools may include, but not be limited to, glue pens, plastic or rubber cement pens, and the like.

In one aspect of the present invention, a writing tool may include multiple cartridges containing different marking substances therein and capable of applying the marking substances onto an article from one of the cartridges at a time.

In one exemplary embodiment of this aspect of the present invention, such a writing tool may have at least one case member, at least one cartridge member, at least one cap member, and at least one actuator member. The case member may be arranged to define an interior therein. The cartridge member may be arranged to be disposed in the interior and to have the cartridges each of which may be arranged to define a body including one of the marking substances therein as well as a tip through which such one of the marking substances may be applied onto the article. The cap member may be arranged to change and restore at least one configuration thereof with respect to the tips, while the actuator member may be arranged to change the configuration and to expose one of the tips selected by an user out of the interior when the tool is in use, and which may also be arranged to restore such configuration and to enclose all of the tips inside the interior when not in use. In one example, at least a portion of the cap member may be disposed inside the interior. In another example, at least a portion of the cap member may be fixedly coupled to at least one of other of such members and to not detach therefrom unless the cap member is to be replaced and/or broken. In yet another example, at least a portion of such a cap member may be arranged to be movably coupled to at least one of other of such members and to move while changing such configuration within a preset distance which may be less than a twice of a height of one of the tips, a width thereof, and/or a distance along which one of such tips may be arranged to move while changing the configuration. In another example, at least a portion of the cap member may optionally be arranged to couple with the tool during such use and such non-use while changing and restoring such a configuration.

In another exemplary embodiment of such an aspect of this invention, a writing tool may have at least one case member, at least one cartridge member, at least one cap member, and at least one actuator member. The case member may be arranged to define an interior therein, while the cartridge member may be arranged to be disposed in the interior and to have the cartridges each of which may be arranged to define a body having one of such marking substances therein and a tip through which one of the marking substances may be applied onto the article. The cap member may be arranged to change and restore at least one configuration thereof with respect to the tips of the cartridges. In one example, the actuator member may be arranged to change the configuration and to expose one of the tips of the cartridges selected by an user out of the interior when the tool is in use, and to restore the configuration and to enclose all of such tips in the interior as the tool is not in use. In another example, the actuator member may instead be arranged to advance one of such cartridges selected by an user downwardly and to expose the tip of such one of the cartridges out of the interior while changing the configuration when the tool is in use, and which may thereafter be arranged to retract such one of the cartridges upwardly into the interior while restoring the configuration and to enclose all of the tips inside the interior when the tool is not in use. In another example, the actuator member may instead be arranged to upwardly retract at least a portion of the case member while changing such configuration and to expose one of the tips of the cartridges selected by an user out of the interior when the tool is in use, and which may also be arranged to advance such a portion of the case member downwardly while restoring the configuration and enclosing all of the tips inside the interior when the tool is not in use. In another example, at least a portion of the cap member may optionally be arranged to couple with the tool during such use and non-use while changing and restoring such a configuration.

In another aspect of the present invention, a writing tool may include multiple cartridges and be capable of exposing the cartridges one at a time, where the cartridges may contain different marking substances and may be arranged to apply the marking substances onto an article one at a time.

In one exemplary embodiment of this aspect of the present invention, a writing tool may include at least one case member, at least one cartridge member, at least one cap member, and at least one actuator member. The case member may be arranged to define an interior therein and to form at least one opening which may be in fluid communication with the interior and with an exterior of the writing tool. The cartridge member may be arranged to be disposed inside the interior and to have the above cartridges each of which may be arranged to define a body containing one of the marking substances therein and a tip through which such one of the marking substances may be applied onto the article when exposed out of the interior through the opening. The cap member may be arranged to vary and to restore at least one configuration thereof and to respectively clear and obstruct at least a portion of such an opening. The actuator member may be arranged to change the configuration in order to clear the portion of the opening and then to expose one of the tips of the cartridges selected by an user out of the interior through the opening when the tool is in use, and may also be arranged to restore such configuration so as to retract such one of the tips into the interior through the opening and to enclose all of such tips inside the interior when not in use. In one example, the portion of the opening may be large enough to expose at least two of the tips of the cartridges simultaneously. In another example, such a portion of the opening may be arranged to be large enough to expose each of such tips one at a time, while such a cap member may be arranged to obstruct and clear the same portion of opening regardless of which one of the cartridges may be selected by the user. In another example, the cap member may instead be arranged to obstruct and to clear different portions of the opening as different cartridges may be selected by the user. In yet another example, at least a portion of the cap member may optionally be arranged to couple with the tool during such use and non-use while changing and restoring such a configuration.

In another exemplary embodiment of such an aspect of this invention, a writing tool may have at least one case member, at least one cartridge member, at least one cap member, and at least one actuator member. The case member may be arranged to define an interior therein, while the cartridge member may be arranged to be disposed inside the interior and to have the above cartridges each of which may be arranged to define a body containing one of the marking substances therein and a tip through which such one of the marking substances may be applied onto the article. The cap member may be arranged to be disposed in one end of such a case member and to vary and to restore at least one configuration thereof so as to respectively form and destroy a conduit extending from the interior to an exterior of the tool. The actuator member may be arranged to change the configuration in order to form such a conduit and to expose one of such tips of the cartridges selected by an user out of the interior through the conduit when the tool is in use, and which may further be arranged to restore the configuration in order to close the conduit and to enclose all of the tips inside the interior when the tool is not in use. In one example, the conduit may be arranged to be large enough to expose therethrough at least two of the tips of the cartridges simultaneously. In another example, the conduit may instead be arranged to be large enough to expose each tip of the cartridges therethrough one at a time, while the cap member may be arranged to form and close the identical conduit regardless of which one of the cartridges may be selected by the user. In yet another example, the cap member may be arranged to form and to close different conduits when different cartridges may be selected by the user. In yet another example, at least a portion of the cap member may optionally be arranged to couple with such a tool during such use and non-use while changing and restoring such a configuration.

In another aspect of the present invention, such a writing tool may include multiple cartridges each of which may contain a different marking substance therein and include a tip through which the marking substance may be applied onto an article in response to input force applied by an user to at least a portion of the tool.

In one exemplary embodiment of this aspect of the present invention, a writing tool may include at least one case member, at least one cap member, and at least one cartridge member. Such a case member may be arranged to define an interior and to retain such cartridges of the cartridge member in the interior.

In one example, the cap member may be arranged to be disposed in one end of the interior, to be coupled to the cartridge member, and to change and restore at least one configuration thereof so as to form and close an access to the interior from an exterior of the tool. The cartridge member may include such cartridges each of which may be arranged to receive the input force from the user and to advance downwardly in response to the input force one at a time while controlling the cap member to change its configuration, thereby exposing the tip out of the interior through the cap member when the tool is in use, and each of which may then be arranged to retract upwardly into the interior while manipulating the cap member to restore its configuration, thereby enclosing all of such tips inside the interior when the tool is not in use.

In another example, the cartridge member may include such cartridges each of which may be arranged to receive the input force from the user and to advance downwardly and retract upwardly in response to such input force one at a time in order to respectively expose the tip out of the interior and to enclose the tip in the interior. The cap member may be arranged to be disposed in one end of the interior, to change and restore at least one configuration thereof in response to the input force in order to respectively allow such each of the cartridges to advance and retract therethrough, thereby exposing at least one of the tips after changing the configuration and then enclosing all of such tips in the interior after restoring the configuration.

In both examples of this embodiment, at least a portion of such a cap member may optionally be arranged to couple with the tool during such use and non-use while changing and restoring such a configuration.

In another exemplary embodiment of such an aspect of this invention, a writing tool may have at least one case member, at least one cartridge member, and at least one cap member. Such a case member may be arranged to define an interior, to retain the cartridges in the interior, and to receive the input force, while the cartridge member may include the cartridges each of which may be arranged to advance downwardly and then to retract upwardly one at a time in order to respectively expose such a tip out of the interior and dispose the tip inside the interior. The cap member may be arranged to be disposed in one end of the interior and to change and restore at least one configuration thereof so as to form and close an access to the interior from an exterior of the case member.

In one example, such a case member may be arranged to receive at least substantially similar multiple input forces successively by its preset portion, and to advance and retract each of such tips one at a time in an alternating mode in response to the input forces while manipulating the cap member to respectively form and close the access to the interior, thereby exposing and enclosing one of such tips through the cap member and thereafter exposing and enclosing another of such tips through such a cap member in the alternating mode.

In another example, the case member may be arranged to receive at least substantially similar multiple input forces successively by its preset portion, and to advance and to retract each of the tips one at a time in an alternating mode in response to the input forces while manipulating the cap member to form and close the access to the interior respectively, thereby exposing one of the tips through the cap member and then enclosing such one of the tips into the interior while exposing another of the tips through the cap member in the alternating mode.

In another example, the case member may be arranged to receive at least substantially similar multiple input forces successively by a preset portion thereof, and to advance and to retract each of the tips one at a time in an alternating mode in response to the input forces. The cap member may be arranged to respectively form and close the access to the interior in response to such input forces in the alternating mode, thereby exposing one of such tips out of the interior and enclosing the tip inside the interior through the cap member, and thereafter exposing another of the tips out of the interior and enclosing such a tip in the interior through the cap member in the alternating mode.

In another example, the case member may be arranged to receive different input forces one at a time through its preset portion and to advance and retract one of the tips which may be selected by a direction of each of the input forces while manipulating such a cap member respectively to form and close the access to the interior, thereby exposing and enclosing such one of the tips through the cap member.

In another example, the case member may be arranged to receive different input forces one at a time through its preset portion and to advance and retract one of the tips which may be selected by a direction of each of the input forces, while the cap member may be arranged to respectively form and close the access to the interior in response to the each of the input forces, thereby exposing and enclosing the one of the tips respectively through the cap member.

In another example, the case member may be arranged to receive the input force through one of multiple portions thereof and to advance and retract one of the tips selected by a location of one of the portions while controlling the cap member respectively to form and close the access to the interior, thereby exposing and enclosing the one of the tips through the cap member.

In yet another example, the case member may be arranged to receive such input force through one of multiple portions thereof and then to advance and retract one of the tips selected by a location of the portions. The cap member may also be arranged to respectively form and close the access to the interior, thereby exposing and enclosing the one of the tips respectively through the cap member.

In all examples of such an embodiment, at least a portion of the cap member may optionally be arranged to couple with the tool during such use and non-use while changing and restoring such a configuration.

In another exemplary embodiment of such an aspect of this invention, a writing tool may have at least one case member, at least one cartridge member, and at least one cap member. Such a case member may be arranged to define an interior and to retain the cartridges in the interior, whereas the cartridge member may have the cartridges each of which may be arranged to advance downwardly and then to retract upwardly one at a time in order to expose the tip out of the interior and to dispose the tip inside the interior, respectively.

In one example, the cap member may be arranged to be disposed in one end of the interior, to receive at least substantially similar multiple input forces successively by a preset portion thereof, and to vary and restore at least one configuration thereof so as to respectively form and close an access to the interior from an exterior of the case member while advancing and retracting each of the tips one at a time in an alternating mode in response to the input forces, thereby exposing and enclosing one of the tips through the cap member, and then exposing and enclosing another of the tips through the cap member in the alternating mode.

In another example, the cap member may be arranged to be disposed in one end of the interior, to receive at least substantially similar multiple input forces successively by a preset portion thereof, and to change and restore at least one configuration thereof so as to respectively form and close an access to the interior from an exterior of the case member while advancing and retracting each of the tips one at a time in an alternating mode in response to the input forces, thereby exposing one of such tips through the cap member and then enclosing such one of the tips into the interior, while exposing another of the tips through the cap member in the alternating mode.

In another example, the cap member may be arranged to be disposed in one end of the interior, to receive at least substantially similar multiple input forces successively by a preset portion thereof, and to change and restore at least one configuration thereof so as to respectively form and close an access which may extend from the interior to an exterior of the case member in an alternating mode. The cartridge member may be arranged to advance and retract each of the tips one at a time through the cap member in response to the input forces in the alternating mode, thereby rendering one of such tips exposed out of and enclosed in the interior through the cap member, and then rendering another of the tips exposed out of and enclosed in the interior through the cap member in the alternating mode.

In another example, the cap member may be arranged to be disposed in one end of the interior, to receive different input forces one at a time by a preset portion thereof, and to change and restore at least one configuration thereof so as to respectively form and close an access to the interior from an exterior of the case member while advancing and retracting one of the tips selected by a direction of each of the input forces, thereby exposing and then enclosing such one of the tips through the cap member.

In another example, the cap member may be arranged to be disposed in one end of the interior, to receive different input forces one at a time by a preset portion thereof, and to change and restore at least one configuration thereof so as to respectively form and close an access to the interior from an exterior of the case member. The cartridge member may be arranged to advance and retract one of the tips selected by a direction of each of the input forces, thereby exposing such one of the tips out of the interior and then enclosing such one of the tips inside the interior respectively through the cap member.

In another example, the cap member may be arranged to be disposed in one end of the interior, to receive the input force through one of multiple portions thereof, and to change and restore at least one configuration thereof so as to respectively form and close an access extending from the interior to an exterior of the case member while advancing and retracting one of the tips to be selected by a location of the one of the portions, thereby exposing and enclosing the one of the tips through the cap member.

In yet another example, such a cap member may be arranged to be disposed in one end of the interior, to receive the input force through one of multiple portions thereof, and to change and restore at least one configuration thereof so as to respectively form and close an access to the interior from an exterior of the case member. The cartridge member may be arranged to advance and retract one of the tips selected by a location of such one of the portions, thereby respectively exposing such one of the tips out of the interior and enclosing such one of the tips inside the interior.

In all examples of such an embodiment, at least a portion of the cap member may optionally be arranged to be coupled to the tool during such use and non-use while changing and restoring such a configuration.

In another aspect of the present invention, a writing tool may have multiple cartridges each of which may be filled with at least one marking substance and each of which may include a tip through which the marking substance may be applied onto an article, while preventing the marking substances from leaking out of the tips onto the article.

In one exemplary embodiment of such an aspect of this invention, a writing tool may include at least one case member, at least one cartridge member, at least one cap member, in addition to at least one absorber unit. The case member may be arranged to define an interior therein, while the cartridge member may be arranged to have the cartridges, to expose each of the tips out of the interior one at a time when the tool is in use, and to enclose all of the tips inside the interior when the tool is not in use. The cap member may be arranged to vary and restore at least one configuration thereof, while such an absorber unit may be arranged to be disposed near the tips and to absorb the marking substances leaked from the tips. In addition, at least one of such members may be arranged to receive input force applied by an user, while the cap and cartridge members may be arranged respectively to change the configuration and to expose the tips out of the interior one at a time as a response to the input force when the tool is in use, and the cap and cartridge members may further be arranged respectively to restore the configuration and to enclose all of the tips inside the interior when the tool is not in use. In addition, at least a portion of the cap member may optionally be arranged to couple with the tool during such use and non-use while changing such a configuration.

In another exemplary embodiment of such an aspect of this invention, a writing tool may also have at least one case member, at least one cartridge member, at least one cap member, at least one actuator member, as well as at least one absorber unit. The case member may be arranged to define an interior therein, while the cartridge member may be arranged to include the cartridges, to expose each of the tips out of the interior one at a time when the tool is in use, and to enclose all of such tips inside the interior when the tool is not in use. The cap member may be arranged to vary and restore at least one configuration thereof, while the actuator member may be arranged to receive input force applied thereto by an user and to manipulate the cartridge and cap members directly or indirectly as a response to the input force, thereby varying the configuration of the cap member and exposing each of the tips out of the interior when the tool is in use and thereby restoring the configuration of the cap member and enclosing all of the tips inside the interior when the tool is not in use.

In one example, the absorber unit may be arranged to be fixedly or movably coupled to at least one of the members and to absorb the marking substances, thereby minimizing leakage of the marking substances from the tips out of the tool. In another example, the absorber unit may be arranged to be disposed in the interior and near the tips and to absorb the marking substances, thereby absorbing the marking substances leaked from the tips before such leaked substances may leak through the tool. In another example, the absorber unit may instead be arranged to be disposed on an outer surface of the case member and to absorb the marking substances, thereby absorbing the marking substances leaked from the tips before the leaked substances escape the tool. In another example, the absorber unit may rather be arranged to be coupled to the cartridge and/or cap members, to absorb the marking substances, to be disposed inside the interior and absorb the marking substances leaked from the tips when the tool is not in use, and to move with the at least one of the cartridge and cap members when the tool is in use. In yet another example, the absorber unit may instead be arranged to be coupled to the cartridge member and to absorb the marking substances, thereby capable of being replaced by a new absorber unit whenever the cartridge member may dispense at least a substantial portion of the marking substance and be replaced by a new cartridge member. In all examples of this embodiment, at least a portion of the cap member may be optionally arranged to couple with the tool during the use and non-use while changing and restoring such a configuration.

In another aspect of the present invention, a writing tool may have multiple cartridges each of which may be filled with at least one marking substance and each of which may include a tip through which the marking substance may be applied to an article, while suppressing the marking substances evaporating out of the tips when the tool is not in use.

In one exemplary embodiment of such an aspect of this invention, such a writing tool may have at least one case member, at least one cartridge member, at least one cap member, as well as at least one divider. The case member may be arranged to form an interior therein, and the cartridge member may be arranged to include such cartridges, to expose each of the tips out of the interior one at a time when the tool is in use, and to enclose all of the tips inside the interior when the tool is not in use. The cap member may be arranged to vary and restore at least one configuration thereof, whereas such a divider may be arranged to be disposed inside the interior and to define an enclosed space which may correspond to only a fraction of the interior and in which all of the tips may be enclosed when the tool is not in use, thereby minimizing an amount of the marking substances which may evaporate from the tips into the space when the tool is not in use. In addition, at least one of such members may also be arranged to receive input force from an user. The cap and cartridge members may also be arranged respectively to change the configuration and to expose such tips out of the interior one at a time as a response to the input force when the tool is in use, while the cap and cartridge members may further be arranged to respectively restore the configuration and enclose all of the tips in the interior as such a tool is not in use. At least a portion of the cap member may optionally be arranged to be coupled to the tool during such use and non-use while changing and restoring such a configuration.

In another exemplary embodiment of such an aspect of this invention, such a writing tool may have at least one case member, at least one cartridge member, at least one cap member, at least one actuator member, and at least one divider.

Such a case member may be arranged to define an interior therein and a bottom end, while the cartridge member may be arranged to include such cartridges, to expose each of the tips out of the interior one at a time when the tool is in use, and then to enclose all of the tips inside the interior when the tool is not in use. The cap member may be arranged to change and restore at least one configuration thereof. The actuator member may be arranged to receive input force from an user and to manipulate the cartridge and cap members directly or indirectly in response to the input force, thereby varying the configuration of the cap member and exposing each of the tips out of the interior when the tool is in use, and then restoring the configuration of the cap member and enclosing all of the tips inside the interior when the tool is not in use.

In one example, the divider may be arranged to be fixedly or movably coupled to at least one of such members and to define an enclosed space which may be arranged to extend to such a bottom end therefrom and to correspond to only a fraction of the interior and in which all of such tips may be enclosed when the tool is not in use, thereby minimizing an amount of the marking substances which may evaporate from the tips to the space when the tool is not in use.

In another example, the divider may be arranged to be disposed around the cartridges and also upwardly with respect to the tips, to abut an inner surface of the case member, and then to define an enclosed space which may be bound by the divider, inner surface, and bottom end and also arranged to correspond to only a fraction of the interior, thereby minimizing amounts of the marking substances evaporating from the tips into the space when the tool is not in use.

In another example, the divider may be arranged to be fixedly disposed perpendicular to a long axis or a longitudinal axis of the case member and to allow the cartridges to move therethrough while defining and maintaining an enclosed space which may be arranged to extend therefrom toward the bottom end, thereby minimizing an amount of the marking substances evaporating from the tips into the space when the tool is not in use.

In another example, the divider may be arranged to be coupled to at least one of the cartridges and to advance and retract with such at least one of the cartridges while defining an enclosed space extending therefrom to the bottom end, thereby minimizing amounts of the marking substances which may evaporate from the tips into the space when the tool is not in use.

In yet another example, the divider may be arranged to couple to at least one of the cartridges and to advance and retract with such at least one of the cartridges while defining an enclosed space extending therefrom to the bottom end, thereby capable of being replaced by a new divider whenever such a cartridge member may dispense at least a substantial portion of the marking substance and be replaced by a new cartridge member.

In all examples of such an embodiment, at least a portion of the cap member may be optionally arranged to couple with the tool during such use and non-use while changing and restoring such a configuration.

In another aspect of the present invention, a writing tool may have multiple cartridges each of which may be filled with at least one marking substance and each of which may include a tip through which the marking substance may be applied onto an article, while minimizing contamination of the tips due to contact therebetween and mixing of the marking substances therefrom.

In one exemplary embodiment of such an aspect of this invention, such a writing tool may have at least one case member, at least one cartridge member, at least one separator, and at least one cap member. The case member may be arranged to define an interior therein, while the cartridge member may be arranged to include such cartridges, to expose each of the tips out of the interior one at a time when the tool is in use, and then to enclose all of the tips inside the interior when the tool is not in use. The separator may be arranged to be incorporated between at least two of such tips and to prevent physical contacts between such tips, thereby preventing mixing of the marking substances contained in different cartridges when the tool is in use and/or not in use. The cap member may be arranged to change and restore at least one configuration thereof. At least one of the members may be arranged to receive input force from an user. The cap and cartridge members may be arranged respectively to vary the configuration and to expose the tips out of the interior one at a time in response to such input force when the tool is in use, while the cap and cartridge members may also be arranged respectively to restore the configuration and to enclose all of the tips inside the interior when the tool is not in use. At least a portion of the cap member may optionally be arranged to couple with the tool during the use and non-use while changing and restoring such a configuration.

In another exemplary embodiment of such an aspect of this invention, such a writing tool may have at least one case member, at least one cartridge member, at least one cap member, at least one actuator member, and at least one separator. The case member may be arranged to define an interior therein and a bottom end, while the cartridge member may be arranged to include such cartridges, to expose each of the tips out of the interior one at a time when the tool is in use, and then to enclose all of the tips inside the interior when the tool is not in use. The cap member may be arranged to change and restore at least one configuration thereof, while the actuator member may be arranged to receive input force from an user and then to manipulate the cartridge and cap members directly or indirectly in response to the input force, thereby varying the configuration of the cap member and exposing each of the tips out of the interior when the tool is in use and thereby restoring the configuration of the cap member and enclosing all of the tips inside the interior when the tool is not in use.

In one example, the separator may be arranged to fixedly and/or movably couple with at least one of the members and to be disposed between at least two of the tips, thereby preventing physical contacts between the tips and mixing of the marking substances contained in different cartridges. In another example, the separator may be arranged to extend inwardly from the case member into such an interior and to be disposed between at least two of the tips when the cartridges are disposed into the case member, thereby avoiding physical contacts between the tips and also preventing mixing of the marking substances contained in different cartridges. In another example, multiple separators may be arranged to be disposed near the tips and to be oriented toward at least one another of the tips as such cartridges may be disposed into the case member, thereby avoiding physical contacts between the tips and also preventing mixing of the marking substances contained in different cartridges. In yet another example, multiple separators may be arranged to be disposed near the tips and to be oriented toward at least one another of the tips when the cartridges are disposed in the case member, thereby capable of being replaced by a new separator when such a cartridge member may dispense at least a substantial portion of the marking substance and be replaced by a new cartridge member. In all of these examples, at least a portion of the cap member may optionally be arranged to be coupled to the tool during such use and non-use while changing and restoring such a configuration.

In another aspect of the present invention, a writing tool may include multiple cartridges each of which may be filled with at least one marking substance and each of which may have a tip through which the marking substance may be applied onto an article, while exposing the tips of the cartridges one at a time.

In one exemplary embodiment of such an aspect of this invention, such a writing tool may have at least one case member, at least one cartridge member, and at least one cap member. Such a case member may be arranged to form an interior therein, the cartridge member may include the cartridges, and the cap member may be arranged to change and then restore at least one configuration thereof, where at least one of the members may be arranged to receive input force from an user.

In one example, such cartridges may be arranged to be enclosed in the interior, to be disposed close to each other and close to the case member when the tool is not in use. One of such cartridges may then be arranged to translate and/or to rotate downwardly and to expose its tip out of the interior through the cap member one at a time in response to the input force while the rest of such cartridges may not significantly move when the tool is in use. Such one of the cartridges may then be arranged to rotate and/or translate upwardly, to retract its tip into the interior through the cap member, and then to dispose all of the tips of the cartridges inside the interior after the use of the tool.

In another example, the cartridges may be arranged to be enclosed inside such an interior, to be placed away from each other but close to the case member when the tool is not in use. Such one of the cartridges may then be arranged to translate and/or rotate downwardly while moving close to at least one of the rest of the cartridges, to expose its tip out of the interior through the cap member one at a time while the rest of the cartridges may not significantly move in response to the input force when the tool is in use. Such one of the cartridges may then be arranged to translate and/or rotate upwardly, to move back close to the case member, and to retract its tip into the interior through such a cap member, thereby disposing all of the tips of the cartridges inside the interior after the use of such a tool.

In another example, the cartridges may be arranged to be enclosed inside such an interior, to be disposed close to each other but away from the case member as the tool is not in use. Such one of the cartridges may be arranged to translate and/or rotate downwardly while moving the cartridges including itself closer to a portion of the case member and exposing its tip out of the interior through the cap member one at a time when the tool is in use. Such one of the cartridges may be arranged to translate and/or rotate upwardly while moving the cartridges including itself away from the portion of the case member, and to retract its tip into the interior through the cap member, thereby disposing all of the tips of the cartridges inside the interior after the use of the tool.

In all examples of such an embodiment, at least a portion of the cap member may optionally be arranged to couple with the tool during such use and such non-use while changing and restoring the configuration.

In another exemplary embodiment of such an aspect of this invention, such a writing tool may have at least one case member, at least one cap member, and at least one cartridge member. Such a case member may have a longitudinal axis and form an interior which may in turn define a center and a periphery, form a center portion in and/or around the center, and form a periphery portion on and/or around the periphery. The cap member may be arranged to receive input force indirectly or directly from a user and to change at least one configuration thereof in response to the input force.

In one example, the cartridge member may include the cartridges at least two of which may be arranged to be disposed close to each other without defining any significant gap therebetween in the center portion and disposed close to the case member without defining a significant gap therewith in the periphery portion when the tool is not in use. Each of at least two of such cartridges selected by the input force may then be arranged to advance downwardly while exposing its tip through the cap member and out of the interior one at a time when the tool is in use. Thereafter, the tip of the each of at least two of such cartridges may be arranged to retract upwardly into the interior through the cap member after the use of the tool, thereby rendering all of the tips enclosed inside the interior when the tool is not in use.

In another example, the cartridge member may have the cartridges at least two of which may be arranged to be disposed away from each other while defining a gap therebetween near the center portion and to be disposed close to the case member without defining any significant gap therewith in the periphery portion when the tool is not in use. Each of the at least two of such cartridges selected by the input force may be arranged to move parallel to the axis of the case member and into the center portion, and to advance downwardly while exposing its tip through such a cap member and out of the interior one at a time when the tool is in use. Thereafter, the tip of such each of at least two of such cartridges may be arranged to retract upwardly into the interior through the cap member after the use of the tool, thereby rendering all of the tips enclosed inside the interior when the tool is not in use.

In another example, the cartridge member may have such cartridges at least two of which may be arranged to be disposed away from each other and to define a gap therebetween in such a center portion and to be disposed close to the case member without defining any significant gap therewith in the periphery portion when the tool is not in use. Each of such at least two of the cartridges selected by the input force may be arranged to be tilted by an acute angle with respect to the axis of the case member while moving its tip closer into the center portion and to advance downwardly while exposing its tip out of the interior through the cap member one at a time when the tool is in use. Thereafter, the tip of such each of at least two of the cartridges may be arranged to retract upwardly into the interior through the cap member after the use of the tool, thereby rendering all of the tips enclosed in such an interior when the tool is not in use.

In another example, the cartridge member may have such cartridges at least two of which may be arranged to be disposed away from each other and to define a gap therebetween in such a center portion and to be disposed close to the case member without defining any significant gap therewith in the periphery portion when the tool is not in use. Each of such at least two of the cartridges selected by the input force may be arranged to bend at least a bottom portion thereof toward the center portion and to advance downwardly while exposing its tip out of the interior through the cap member one at a time when the tool is in use. Such each of such at least two of the cartridges may then be arranged to retract its tip upwardly into the interior through the cap member while unbending its bottom portion after the use of the tool, thereby rendering all of the tips enclosed in the interior when the tool is not in use.

In another example, the cartridge member may have such cartridges at least two of which may be arranged to be disposed close to each other without defining any significant gap therebetween in the center portion and to be disposed away from such a case member while defining a gap therewith in the periphery portion when the tool is not in use. All of such cartridges may be arranged to move together parallel to the axis and toward the case member in response to the input force while placing each of such at least two of the cartridges selected by the input force into the center portion. Such each of such at least two of the cartridges may also be arranged to advance downwardly and then to expose its tip out of the interior through the cap member one at a time when the tool is in use. The tip of such each of such at least two of the cartridges may be thereafter arranged to retract upwardly into the interior through such a cap member after the use of the tool, thereby rendering all of such tips enclosed inside the interior when the tool is not in use.

In another example, the cartridge member may have such cartridges at least two of which may be arranged to be disposed close to each other without defining a significant gap therebetween in the center portion and to be disposed away from the case member while defining a gap therewith in such a periphery portion when the tool is not in use. All of the cartridges may be arranged to be tilted by an acute angle with respect to the axis of the case member in response to the input force while moving the tip of each of such at least two of the cartridges selected by the input force toward such a center portion. Each of such at least two of such cartridges may then be arranged to advance downwardly and to expose its tip out of the interior through the cap member one at a time as the tool is in use, and the tip of such each of such at least two of the cartridges may then be arranged to retract upwardly into the interior and through the cap member after the use of the tool, thereby rendering all of the tips enclosed inside the interior when the tool is not in use.

In all examples of such an embodiment, at least a portion of the cap member may optionally be arranged to couple with the tool during such use and such non-use while changing and restoring the configuration.

Embodiments of the foregoing aspects of the present invention may include one or more of the following features.

The cap members may be disposed and/or coupled according to various embodiments. In one example, at least a portion of the cap member may be arranged to be disposed inside such an interior. In another example, at least a portion of such a cap member may be arranged to be disposed around, near, above or below the opening of the case member. At least a portion of the cap member may also be arranged to be fixedly coupled to at least one of other of such members, and to not be detachable therefrom unless the cap member is broken and/or to be replaced. In addition, at least a portion of the cap member may be arranged to be movably coupled to at least one of other of such members and to move within a preset distance while changing its configuration, where such a distance may be less than a preset multiple of a height of one of the tips, a width thereof, a distance along which one of the tips may move while changing the configuration of the cap member and where such a multiple may be a twice or a thrice.

The actuator member may be arranged to change the configuration of the cap member while exposing one of the tips of the cartridges selected by the user (and/or input force) out of the interior through the opening and/or conduit when the tool is in use, and then to restore the configuration while enclosing all of the tips inside the interior when the tool is not in use. The actuator member may also be arranged to advance one of the cartridges selected by the user (and/or force) downwardly and to expose the tip of such one of the cartridges out of the interior through such an opening and/or conduit while changing such a configuration of the cap member when the tool is in use, and further arranged to retract such one of the cartridges upwardly into the interior while restoring the configuration and to enclose all of the tips of the cartridges in the interior when the tool is not in use.

The actuator member may further be arranged to retract at least a portion of the case member upwardly while changing the configuration of the cap member and to expose one of the tips of such cartridges selected by the user (and/or force) out of the interior through the opening and/or conduit as the tool is in use, and to advance such a portion of the case member downwardly while restoring the configuration of the cap member and to enclose all of the tips of the cartridges inside the interior when the tool is not in use.

The writing tool may further include at least one absorber unit arranged to couple with at least one of such members and to absorb the marking substances leaked from the tips, thereby minimizing leakage of the marking substances out of the interior. Such an absorber unit may be disposed close to, above, below, inside or outside the opening and/or conduit. The writing tool may further include at least one divider arranged to be disposed around the tips and to define an enclosed space which may be arranged to correspond to only a fraction of the interior and in which all of the tips of the cartridges may be disposed when the tool is not in use, thereby minimizing an amount of the marking substances which may evaporate thereinto from the tips as the tool is not in use. Such a divider may be disposed close to but upward of the tips of the cartridges. Such a writing tool may further include at least one separator arranged to be disposed between at least two of the tips and to prevent physical contacts between the tips, thereby preventing mixing of the marking substances in different cartridges. Such an absorber unit may couple with the separator when desirable.

The above access may be the opening provided to the case member and/or the conduit formed and closed by the cap member. Such an access may be arranged to maintain the same shape and/or size regardless of which of such cartridges may be selected by the user (and/or input force). In the alternative, the access may instead be arranged have different shapes and/or sizes depending upon which of the cartridges may be selected.

The input force may be applied to the actuator member and/or other members of the tool along various directions. For example, such a direction may be upward, downward, vertically and inwardly toward the case member, vertically and outwardly from the interior, angularly around the interior, and the like.

The cap member may change and/or restore at least one of configurations examples of which may include, but not be limited to, shapes thereof, sizes such as heights, lengths, width, thicknesses, and angles thereof, and arrangements between at least two caps when the cap member may include multiple caps.

The cartridge selected by such input force may advance downwardly and/or retract upwardly while translating and/or rotating by itself or while translating and/or rotating the rest of the cartridges which are not selected by such input force. Accordingly, each of the cartridges selected by the input force may expose its tip out of the interior through the same region of the opening and/or conduit or, in the alternative, through a different region of the opening and/or conduit.

In another aspect of the present invention, a cap member may also be provided to enclose an interior defined inside a case member of a writing tool from an exterior of the tool when the tool is not in use and to fluidly connect such an interior with the exterior through an opening defined in the case member as the tool is in use.

In one exemplary embodiment of such an aspect of the present invention, such a cap member may include a single cap which may be arranged to be at least partially supported by at least a part of the tool. The cap may be arranged to obstruct at least a substantial portion of the opening in at least one off-state thereof, thereby enclosing the interior when the tool is not in use, and may be arranged to rotate, pivot, translate, and/or deform from the off-state to at least one on-state in response to input force applied by an user while varying at least one of its configurations and to clear the portion of the opening while fluidly connecting the interior to the exterior when the tool is in use.

In another exemplary embodiment of this aspect of the present invention, such a cap member may include a single cap which may be arranged to be at least partially supported by at least a part of the tool. The cap may be arranged to obstruct at least a substantial portion of the opening in at least one off-state thereof, thereby enclosing the interior when the tool is not in use, and may be arranged to rotate, pivot, translate, and/or deform from the above off-state to one of multiple on-states thereof in response to input force applied to another portion of the tool by an user while changing at least one of its configurations and to clear one of multiple areas of the portion of such an opening while fluidly connecting the interior to the exterior as the tool is in use. Such one of the on-states and such one of the areas of the portion may be arranged to be determined according to a direction of the input force and/or a location of such another portion of the tool.

In another exemplary embodiment of this aspect of the present invention, such a cap member may include multiple caps which may be arranged to be at least partially supported by at least a part of the tool. Such caps may be arranged to obstruct at least a substantial portion of the opening in at least one off-state thereof, thereby enclosing the interior when the tool is not in use, and may also be arranged to rotate, pivot, translate, and/or deform from the above off-state to at least one on-state in response to input force applied by an user while varying at least one of its configurations and to clear the portion of the opening while fluidly connecting the interior to the exterior when the tool is in use.

In another exemplary embodiment of this aspect of the present invention, such a cap member may include multiple caps which may be arranged to be at least partially supported by at least a part of the tool. Such caps may be arranged to obstruct at least a substantial portion of the opening in at least one off-state thereof, thereby enclosing the interior as the tool is not in use, and a preset number of such caps may also be arranged to rotate, pivot, translate, and/or deform from the off-state to one of multiple on-states in response to input force which may be applied to another portion of the tool by an user while varying at least one of its configurations and to clear one of multiple areas of the portion of the opening while fluidly connecting the interior to the exterior when the tool is in use. The number of such caps, such one of the on-states, and such one of the areas of the portion may be arranged to be determined by a direction of the input force and/or a location of the another portion of the tool.

In another aspect of the present invention, a cap-actuator assembly for a writing tool may be provided to have a case member defining an interior therein and forming an opening in one of its ends.

In one exemplary embodiment of this aspect of the present invention, an assembly may include at least one cap member and at least one actuator member. The cap member may include a single cap which may be arranged to obstruct at least a substantial portion of the opening and to enclose such an interior from an exterior of the case member in its off-state, and may also be arranged to translate, rotate, pivot, and/or deform to an on-state, to clear the portion of the opening, and to fluidly connect the interior to the exterior. The actuator member may be arranged to be operatively coupled to the cap member, to form an unit with the cap member to be detachable out of the tool, and to manipulate such a cap to operate between the off- and on-state in response to input force from an user.

In another exemplary embodiment of such an aspect of this invention, an assembly may have at least one cap member and at least one actuator member. The cap member may include a single cap which may be arranged to obstruct at least a substantial portion of the opening and to enclose such an interior from an exterior of the case member in its off-state, and may also be arranged to translate, rotate, pivot, and/or deform to one of multiple on-states, to clear one of multiple areas of the portion of the opening, and to fluidly connect the interior to the exterior. The actuator member may be arranged to operatively couple with the cap member, to form an unit with the cap member to be replaceable out of the tool, and to manipulate the cap to operate between the off-state and each of the on-states as a response to input force applied to a portion of such a tool by an user. Such one of the on-states and such one of the areas of the portion may be arranged to be determined based upon a direction of the input force and/or a location of the portion of the tool.

In another exemplary embodiment of such an aspect of this invention, an assembly may have at least one cap member and at least one actuator member. The cap member may have multiple caps which may be arranged to obstruct at least a substantial portion of the opening and to enclose such an interior from an exterior of the case member in their off-state, and may also be arranged to rotate, pivot, translate, and/or deform to an on-state, to clear the portion of the opening, and to fluidly connect the interior to the exterior. The actuator may be arranged to operatively couple with the cap member, to form an unit with the cap member to be detachable out of the tool, and then to manipulate the caps to operate between the off- and on-state in response to input force from an user.

In another exemplary embodiment of such an aspect of this invention, an assembly may have at least one cap member and at least one actuator member. The cap member may have multiple caps which may be arranged to obstruct at least a substantial portion of the opening and to enclose such an interior from an exterior of the case member in their off-state. A preset number of the caps may be arranged to translate, rotate, pivot, and/or deform to one of multiple on-states, to clear one of multiple areas of such a portion of the opening, and to fluidly connect the interior to the exterior. The actuator member may be arranged to operatively couple with the cap member, to form an unit with such a cap member to be replaceable out of the tool, and to manipulate the caps to operate between the off-state and each of the on-states in response to input force applied to a portion of the tool by an user. Such a number of the caps, such one of the on-states, and such one of the areas of the portion may also be arranged to be determined based on a direction of the input force and/or a location of such another portion of the tool.

Embodiments of the above two aspects of the present invention may also include one or more of the following features.

At least one of the caps may be fixedly coupled to the case and may not be replaceable by a new cap. Alternatively, at least one of the caps may releasably couple with the case and replaceable by a new cap. The cap member may include one of more of the above absorber unit, divider, and/or separator which may couple with at least one of such caps. The cap member may also have at least one recoil unit arranged to bias at least a portion of at least one of the caps toward the opening in the off-state and to enhance airtight sealing between the caps and opening and enclosing of the interior from the exterior in the off-state.

The cap member may be arranged to directly receive the input force from the user and then to transmit the force to the actuator and/or case members. Such an actuator member may be arranged to directly receive the input force from the user and then to transmit the force to the cap and/or case members. In the alternative, such a case member may be arranged to directly receive the input force from the user and to transmit the force to the actuator and/or cap members.

The actuator member may be arranged to translate in response to the input force and then to manipulate at least one of such caps to translate, rotate, and/or deform. The actuator member may be arranged to rotate or pivot in response to the input force and to manipulate at least one of the caps to translate, rotate, and/or deform. In the alternative, the actuator member may be arranged to deform in response to the input force and then to manipulate at least one of the caps to translate, rotate, and/or deform.

In another aspect of the present invention, a cartridge assembly may be provided for a writing tool having a case member defining an interior and capable of receiving the cartridge assembly in said interior.

In one exemplary embodiment of such an aspect of the present invention, a cartridge assembly may include multiple cartridges each of which may be arranged to include a body and to contain in the body at least one marking substance capable of leaving marks onto an article. At least one surface of at least one of such cartridges may define a first contour which may be arranged to match a second contour of at least one surface of at least another of such cartridges, thereby reducing a gap defined between such one and another cartridges when such one and another cartridges are arranged to be disposed close to each other (or to abut each other) in the interior of the tool.

In another exemplary embodiment of this aspect of the present invention, a cartridge assembly may include multiple cartridges each of which may be arranged to include a body, to contain therein at least one marking substance capable of leaving marks onto an article, to be disposed according to a preset relation therebetween inside the interior, and to have an outer surface which may be oriented away from the rest of the cartridges. The outer surfaces of the cartridges when disposed according to the preset relation may define a contour which may be arranged to be at least substantially similar to a contour of the interior, thereby minimizing a gap formed between the cartridges and interior of the case member when the cartridges may be disposed inside the interior.

In another exemplary embodiment of this aspect of the present invention, a cartridge assembly may include multiple cartridges each of which may be arranged to include a body and to contain in the body at least one marking substance capable of leaving marks onto an article. At least one surface of at least one of such cartridges may define a first contour which may be arranged to match a second contour of at least one surface of at least another of the cartridges, thereby facilitating movements of such one and another of the cartridges when one of such cartridges may be arranged to move while abutting the other thereof.

In another exemplary embodiment of this aspect of the present invention, a cartridge assembly may also include multiple cartridges and at least one holder. Each of such cartridges may be arranged to include a body and to contain in the body at least one marking substance capable of leaving marks onto an article. Such a holder may be arranged to releasably hold or retain the cartridges and to allow the cartridges to advance and to retract therethrough while being releasably supported by the holder, thereby enabling all of such cartridges to move together when disposed inside the interior.

In another aspect of the present invention, a replaceable cartridge may also be provided for a writing tool with a case member defining an interior and capable of retaining multiple the cartridges in the interior.

In one exemplary embodiment of this aspect of the present invention, a cartridge may include a body, a tip, and at least one absorber unit. The body may be arranged to contain therein at least one marking substance capable of leaving marks onto an article, while the tip may be arranged to dispense the marking substance from the body onto an article. The absorber unit may be arranged to couple to the body and to be capable of absorbing the marking substance leaked from the tip.

In another exemplary embodiment of such an aspect of the present invention, a cartridge may include a body, a tip, and at least one divider. Such a body may be arranged to contain therein at least one marking substance which is capable of leaving marks onto an article, and the tip may be arranged to dispense the marking substance from the body onto an article. The divider may then be arranged to be coupled to the body and to extend outwardly therefrom, thereby forming airtight sealing around at least a substantial portion of a circumference of the body with the case member when inserted into the interior.

In another exemplary embodiment of such an aspect of the present invention, a cartridge may include a body, a tip, and at least one separator. The body may be arranged to contain therein at least one marking substance which is capable of leaving marks onto an article, and the tip may be arranged to dispense the marking substance from the body onto an article. The separator may be arranged to couple with the body, to extend along at least a portion of the tip, and to be oriented to face another tip of another cartridge when the cartridge and another cartridge are disposed inside the interior.

In another aspect of the present invention, various methods may be provided for exposing tips of cartridges of a writing tool out of an interior defined inside a case member of the tool one at a time through an access which may be defined in one end of the interior during use of the tool.

In one exemplary embodiment of this aspect of the present invention, a method may include the steps of defining the access as an opening provided in a bottom end of the case member; providing at least one cap member capable of obstructing and clearing such an access; coupling at least a portion of the cap member to at least one first portion of the tool; movably disposing multiple cartridges in the case member; obstructing the access by the cap member, thereby enclosing the tips of the cartridges inside the interior before the use; selecting one of the cartridges by applying input force to at least one second portion of the writing tool; advancing such one of the cartridges downwardly in response to the above selecting; clearing the access by the cap member while maintaining such movably coupling during such advancing, thereby exposing the tips of the cartridges one at a time through the access out of the interior during such use; and retracting such one of the cartridges upwardly into the interior and repeating such obstructing, thereby enclosing all of the tips in the interior again after such use.

In another exemplary embodiment of this aspect of the present invention, a method may include the steps of defining the access as an opening formed in a bottom end of the case member, providing a cap member capable of obstructing and clearing each of multiple areas of such an access; coupling at least a portion of the cap member to at least one first portion of the tool; movably disposing multiple cartridges inside the case member; obstructing all of the areas of such an access by the cap member, thereby enclosing the tips of the cartridges inside the interior before such use; selecting one of such cartridges by applying input force to at least one second portion of the tool; determining at least one specific area of such areas of the access based on the above selecting; advancing such one of the cartridges downwardly in response to the above selecting; clearing the specific area of the access by the cap member while maintaining such movably coupling during such advancing, thereby exposing the tips of the cartridges one at a time out of the interior through each of the specific areas of such an access during the use; and then retracting such one of the cartridges upwardly to the interior through such one specific area of the access and repeating such obstructing, thereby enclosing all of the tips in the interior again after the use.

In another exemplary embodiment of this aspect of the present invention, a method may include the steps of providing a cap member which may vary and restore at least one configuration thereof, thereby forming and closing the access, respectively; coupling at least a portion of the cap member to at least one first portion of such a tool; movably disposing multiple cartridges inside the case member; maintaining the configuration of the cap member, thereby closing the access and enclosing all of such tips of the cartridges in the interior before such use; selecting one of the cartridges by applying input force to at least one second portion of the tool; advancing such one of the cartridges downwardly in response to the above selecting; changing the configuration of the cap member while maintaining the above movably coupling during such advancing, thereby forming the access and exposing the tips of the cartridges one at a time through the access out of the interior during the use; and retracting such one of the cartridges upwardly to the interior and repeating the above maintaining, thereby enclosing all of the tips inside the interior again after the use.

In another exemplary embodiment of this aspect of the present invention, a method may include the steps of providing a cap member which is capable of changing and of restoring multiple different configurations thereof, thereby respectively forming and closing each of multiple accesses; coupling at least a portion of the cap member to at least one first portion of the tool; movably disposing multiple cartridges inside the case member; maintaining the configurations of the cap member, thereby closing all of the accesses and enclosing all of the tips of such cartridges inside the interior before such use; selecting one of the cartridges by applying input force to at least one second portion of such a tool; determining at least one specific configuration of such configurations and at least one specific access of such accesses based on the above selecting; advancing such one of the cartridges downwardly in response to such selecting; varying the specific configuration of the cap member while maintaining such movably coupling and forming the specific access during such advancing, thereby exposing the tips of the cartridges one at a time through each of the accesses out of the interior during such use; and retracting such one of the cartridges upwardly to the interior and repeating the above maintaining, thereby enclosing all of the tips inside the interior again after the use.

Embodiments of this aspect of the invention may include one or more of the following features.

The coupling may include at least one of the steps of movably coupling the cap member with at least one of such cartridges; fixedly coupling such a cap member with at least one of such cartridges; movably coupling the cap member with the case member; fixedly coupling the cap member to the case member, and the like.

The applying may include at least one of the steps of providing such input force to one of the cartridges; providing the input force to the cap member; providing the input force to the case member, and the like. The applying may also include at least one of the steps of providing the input force to the second portion in one of multiple directions; repeating applying the input force to the second portion in one of multiple numbers; providing the input force to one of multiple different second portions of such a tool, and the like.

In another aspect of the present invention, various methods may be provided for exposing tips of cartridges of a writing tool out of an interior defined inside a case member of the tool one at a time during use and enclosing the tips inside the interior during non-use.

In one exemplary embodiment of this aspect of the present invention, a method may include the steps of movably disposing multiple cartridges in the case member while enclosing all of the tips of the cartridges inside the interior during the non-use; movably coupling at least a portion of a cap member to at least one first portion of the tool; selecting one of the cartridges by applying input force to at least one second portion of the tool; advancing such one of the cartridges downwardly in response to the above selecting; varying at least one configuration of the cap member while maintaining such movably coupling thereof during such advancing, thereby exposing the tips of the cartridges out of the interior through the cap member one at a time during the use; retracting such one of the cartridges upwardly; and restoring such configuration of the cap member while maintaining such movably coupling thereof during the above retracting, thereby enclosing again all of the tips of the cartridges inside the interior during the non-use.

In another exemplary embodiment of this aspect of the present invention, a method may include the steps of movably coupling at least a portion of a cap member to at least one first portion of such a tool; movably disposing multiple cartridges in the case member; maintaining at least one configuration of the cap member in order to enclose all of the tips of the cartridges inside the interior during the non-use; receiving input force by at least one second portion of the tool; selecting one of such cartridges based on the input force; advancing such one of the cartridges downwardly in response to the input force; varying at least one configuration of the cap member while maintaining such movably coupling during such advancing; exposing the tips of the cartridges one at a time through the cap member out of the interior as a result of at least one of the above advancing and varying during the use; retracting such one of the cartridges upwardly; restoring the configuration of the cap member while maintaining the above movably coupling during such retracting; and enclosing all of the tips of the cartridges in the interior as a result of at least one of the above retracting and restoring during the non-use.

In such embodiments of this aspect of the present invention, each method may optionally have the step of disposing at least a portion of the cap member inside the interior during the use and/or non-use. Each method may also optionally include the step of fixedly coupling at least a portion of the cap member to such a portion of the tool, thereby such a portion of the cap member may not be detachable therefrom unless the cap member is broken and/or to be replaced. In another alternative, each method may have the steps of movably coupling at least a portion of the cap member to such a portion of the tool; and moving the portion of the cap member while changing the configuration thereof by a preset distance which may be less than a twice or a thrice of a height of one of such tips, a width thereof, a distance along which one of such tips may move while changing the configuration, and the like.

In another aspect of the present invention, various methods may be provided for exposing tips of cartridges of a writing tool out of an interior defined inside a case member of the tool one at a time during use.

In one exemplary embodiment of this aspect of the present invention, a method may include the steps of movably disposing multiple cartridges inside the case member while enclosing the tips of the cartridges inside the interior during the non-use; movably coupling at least a portion of a cap member with at least one first portion of the tool; applying input force to one of the cartridges; advancing such one of the cartridges downwardly as a result of such applying; changing at least one configuration of the cap member through at least one of such applying and advancing while maintaining such movably coupling of the cap member, thereby exposing the tips of the cartridges one at a time through the cap member out of the interior during the use; and retracting such one of the cartridges upwardly while restoring the configuration of the cap member and maintaining the above movably coupling of the cap member, thereby enclosing again all of the tips of the cartridges in the interior again after the use.

In a related example, the above changing may also be replaced by the steps of moving at least a portion of the case member through one of the above applying and advancing; and varying at least one configuration of the cap member through one of the above applying and moving while maintaining such movably coupling, thereby exposing the tips of the cartridges through the cap member out of the interior one at a time during the use.

In another exemplary embodiment of this aspect of the present invention, a method may include the steps of movably disposing multiple cartridges inside the case member while enclosing the tips of the cartridges in the interior during such non-use; movably coupling at least a portion of a cap member to at least one first portion of such a tool; applying input force to at least a portion of the case member; moving at least a portion of the case member as a result of such applying; advancing such one of the cartridges downwardly through one of such applying and moving; changing at least one configuration of the cap member through at least one of such applying, moving, and advancing while maintaining the above movably coupling of the cap member, thereby exposing the tips of the cartridges through such a cap member out of the interior one at a time during the use; and retracting such one of the cartridges upwardly while restoring the configuration and maintaining such movably coupling of the cap member, thereby enclosing again all of the tips of the cartridges in the interior again after the use.

In a related example, the above advancing and changing may also be replaced by the steps of changing at least one configuration of the cap member through one of such applying and moving while maintaining such movably coupling, thereby exposing such tips of the cartridges out of the interior one at a time through the cap member during the use; and thereafter advancing such one of the cartridges downwardly through at least one of the above applying, moving; and varying.

In another exemplary embodiment of this aspect of the present invention, a method may include the steps of movably disposing multiple cartridges inside the case member while enclosing the tips of such cartridges in the interior during the non-use; movably coupling at least a portion of a cap member with at least one first portion of the tool; applying input force to at least a portion of the cap member, varying at least one configuration of the cap member through the above applying while maintaining the above movably coupling of the cap member; moving at least a portion of the case member through at least one of the above applying and varying; selecting one of the cartridges based on the input force; advancing such one of the cartridges downwardly by at least one of the above applying, varying, and moving, thereby exposing the tips of the cartridges out of the interior through the cap member one at a time during the use; and thereafter retracting such one of the cartridges upwardly while restoring the configuration and maintaining the above movably coupling of the cap member, thereby enclosing again all of the tips of the cartridges in the interior again after the use.

In another exemplary embodiment of this aspect of the present invention, a method may include the steps of movably disposing multiple cartridges inside the case member while enclosing the tips of such cartridges in the interior during the non-use; movably coupling at least a portion of a cap member with at least one first portion of the tool; applying input force to at least a portion of the cap member; varying at least one configuration of the cap member through the above applying while maintaining the above movably coupling of the cap member; selecting one of the cartridges based on the input force; advancing such one of the cartridges downwardly by at least one of the above applying and varying, thereby exposing such tips of such cartridges one at a time through the cap member out of the interior during the use; moving at least a portion of the case member by at least one of such applying, varying, and advancing; and retracting such one of the cartridges upwardly while restoring the configuration and maintaining the above movably coupling of the cap member, thereby enclosing again all of the tips of the cartridges in the interior again after the use.

In another exemplary embodiment of this aspect of the present invention, a method may include the steps of movably disposing multiple cartridges inside the case member while enclosing the tips of the cartridges in the interior during the non-use; movably coupling at least a portion of a cap member with at least one first portion of such a writing tool; operatively coupling at least one actuator member with the cap member, cartridges, and/or case member; applying input force to the actuator member, advancing such one of the cartridges downwardly through the above applying; changing at least one configuration of the cap member by at least one of such applying and advancing while maintaining the above movably coupling of the cap member, thereby exposing the tips of the cartridges one at a time out of the interior through the cap member during the use; and retracting such one of the cartridges upwardly while restoring the configuration and maintaining such movably coupling of the cap member, thereby enclosing again all of the tips of the cartridges in the interior again after the use.

In a related example of such an embodiment of this aspect of the present invention, the above advancing and changing may be replaced by the steps of varying at least one configuration of the cap member through such applying while maintaining such movably coupling of the cap member, thereby exposing the tips of the cartridges one at a time out of the interior through the cap member during the use; and advancing such one of the cartridges downwardly by at least one of the above applying and varying. In another example, the above advancing and changing may also be replaced by the steps of moving at least a portion of the case member; advancing such one of the cartridges downwardly by at least one of the above applying and moving; and changing at least one configuration of such a cap member through at least one of such applying, moving, and advancing while maintaining such movably coupling of the cap member, thereby exposing the tips of the cartridges one at a time out of the interior through the cap member during the use. In yet another example, the above advancing and changing may be replaced by the steps of moving at least a portion of the case member; changing at least one configuration of the cap member by at least one of such applying and moving while maintaining the above movably coupling of the cap member, thereby exposing each tip of the cartridges one at a time out of the interior through the cap member during the use; and thereafter advancing such one of the cartridges downwardly through one of the applying, moving, and changing; and In another aspect of the present invention, various methods may be provided for exposing tips of cartridges of a writing tool out of an interior defined inside a case member of the tool one at a time while minimizing leakage of marking substances from such cartridges.

In one exemplary embodiment of this aspect of the present invention, a method may include the steps of providing at least one cap member in a bottom end of the case member; movably disposing multiple cartridges inside the case member; enclosing such tips of the cartridges in the interior before use of the tool; advancing one of the cartridges downwardly; varying at least one configuration of the cap member during such advancing, thereby forming an access through the bottom end and exposing each of such tips of the cartridges one at a time out of the interior through such an access during the use; retracting each of the cartridges upwardly while restoring the configuration of the cap member, thereby enclosing all of the tips inside the interior again after the use; and then absorbing the marking substances leaking out of the cartridges before, during, and/or after such use, thereby minimizing the leakage of the substances.

In another exemplary embodiment of this aspect of the present invention, a method may include the steps of defining an opening in a bottom end of the case member; placing at least one cap member around the opening; movably disposing multiple the cartridges inside the case member; obstructing the opening by the cap member, thereby enclosing the tips of the cartridges inside the interior before use of the tool; advancing one of the cartridges downwardly while changing at least one configuration of the cap member and clearing the opening, thereby exposing each of the tips out of the interior one at a time during the use; retracting such one of the cartridges upwardly while restoring such configuration of the cap member and obstructing the opening, thereby enclosing all of the tips inside such an interior again after the use; and absorbing the marking substances leaking from the cartridges before, during, and/or after the use before the substances leak from the cartridges and escape through the opening, thereby avoiding the leakage of the substances.

In another exemplary embodiment of this aspect of the present invention, a method may include the steps of providing at least one cap member in a bottom end of the case member; disposing at least one absorber unit into the cap member; movably disposing multiple cartridges inside the case member; closing the cap member, thereby enclosing such tips of the cartridges in the interior before use of the tool; advancing one of the cartridges downwardly while varying at least one configuration of the cap member and forming a conduit therethrough, thereby exposing one of the tips out of the interior one at a time during the use; retracting such one of the cartridges upwardly while restoring the configuration of the cap member and closing the conduit, thereby enclosing all of such tips inside the interior again after the use; and absorbing the marking substances leaking from the cartridges before and/or after the use by the absorber unit before such substances escape through the conduit, thereby preventing the leakage of the substances.

In another aspect of the present invention, various methods may be provided for exposing tips of cartridges of a writing tool out of an interior defined inside a case member of the tool one at a time while minimizing evaporation of marking substances from the tips of the cartridges.

In one exemplary embodiment of this aspect of the present invention, a method may include the steps of providing at least one cap member in a bottom end of the case member, movably disposing multiple cartridges inside such a case member; dividing the interior into at least two enclosed spaces; enclosing all of the tips of the cartridges in one of the enclosed spaces which may be arranged to be smaller than the interior before use of the tool, thereby reducing an amount of the substances which may evaporate from the tips before the use; advancing one of the cartridges downwardly; varying at least one configuration of the cap member during such advancing, thereby forming an access through the bottom end and exposing each of the tips of the cartridges one at a time out of the interior through the access during the use; and thereafter retracting each of such cartridges upwardly while restoring the configuration of the cap member, thereby enclosing all of the tips inside such one of the enclosed spaces again after the use and also reducing the amount of the substances evaporating from the tips again after the use.

In another exemplary embodiment of this aspect of the present invention, a method may include the steps of providing at least one cap member in a bottom end of the case member; movably placing multiple cartridges in the case member; coupling at least one divider to the case and/or cap members; extending the divider toward or into the interior which may define an enclosed space bound by such a divider and bottom end along the interior and which may correspond to only a fraction of the interior; enclosing all of the tips of the cartridges inside the enclosed space before use of such a tool, thereby reducing an amount of the substances evaporating from the tips before the use; advancing one of the cartridges downwardly while maintaining the defining the space; varying at least one configuration of the cap member during the above advancing, thereby forming an access through the bottom end and exposing each of the tips of the cartridges one at a time out of the interior through the access during the use; and retracting each of the cartridges upwardly while restoring such configuration of the cap member and maintaining such an enclosed space, thereby enclosing again all of the tips inside such an enclosed space and reducing the amount of the substances which may evaporate from such tips after the use.

In another exemplary embodiment of this aspect of the present invention, a method may include the steps of providing at least one cap member in a bottom end of the case member; movably placing multiple cartridges in the case member; coupling at least one divider with at least one of the cartridges; defining an enclosed space arranged to be bound by the divider and bottom end along the interior and to correspond to only a fraction of the interior; enclosing the tips of the cartridges in such an enclosed space before use of the tool, thereby reducing an amount of the substances evaporating from the tips before the use; advancing one of the cartridges downwardly along with the divider; changing at least one configuration of the cap member during such advancing, thereby forming an access through the bottom end and exposing each of the tips of the cartridges one at a time out of the interior through the access during the use; and retracting each of the cartridges upwardly while restoring the foregoing configuration of the cap member and forming the enclosed space, thereby enclosing again all of such tips inside the enclosed space and reducing the amount of the substances evaporating from the tips after the use.

In another aspect of the present invention, various methods may be provided for exposing tips of cartridges of a writing tool out of an interior defined inside a case member of the tool one at a time while minimizing mixing of different marking substances contained in the cartridges.

In one exemplary embodiment of this aspect of the present invention, a method may include the steps of providing at least one cap member in a bottom end of such a case member; disposing at least one separator between the tips; movably disposing multiple cartridges in the case member; enclosing the tips of the cartridges inside the interior while avoiding contact between the tips by the separator, thereby preventing mixing of the different marking substances between the tips before use of the tool; advancing one of the cartridges downwardly while maintaining such avoiding; changing at least one configuration of the cap member during the above advancing, thereby forming an access through the bottom end and exposing each of the tips of the cartridges one at a time out of the interior through the access during the use; and thereafter retracting each of the cartridges upwardly while restoring such configuration of the cap member, thereby enclosing all of the tips again inside the interior after the use and maintaining the above avoiding.

In another exemplary embodiment of this aspect of the present invention, a method may include the steps of providing at least one cap member in a bottom end of the case member, movably placing multiple cartridges inside the case member; coupling at least one separator with the case and/or cap members while disposing the separator between the tips of the cartridges; enclosing such tips of the cartridges in the interior while avoiding contact between the tips by the separator, thereby preventing mixing of the different marking substances between the tips before use of the tool; advancing one of the cartridges downwardly while maintaining the above avoiding and preventing; varying at least one configuration of the cap member during the above advancing, thereby forming an access through the bottom end and exposing each of the tips of the cartridges one at a time out of the interior through the access during the use; and thereafter retracting each of the cartridges upwardly while restoring such configuration of the cap member, thereby enclosing all of the tips again inside the interior after the use and maintaining the avoiding.

In another exemplary embodiment of this aspect of the present invention, a method may include the steps of providing at least one cap member in a bottom end of the case member; movably placing multiple cartridges inside the case member, coupling at least one separator with at least one tip of the cartridges; enclosing the tips of the cartridges inside the interior while placing the separator between at least two of such tips, thereby avoiding contact between the tips by the separator and preventing mixing of the different marking substances between the tips before use of the tool; advancing one of the cartridges with such at least one tip downwardly while maintaining such avoiding and preventing; varying at least one configuration of the cap member during the above advancing, thereby forming an access through the bottom end and exposing each of the tips of the cartridges one at a time out of the interior through the access during the use; and then retracting each of the cartridges upwardly while restoring the configuration of the cap member, thereby enclosing all of the tips again inside the interior after the use and maintaining the avoiding.

In another aspect of the present invention, various methods may be provided for exposing tips of cartridges of a writing tool out of an interior defined inside a case member of the tool one at a time, where the interior is arranged to have a center and a periphery.

In one exemplary embodiment of this aspect of the present invention, a method may include the steps of providing at least one cap member in a bottom end of the case member, movably disposing multiple cartridges inside the case member and at least substantially close to each other and close to the case member while enclosing such tips of the cartridges in the interior before use of such a tool; advancing one of the cartridges downwardly without altering at least one horizontal distance from such one of the cartridges to the rest of the cartridges; changing at least one configuration of the cap member and creating an access therethrough during such advancing, thereby exposing the tip of the one of the cartridges one at a time through the access out of the interior during the use; and retracting such one of the cartridges upwardly into the interior through the access; and thereafter restoring the configuration of the cap member during such retracting, thereby enclosing again all of such tips inside the interior after the use.

In another exemplary embodiment of this aspect of the present invention, a method may include the steps of providing at least one cap member in a bottom end of the case member, movably placing multiple cartridges inside the case member substantially each of which may be disposed close to the case member but away from the center by a preset horizontal distance while enclosing the tips of the cartridges in the interior before use of such a tool; advancing one of the cartridges downwardly while moving such one of the cartridges along a direction at least substantially parallel to the case member and toward the center, thereby decreasing the horizontal distance between the center and such one of the cartridges; changing at least one configuration of such a cap member and creating an access therethrough during the advancing, thereby exposing the tip of the one of the cartridges one at a time through the access out of the interior during the use; retracting such one of the cartridges upwardly back to the interior through such an access while moving such one of the cartridges in the direction toward the case member, thereby increasing the horizontal distance back toward the preset distance; and restoring the configuration of the cap member during such retracting, thereby enclosing again all of the tips inside the interior after the use.

In another exemplary embodiment of this aspect of the present invention, a method may include the steps of providing at least one cap member in a bottom end of the case member; movably placing multiple cartridges inside the case member substantially each of which may be disposed close to the case member but away from the center by a preset horizontal distance while enclosing the tips of the cartridges in the interior before use of the tool; advancing one of such cartridges downwardly while tilting such one of the cartridges toward the center at about an acute angle, thereby decreasing such a horizontal distance between the center and the tip of such one of the cartridges; changing at least one configuration of such a cap member and creating an access therethrough during such advancing, thereby exposing such a tip of such one of the cartridges one at a time through the access out of the interior during the use; retracting such one of the cartridges upwardly back to the interior through the access while tilting such one of the cartridges back toward the case member, thereby increasing the horizontal distance back toward the preset horizontal distance; and restoring the configuration of the cap member during the above retracting, thereby enclosing again all of the tips inside the interior after the use.

In another exemplary embodiment of this aspect of the present invention, a method may include the steps of providing at least one cap member in a bottom end of the case member; movably placing multiple cartridges inside the case member substantially each of which may be disposed close to the case member but away from the center by a preset horizontal distance while enclosing the tips of the cartridges in the interior before use of the tool; advancing one of such cartridges downwardly while bending a bottom portion of such one of the cartridges toward such a center, thereby decreasing the horizontal distance between the center and the tip of such one of the cartridges; varying at least one configuration of the cap member and creating an access therethrough during the advancing, thereby exposing the tip of such one of the cartridges one at a time through such an access out of the interior during the use; retracting such one of the cartridges upwardly back to the interior through the access while straightening the tip portion of such one of the cartridges, thereby increasing such a horizontal distance back toward the preset horizontal distance; and then restoring the configuration of the cap member during such retracting, thereby enclosing again all of the tips inside the interior after the use.

In another exemplary embodiment of this aspect of the present invention, a method may include the steps of providing at least one cap member in a bottom end of the case member; movably placing multiple cartridges inside the case member substantially close to each other but away from the case member by a preset horizontal distance while enclosing the tips of the cartridges in the interior before use of the writing tool; advancing one of the cartridges downwardly while moving all of the cartridges toward the case member in a direction at least substantially parallel to the case member and disposing such one of the cartridges near the center; changing at least one configuration of such a cap member and creating an access therethrough during the advancing, thereby exposing the tip of the one of the cartridges one at a time through such an access out of the interior during the use; retracting such one of the cartridges upwardly back to the interior through the access while moving all of such cartridges toward the center; and restoring the configuration of the cap member during such retracting, thereby enclosing again all of the tips inside the interior after the use.

In another exemplary embodiment of this aspect of the present invention, a method may include the steps of providing at least one cap member in a bottom end of the case member; movably placing multiple cartridges inside the case member substantially close to each other but away from the case member by a preset horizontal distance while enclosing the tips of the cartridges in the interior before use of the tool; advancing one of the cartridges downwardly while tilting all of the cartridges about an acute angle with respect to the center and orienting the one of the cartridges near the center; varying at least one configuration of the cap member and creating an access therethrough during the above advancing, thereby exposing the tip of such one of such cartridges one at a time through the access out of the interior during the use; retracting such one of the cartridges upwardly back into the interior through the access while moving all of the cartridges toward the center; and thereafter restoring the configuration of the cap member during such retracting, thereby enclosing again all of such tips inside the interior after the use.

Embodiments of all of the above method aspects of this invention may also include one or more of the following features.

Such providing the cap member may include the step of disposing at least a portion thereof in the interior. Such providing the cap member may include the step of placing at least a portion thereof near and/or around the opening and/or conduit. Such providing the cap member may also include the step of fixedly coupling at least a portion thereof to at least one of other of the members and not being detachable therefrom unless the cap member is broken and/or to be replaced. Such providing the cap member may instead include the steps of movably coupling at least a portion thereof with at least one of other of the rest of the members; and moving the portion within a preset distance while changing the configuration thereof, wherein such a distance may be less than a twice or a thrice of a height of one of such tips, a width thereof, a distance along which one of the tips may move while varying the configuration, and the like.

The above varying or changing the configuration may include the steps of exposing one of the tips of the cartridges selected by an user out of the interior through the opening and/or conduit during the use; and restoring the configuration while enclosing all of the tips inside the interior during the non-use or after the use. Such varying or changing the configuration may include the steps of advancing one of the cartridges which is selected by an user downwardly and exposing the tip of such one of the cartridges from the interior through the opening or conduit while changing the configuration during the use; and then retracting such one of the cartridges upwardly into the interior while restoring such configuration and enclosing all of the tips of the cartridges inside the interior during such non-use or after the use. Such varying or changing the configuration may also include the steps of retracting at least a portion of the case member upwardly while varying the configuration and exposing one of the tips of the cartridges selected by an user out of the interior through the opening or conduit during the use; and advancing the portion of the case member downwardly while restoring the configuration and enclosing all of the tips of the cartridges inside the interior during the non-use or after the use. Such varying or changing the configuration may include the step of varying or changing a size and/or shape of the cap member or, in the alternative, the steps of providing the cap member with multiple caps; and varying or changing arrangements between at least two of such caps.

Such forming or defining the access may include the step of providing an opening to the case member or the step of creating a conduit which may be formed and closed by the cap member. Such forming or defining the access may include the step of maintaining the same shape and/or size thereof regardless of which of the cartridges may be selected or, in the alternative, the step of varying such shapes and/or sizes depending upon which of the cartridges may be selected.

The moving in such a direction may include the step of moving upward, downward, vertically and inwardly toward the case member, vertically and outwardly from the interior, angularly around the interior, and the like. The advancing and/or retracting may also include the step of translating and/or rotating at least a portion of at least one of the cartridges during such advancing and/or retracting.

In another aspect of the present invention, a writing tool may include multiple cartridges each of which may contain different marking substances therein and may be capable of applying marking substances onto an article from one of the cartridges at a time. Such a writing tool may be made by various processes.

In one exemplary embodiment of such an aspect of this invention, such a process may include the steps of, providing at least one case member and defining an interior therein; disposing inside the interior at least one cartridge member with the cartridges each of which may be arranged to define a body including one of the marking substances therein and a tip through which the one of the marking substances is applied onto the article; coupling to at least a portion of the tool at least one cap member capable of changing and restoring at least one configuration thereof with respect to such tips; and operatively coupling at least one actuator member to the cap and cartridge members, thereby varying the configuration and exposing one of such tips selected by an user out of the interior during use and thereby restoring the configuration and enclosing all of the tips inside the interior when not in use.

In another aspect of the present invention, a writing tool may include multiple cartridges and be capable of exposing one of such cartridges at a time, where such cartridges contain different marking substances and may be arranged to apply the marking substances onto an article one at a time. Such a writing tool may be made by various processes.

In one exemplary embodiment of such an aspect of this invention, such a process may include the steps of: providing at least one case member defining an interior therein and forming at least one opening which is in fluid communication with the interior and an exterior of the writing tool; disposing inside the interior at least one cartridge member with the cartridges each of which may be arranged to define a body having one of the marking substances therein and a tip through which such one of the marking substances may be applied onto the article when the tip is exposed through the opening out of the interior; coupling to at least a portion of the tool at least one cap member capable of changing and restoring at least one configuration thereof and clearing and obstructing at least a portion of the opening, respectively; and operatively coupling at least one actuator member to the cap and cartridge members, thereby changing the configuration so as to clear the portion of the opening and to expose one of the tips of the cartridges selected by an user out of the interior through the opening during use and thereby restoring the configuration so as to retract the one of the tips into the interior through the opening and to enclose all of the tips inside the interior when not in use, In another aspect of the present invention, a writing tool may include multiple cartridges each of which may contain a different marking substance therein and include a tip through which marking substances may be applied onto an article in response to input force applied to at least a portion of the tool by an user. Such a writing tool may be made by various processes.

In one exemplary embodiment of such an aspect of this invention, such a process may include the steps of: providing at least one case member defining an interior therein and capable of retaining the cartridges of the cartridge member in the interior; disposing at least one cap member in one end of the interior; coupling the cap member to the cartridge member, thereby changing and restoring at least one configuration of the cap member in order to respectively form and close an access to the interior from an exterior of the tool; providing at least one cartridge member with the cartridges each of which may be arranged to receive the input force from the user; arranging each of the cartridges to advance downwardly as a response to the input force one at a time while manipulating the cap member to vary the configuration thereof, thereby exposing the tip out of the interior through the cap member during use; and arranging each of the cartridges to retract upwardly into the interior while controlling the cap member to restore the configuration thereof, thereby enclosing all of the tips inside the interior when not in use.

More product-by-process claims may be constructed by modifying the foregoing preambles of the apparatus or systems claims and by appending thereto the foregoing bodies of the method claims. Alternatively, the foregoing bodies of the apparatus claims may also be incorporated into the product-by-process claims. Such product-by-process claims may further include one or more of the foregoing features of the apparatus and/or method claims of the present invention.

Other details of the case members, cap members, cartridge members, and/actuator members and their units of various writing tools of the present invention have been provided in the co-pending Applications entire portions of which are incorporated herein by reference.

As used herein, the term "opening" refers to an aperture defined on a case of a case member of a writing tool. Through such an "opening," a tip of a cartridge member of the writing tool is exposed out of the case when in use so as to allow an user to apply a marking substance such as an ink over an article such as a paper. In general, such an "opening" is arranged to have a fixed shape and size, unless at least a portion of such a case may be arranged to move and to create and destroy such an "opening."

As used herein, the term "conduit" refers to an aperture defined by two or more caps of a cap member of the writing tool. Such a "conduit" may generally be arranged to be formed and closed by at least one of such caps and, therefore, have variable shapes and/or sizes. It is to be understood that, in a majority of exemplary aspects and/or embodiments of various writing tools of this invention, such a "conduit" of the cap member is arranged to be in a complementary relation with the "opening" of the cap member. In one example, the cap member may be disposed adjacent to the "opening" so that the formation and closure of the "conduit" result in clearing and obstruction of the "opening," respectively. In another example, the cap member may be disposed at a preset distance but not proximate to such an "opening" and aligned across an interior of a case member such that the formation and closure of the "conduit" may respectively result in formation and destruction of fluid communication between the interior and an exterior of the case member of the tool and, therefore, indirectly result in clearing and obstruction of the "opening," respectively. In another example, such a "conduit" may be arranged to have a fixed shape and/or size, but to move in relation to the "opening" such that alignment of such a "conduit" relative to the "opening" results in clearance or obstruction of the "opening."

A "capping surface" is a portion of a surface of a cap of a cap member of a writing tool which may be disposed within, around, over, on, beneath, below, and/or proximate to the opening and which also contributes to at least one of forming and blocking fluid communication between an interior and an exterior of a case member of the writing tool through such an opening. That is, the "capping surface" refers to those portions of the cap and/or cap member which participate in obstructing and/or clearing of the opening and/or in creating and/or closing a conduit. Therefore, the "capping surface" does not include other portions of the cap and/or cap member which do not participate in the obstructing and/or clearing of the opening and/or creating and/or destroying the conduit. Such a "capping surface" may define a planar surface, a curved surface, and the like.

As used herein, the verb "move" includes various other verbs examples of which may include, but not be limited to, translate along a curvilinear (i.e., a linear and/or curved) path, reciprocate along a similar path, rotate or pivot about a point and/or a rotation axis, rotate or pivot angularly and/or radially, deform at least a portion of a moving subject, and the like.

The verb "enclose" refers to fluidly isolating or blocking fluid communication. Accordingly, the phrase "enclose an interior" means to fluidly isolate the interior from an exterior of the tool and/or from other portions of the tool or to block fluid communication between the interior and exterior or between the interior and other portions of the tool. Similarly, the phrase "enclose a tip inside an interior" means to dispose the tip inside the interior and then to fluidly isolate the tip and/or interior from the exterior or from other portions of the tool. In general, the purpose of such "enclosing" is to ensure that the tip is disposed in an "enclosed" interior or an "enclosed space" (which is only a portion of such an interior as described herein), thereby minimizing evaporation of marking substances from the tip.

As used herein, the terms "top" and "bottom" are defined in opposite ends of the writing tool so that a "bottom" end is the one through which multiple tips of multiple cartridges of the writing tool are to be exposed one at a time and that a "top" end is the other one opposite to the "bottom" end. Similarly, the terms "upward" and "downward" are defined as opposite directions, where an "upward" direction is a direction from the "bottom" to the "top," while a "downward" direction is a direction from the "top" to the "bottom" of the tool.

It is appreciated that the term "interior" is synonymous with the term "inner space." It is also appreciated that the term "access" may refer to the opening provided in a bottom end of the tool or the conduit created and closed by the cap member. Whether it may be the opening or conduit, such an "access" may play the role of providing fluid communication between an interior and an exterior of the tool.

The term "input force" generally refers to a force supplied by an user to a specific member or its part of a multicolor writing tool of this invention. Such a member and/or part may transmit at least a portion of such force to another member or its part. It is appreciated that the term "input force" may be collectively used to represent a force which is originally applied by the user, at least a portion of such original force which may have the same or different amplitude and/or direction of the original force, unless otherwise specified.

Unless otherwise defined in the following specification, all technical and scientific terms used herein have the same meaning as commonly understood by one of ordinary skill in the art to which the present invention belongs. Although the methods or materials equivalent or similar to those described herein can be used in the practice or in the testing of the present invention, the suitable methods and materials are described below. All publications, patent applications, patents, and/or other references mentioned herein are incorporated by reference in their entirety. In case of any conflict, the present specification, including definitions, will control. In addition, the materials, methods, and examples are illustrative only and not intended to be limiting.

Other features and advantages of the present invention will be apparent from the following detailed description, and from the claims.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
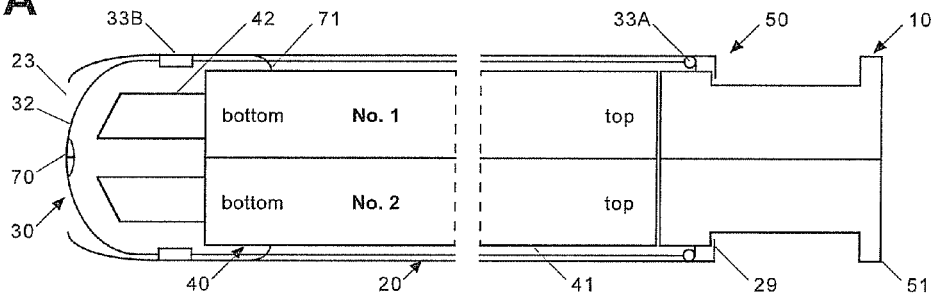
FIGS. 1A to 1H show longitudinal cross-sectional views of exemplary writing tools exposing tips of their cartridge members out of their case members one at a time in their use positions (shown in upper panels) and then enclosing the tips inside their case members in their rest positions (shown in lower panels) through different actuating mechanisms according to aspects of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Although a few embodiments of the present invention have been shown and described, it would be appreciated by those skilled in the art that changes may be made in this embodiment without departing from the principles and spirit of the invention, the scope of which is defined in the claims and their equivalents.

The present invention generally relates to various multicolor writing tools and methods thereof for applying multiple volatile marking substances one at a time. More particularly, the present invention relates to multicolor writing tools including a case member, a cartridge member, a cap member, and an actuator member. The case member forms an interior in which is disposed the cartridge member with the multiple cartridges each of which defines a body containing one of the marking substances therein and a tip through which such a marking substances is applied. The cap member varies and restores at least one configuration thereof, while the actuator member changes the configuration and exposes one of the tips selected by an user out of said interior when the tool is in use, and then restores such a configuration and encloses all of said tips inside the interior when the tool is not in use. Therefore, such writing tools preferably open the cap member in response to input force applied to other parts of the tools by the user, without having to require the user to engage in a separate maneuver to remove the cap member from such tools. In addition, such tools also close the cap member after the use as a response to the cartridge member which retracts into the interior of the case member, without having to require the user to engage in another separate maneuver to place the cap back to the tools. Thus, such tools of the present invention effectively prevent drying of tips of the cartridges when the tool is not in use. The present invention also relates to various methods of exposing tips of the cartridges of such tools out of the interior through various accesses provided in bottom ends of the tools, various methods of actuating such members of the tools, and various methods of moving multiple cartridges out of and into the interior of the tools. The present invention further relates to various processes for providing such multicolor writing tools and/or various members thereof.

Various aspects and/or embodiments of various writing tools, methods, and/or processes of this invention will now be described more particularly with reference to the accompanying drawings and text, where such aspects and embodiments thereof only represent different forms. Such tools, methods, and/or processes of this invention, however, may also be embodied in many other different forms and, accordingly, should not be limited to such aspects and/or embodiments which are set forth herein. Rather, various exemplary aspects and/or embodiments described herein are provided so that this disclosure will be thorough and complete, and fully convey the scope of the present invention to one of ordinary skill in the relevant art.

Unless otherwise specified, it is to be understood that various members, units, elements, and parts of various tools of the present invention are not typically drawn to scales and/or proportions for ease of illustration. It is also appreciated that such members, units, elements, and/or parts of various tools of this invention designated by the same numerals may typically refer to the same, similar, and/or functionally equivalent members, units, elements, and/or parts of such tools, respectively.

Various multicolor writing tools may be provided to expose multiple tips of multiple cartridges one at a time through various accesses formed in bottom ends of such tools through various actuating mechanisms. FIGS. 1A to 1H are longitudinal cross-sectional views of several exemplary writing tools exposing tips of their cartridge members out of their case members one at a time in their use positions (shown in upper panels) and then enclosing such tips inside their case members in their rest positions (shown in lower panels) through different actuating mechanisms according to the present invention.

In one aspect of the present invention, multiple tips of multiple cartridges of such a writing tool may be arranged to be exposed through different areas of an access one at a time in its use position and then to be enclosed in an interior in its rest position.

Figure 1B:
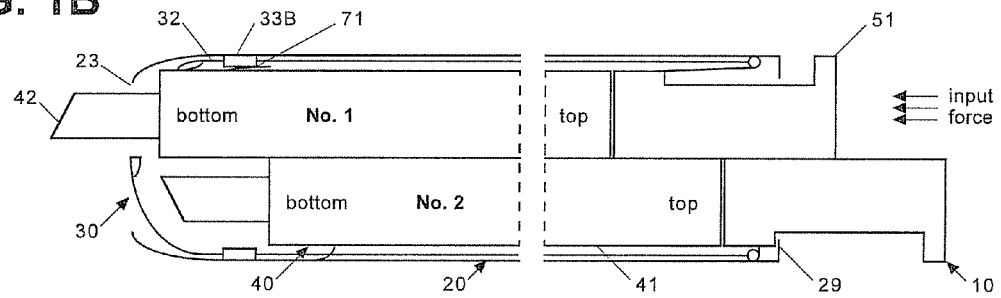

As shown in FIGS. 1A and 1B, an exemplary multicolor writing tool 10 includes a case member 20, a cap member 30, a cartridge member 40, and an actuator member 50. The case member 20 has an elongated case which forms an interior therein and which is shaped and/or sized to movably retain multiple cartridges therein and to allow movements of the cartridges one at a time. The case member 20 also forms an opening 23 in its bottom end so as to provide an access into the interior of the case member 20 from an exterior thereof through such an opening 23. The opening 23 of this embodiment is generally shaped and/or sized to allow movements multiple cartridges therethrough and arranged to be typically transverse to a longitudinal axis of the case member 20. The case member 20 also has a stop 29 disposed in its top end. The cap member 30 includes multiple caps 32 movably disposed in the interior of the case member 20 and above (or on top of) the opening 23. The caps 32 are arranged to extend upwardly toward the top end of the interior, to be movably supported by supports 33A, 33B, and to be fixedly coupled to top ends of handles 51 of the actuator member 50. As shown in FIG. 1A, the caps 32 are arranged to abut each other in a center area of the opening 23 in their off-state so as to obstruct such an opening 23 and to enclose the interior from the exterior. As described in FIG. 1B, one of such caps 32 may then be arranged to move away from the other thereof in its on-state, e.g., by vertically translating in an upward direction, thereby clearing one half of an entire area of such an opening 23.

The cartridge member 40 include multiple cartridges each having a body 41 and a tip 42, where each body 41 extends vertically from a top end to a bottom end of the body 41, whereas each tip 42 is disposed in the bottom end of the body 41. As shown in the figures, such cartridges are movably disposed inside the interior of the case member 20. It is appreciated that the exemplary cartridges are disposed close to each other in a center portion of the interior and also close to the case member 20 in a periphery portion of the interior. Such cartridges generally contain various marking substances in their bodies 41 and dispense the substances through their tips 42. In this exemplary embodiment, the cartridge member 40 consists of two cartridges which are to be referred to as a first cartridge and a second cartridge. The body 41 may have any shapes and/or sizes but may preferably be arranged to conform to the interior of the case member 20 so as to maximize an amount of the marking substances contained therein. Similarly, the tip 42 may be arranged to have any shapes and/or sizes as far as an user may apply the marking substances over an article such as, e.g., a sheet of paper.

The actuator member 50 includes a pair of handles 51 each of which is disposed above one of the cartridges and arranged to receive input force from an user and to translate vertically in response to such force. As described above, a top end of each cap 32 may be fixedly coupled to a portion of the handle 51 such that vertical translation of the handle 51 between its rest and use positions may be transformed into the movements of such caps 32 between their off- and on-states, respectively. It is appreciated that the capping surfaces of the caps 32 of this embodiment may generally correspond to those portions disposed below the support 33B in FIG. 1A. The remaining portions of the caps 32 do not constitute such capping surfaces and they rather play the role of transmitting at least a portion of the input force from the handle 51 to the capping surfaces of the caps 32.

Still referring to FIGS. 1A and 1B, the multicolor writing tool 10 also has at least one absorber unit 70 which is coupled to inner surfaces of the caps 32. More specifically, the absorber unit 70 has a pair of absorbers each of which couple with bottom ends of the caps 32 so that each absorber may abut each other when the caps 32 are in their off-states as in FIG. 1A and may move along with such caps 32 when the caps 32 move to their on-states as in FIG. 1B. Such absorbers are generally made of and/or include materials capable of physically (or chemically) absorbing (or adsorbing) the marking substances which may be present in the interior of the case member 20 due to leaking thereof through the tips 42 of the cartridge member 40. As will be described in greater detail below, incorporation of such an absorber unit 70 offers an advantage of preventing the marking substances leaked from the tips 42 from escaping the interior and contaminating the articles or user.

Such a multicolor writing tool 10 also includes multiple dividers 71 each of which is coupled to the body 41 of the cartridges. More specifically, the dividers 71 are generally made of and/or include flexible materials and arranged to be shaped and/or sized to snug-fit the inner surfaces of the case member 20 for forming an enclosed space bound by themselves and the bottom portions of the caps 32. Accordingly, such an enclosed space is only a fraction of the interior of the case member 20. As will be described below, incorporation of such dividers 71 offers an advantage of providing a smaller enclosed space for the tips 42 into which the marking substances may evaporate when the tool 10 is not in use. Thus, the dividers 71 may minimize an amount of the marking substances to be evaporated from the tips 42 when the tool 10 is not in use.

In operation and as shown in FIG. 1A, the cartridge member 40 is movably disposed in its rest position such that the first and second cartridges are disposed inside the interior of the case member 20 side by side and their tips 42 are placed in a same elevation. At the same time, the cap member 20 is disposed in its off-state such that the caps 32 may abut each other in the center of the opening 23 and obstruct an entire area of the opening 23. Accordingly, the tips 42 of the cartridge member 40 are enclosed in the interior of the case member 20 and fluidly isolated from the exterior of such a tool 10, thereby preventing or at least minimizing evaporation of the marking substances from the tips 42 into the exterior. Although the marking substances may evaporate constantly into the interior of the case member 20, an amount of such substances may be kept to a minimal level by carefully reducing a gap formed in the interior during this stage of non-use.

When the user wants to write or draw, he or she first selects which cartridge to use and then applies the input force to a selected portion of the actuator member 50, e.g., by vertically pressing one of the handles 51 of the actuator member 50 downwardly as depicted in FIG. 1B. In response thereto, one of the handles 51 chosen by the user begins to advance downwardly into the interior of the case member 20 while advancing one of such cartridges (the first cartridge in this example) selected by the user downwardly toward its use position. Because the top end of such caps 32 is fixedly coupled to the handles 51, downward movement of one of the handles 51 pulls one of the caps 32 through and around the support 33A, 33B. Therefore, the bottom end of the cap 32 or the capping surface thereof are pulled upwardly toward its on-state and gradually clears the opening 23 when the handle 51 and cartridge selected by the user advance downwardly. As the handle 51 reaches its most downward position, the cartridge selected by the user reaches its use position, while the cap 32 coupled to such a cartridge also reaches its on-state. In this stage, one half area of the opening 23 may be completely uncovered by the cap 32 and the tip 42 of the selected cartridge may be fully exposed through such an area of the opening 23.

Still referring to FIG. 1B and when the user is done with writing or drawing, he or she pushes, presses or otherwise manipulates the selected handle 51 again, and delivers similar or different input force to the actuator member 50. In response thereto, a recoil unit (not shown in the figure) begins to exert recoil force and to push the selected cartridge vertically and upwardly. When such a cartridge begins to translate upwardly and to retract back to the interior of the case member 20 toward its rest position, the handle 51 also begins to translate upwardly and to move out of the interior therewith. In addition, the bottom end of the selected cap 32 begins to move back toward the center of the opening 23 toward its off-state while gradually obstructing the cleared area of the opening 23 from its edges toward its center. As the handle 51 reaches the stop 29 provided in the top end of the case member 20, the handle 51 stops its upward movement, and the selected cartridge reaches its rest position and stops its upward retraction as well. In this stage, the selected cap 32 is arranged to reach its full off-state and to completely obstruct the opening 23 as depicted in FIG. 1A. Therefore, both of the tips 42 of the cartridge member 40 are again enclosed in the interior or fluidly isolated from the exterior of the tool 10, thereby preventing or minimizing evaporation of such marking substances therefrom when the tool 10 is not in use.

Figure 1C:
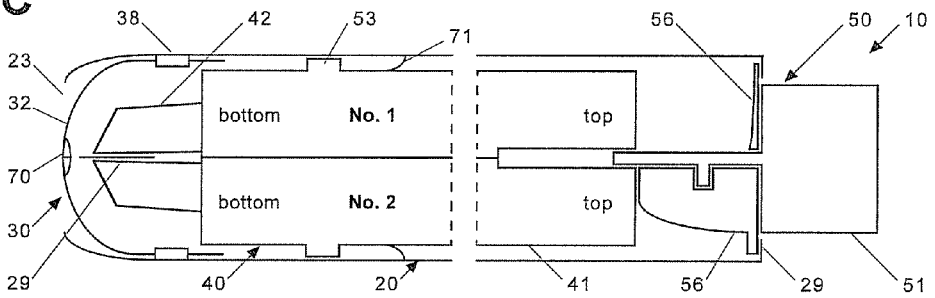
Figure 1D:
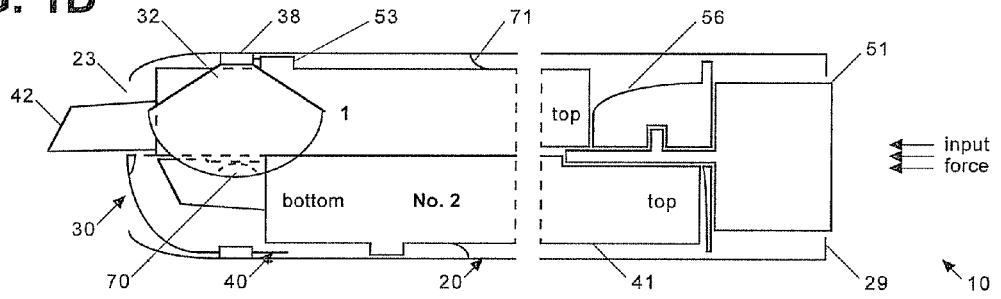

In another example as described in FIGS. 1C and 1D, another multicolor writing tool 10 includes a case member 20, a cap member 30, a cartridge member 40, and an actuator member 50. The case member 20 is similar to that of FIGS. 1A and 1B and defines an identical opening 23 in its bottom end. The case member 20 also includes a divider 29 disposed near its bottom end and, more specifically, disposed between two tips 42 of a pair of cartridges of the cartridge member 40. The cap member 30 includes multiple caps 32 which are movably disposed inside the interior of the case member 20 and above (or on top of) the opening 23 and which are movably supported by and also arranged to rotate about rotation axes 38. As shown in FIG. 1C, the caps 32 are arranged to abut each other in a center area of the opening 23 in their off-state, to obstruct the opening 23, and to enclose the interior from an exterior of the tool 10. As shown in FIG. 1D, such caps 32 are arranged to rotate or pivot away from each other about the rotation axes by about 90.degree, one at a time in their on-state while being disposed at least substantially parallel to a longitudinal axis of the case member 20.

The cartridge member 40 include multiple cartridges each having a body 41 and a tip 42 which are similar to those of FIGS. 1A and 1B. Each of the cartridges also define an indentation on one side of its top end so that two cartridges when disposed into the interior may form a hole in a center of the interior. Similar to those of FIGS. 1A and 1B, such cartridges are also disposed close to each other in the center of the interior and close to the case member 20 in a periphery portion thereof.

The actuator member 50 includes a single handle 51, a pair of actuators 53, and a rotating cam 56. The handle 51 is disposed above the cartridges and arranged to receive input force from an user and to translate vertically in response to such input force. The cam 56 generally forms a spiral shape such that the cam 56 abuts only one of the cartridges (the second cartridge in this example) in its rest position. Such a cam 56 is movably disposed under the handle 51 and arranged to translate vertically with the handle 51 while rotating in a clockwise or counterclockwise direction. More specifically, the actuator member 50 is arranged to transform the vertical translation of the handle 51 between its rest and use positions into rotation of such a cam 56 as depicted in FIGS. 1C and 1D. The actuators 53 are disposed near the bottom ends of the cartridges and shaped and/or sized to be disposed away from top ends of the caps 32 when the cartridges are disposed inside the interior in their rest position and then to abut and push the top ends of the caps 32 about the rotation axes as the cartridges advance downwardly toward their use position. Therefore, such actuators 53 may move the caps between their off- and on-states.

Still referring to FIGS. 1C and 1D, the multicolor writing tool 10 also has at least one absorber unit 70 which is coupled to inner surfaces of the caps 32. The absorber unit 70 is generally similar to that of FIGS. 1A and 1B and prevents the marking substances leaking from the tips 42 from escaping the interior and contaminating the articles or user. In addition, the tool 10 further includes at least one divider 71 which is fixedly coupled to the inner surfaces of the case member 20. Such a divider 71 is generally similar to those of FIGS. 1A and 1B and serves to form a smaller enclosed space inside the interior and minimizes an amount of the marking substances evaporating through the tips 42 when the tool 10 is not in use.

In operation and as shown in FIG. 10, the cartridge member 40 is movably disposed in its rest position such that the first and second cartridges are disposed inside the interior side by side and the tips 42 are placed in a same elevation. The cap member 20 is kept in its off-state so that the caps 32 abut each other in the center of the opening 23 and obstruct an entire area of the opening 23. Thus, the tips 42 are enclosed inside the interior and fluidly isolated from the exterior, thereby preventing or at least minimizing evaporation of the marking substances from the tips 42 into the exterior during this stage of non-use.

When the user wants to write or draw, he or she applies the input force by vertically pressing the handle 51 downwardly as shown in FIG. 1D. The handle 51 then begins to advance downwardly into the interior in response to such input force while translating the cam 56 downwardly therewith. The actuator member 50 then manipulates the cam 56 to gradually rotate and to be disposed over the other cartridge (the first cartridge in this example). As the handle 51 advances downwardly, the cam 56 also rotates further while advancing one of the cartridges selected by the user (the first cartridge in this example) downwardly toward its use position. In addition, as the selected cartridge advances, the actuator 53 also moves downwardly therewith, begins to abut the top end of the cap 32, and then to rotate such a cap 32 about the rotation axis 38. In response thereto, the bottom end of the cap 32 (i.e., the capping surface of such a cap member 30) also rotates about the rotation axis 38 toward its on-state and gradually clears the opening 23. As the handle 51 reaches its most downward position, the cartridge selected by the user and its actuator 53 also reach their use position, while the cap 32 also rotates to its on-state. In this stage, one half area of the opening 23 is completely uncovered by the cap 32 and the tip 42 of the selected cartridge may be fully exposed through such an area of the opening 23.

Still referring to FIG. 1D and when the user is done with writing or drawing, he or she pushes, presses or otherwise manipulates the handle 51 again, and delivers similar or different input force to the actuator member 50. A recoil unit (not shown in the figure) then begins to exert recoil force and to push the selected cartridge vertically and upwardly. When the cartridge begins to translate upwardly and to retract back into the interior toward its rest position, the actuator 53 also moves upwardly and allows the bottom end of the cap 32 to move back toward the center of the opening 23 toward its off-state while gradually obstructing the cleared area of the opening 23 from its edges toward its center. When the handle 51 reaches the stop 29 provided in the top end of the case member 20 and stops its upward movement, the selected cartridge reaches its rest position and stops its upward retraction as well. In this stage, the cap 32 also reaches its full off-state and completely obstructs the opening 23 as depicted in FIG. 1C. Accordingly, both of the tips 42 of the cartridge member 40 are again enclosed in the interior or fluidly isolated from the exterior, thereby preventing or minimizing evaporation of such marking substances therefrom when the tool 10 is not in use.

A case may arise that the user intends to select another cartridge (the second cartridge in this example) over which the cam 56 is disposed in the rest position. In such a case, the user may simply apply multiple input forces to the handle 51 so that the intended cartridge may expose its tip.

Figure 1E:
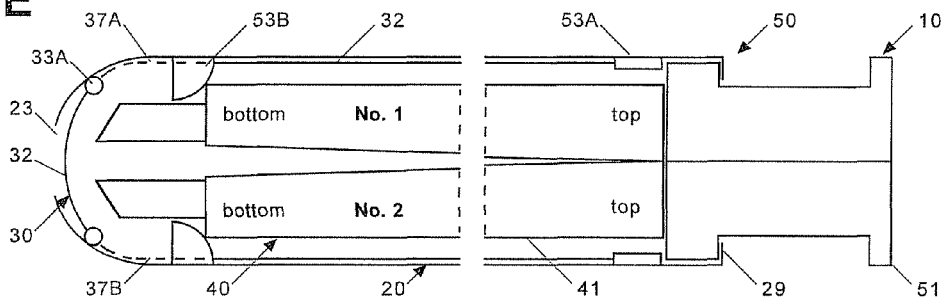
Figure 1F:
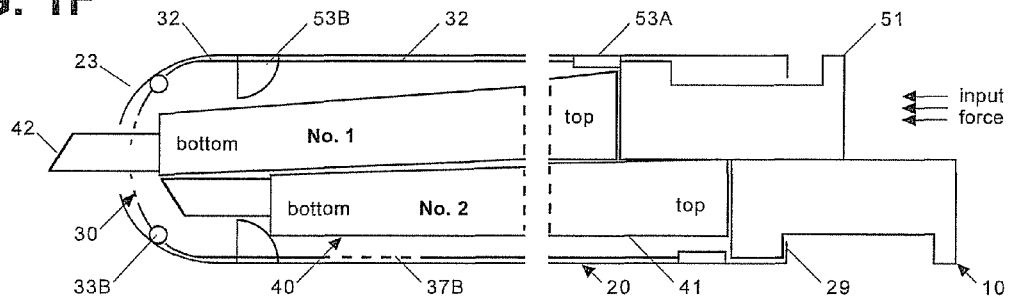

In another example as shown in FIGS. 1E and 1F, another exemplary multicolor writing tool 10 also includes a case member 20, a cap member 30, a cartridge member 40, and an actuator member 50. The case member 20 is generally similar to those shown in FIGS. 1A to 1D, except that it forms an opening 23 which is smaller or about one half of those of FIGS. 1A to 1D. A cap member 30 includes a single cap 32 defining multiple holes 37A, 37B therealong. Other portions of the cap 32 away from such hole 37 are typically shaped and/or sized enough to obstruct an opening 23, whereas the holes 37A, 37B are preferably shaped and/or sized to at least similarly match a characteristic dimension of the opening 23 such as, e.g., its diameter, length, width, height, and the like. Such a cap member 30 is preferably arranged to move with respect to the opening 23, to position the other portions thereof on or over the opening 23 in its off-state, and to align one of each holes 37A, 37B on or over the opening 23 in its on-state. Therefore, such a cap 32 may obstruct the opening 23 with its other portions in its off-state and then clear the opening 23 through each of such holes 37A, 37B in its on-state. The cap member 30 generally extends into the interior upwardly toward a top end of the interior and terminates by a pair of first actuators 53A which is movably disposed around inner surfaces of the case member 20. The cap member 30 also includes multiple supports 33A, 33B which movably support the cap 32 while allowing translation of such a cap 32 therethrough.

The cartridge member 40 includes multiple cartridges each of which has a body 41 and a tip 42 which are generally similar to those of FIGS. 1A to 1D. Such cartridges may have various shapes and sizes but may be preferably arranged to form a gap therebetween in a center of the interior when put into the case member 20. As exemplified in FIG. 1E, such cartridges may be tapered down from top to bottom so that, when inserted into the interior, they may form a sizable gap near their bottom ends but may not form any gap near their top ends. Such cartridges may further be disposed close to the case member 20 in a periphery portion of the interior or may define a clearance therefrom as exemplified in these figures.

The actuator member 50 includes a pair of handles 51 which are similar to those of FIGS. 1A and 1B and shaped and sized to extend toward the inner surfaces of the case member 20 such that they may abut and push the actuators 53A when advanced downwardly in response to input force. The actuator member 50 also includes at least one second actuator 53B disposed around or near the bottom end of the case member 20 and also extending into the center of the interior by a preset depth. More specifically, the second actuator 53B is disposed not to abut the cartridges in their rest position, but to abut and bias such cartridges in their use positions. Further roles of the second actuator 53B will be provided below. Although not shown in the figures, the writing tool 10 may include at least one absorber unit and/or divider as described in FIGS. 1A to 1D.

In operation and as shown in FIG. 1E, the cartridge member 40 is movably disposed in its rest position where the first and second cartridges are disposed inside the interior of the case member 20 side by side while defining a gap near the center of the interior. The cap member 20 is disposed in its off-state such that the portions of the cap 32 without the holes 37A, 37B are disposed on or over the opening 23 in its off-state and obstruct an entire area thereof. Therefore, the tips 42 of the cartridge member 40 is disposed inside the interior and fluidly isolated from the exterior.

As the user wants to write or draw, he or she first selects one of such cartridges and applies the input force by vertically pressing one of the handles 51 downwardly as exemplified in FIG. 1F. As a response, the selected handle 51 begins to advance downwardly into the interior while advancing one of such cartridges (the first cartridge in this example) selected by the user downwardly toward its use position. During its downward movement, the selected handle 51 approaches and then begins to push the first actuator 53A downwardly which in turn translates the cap 32 downwardly through the support 33A, 33B while gradually aligning the hole 37A of the cap 32 with the opening 23 toward its on-state. As the cartridge advances, its body 41 begins to contact the second actuator 53B and to be biased thereby toward the center of the interior. Accordingly, the tip 42 of the selected cartridge which is disposed off the center of the interior gradually moves toward such a center. As the handle 51 reaches its most downward position, the selected cartridge reaches its use position by advancing downwardly and disposing its tip 42 into the center of the interior, thereby positioning its tip 42 in line with the opening 23. In addition, the cap 32 also reaches its on-state by aligning its hole 37A with the opening. In such a stage, at least a substantial area of the opening 23 is completely uncovered by the cap 32, and the selected tip 42 may be fully exposed through such an area of the opening 23.

Still referring to FIG. 1F and when the user is done with writing or drawing, he or she pushes, presses or otherwise manipulates the selected handle 51 again, and delivers similar or different input force to the actuator member 50. In response thereto, a recoil unit (not shown in the figure) begins to exert recoil force and to push the selected cartridge vertically and upwardly while moving back such a cartridge toward the inner surfaces of the case member 20. In addition, the handle 51 also begins to translate upwardly and to move out of the interior, and the cap 32 begins to move back toward its off-state while misaligning the hole 37A away from the opening 23 and gradually obstructing such an opening 23 by its other portions. As the handle 51 reaches the stop 29 provided in the top end of the case member 20, the handle 51 stops its upward movement, and the selected cartridge reaches its rest position. In this stage, the cap 32 is arranged to reach its full off-state and to completely obstruct the opening 23 as depicted in FIG. 1E. Therefore, both of the tips 42 of the cartridge member 40 may be again enclosed in the interior or fluidly isolated from the exterior, thereby preventing or minimizing evaporation of such marking substances therefrom when the tool 10 is not in use.

It is appreciated that the exemplary multicolor writing tool 10 of FIGS. 1E and 1F is arranged to tilt the selected cartridge by a preset angle as such a cartridge advances downwardly. Accordingly, such a tool 10 may expose each tip 42 through the identical or at least substantially similar area of the opening 23. Such an embodiment is to be contrasted with other exemplary tools shown in FIGS. 1A to 1D in which each cartridge advances at least substantially parallel to the longitudinal axis of the case member and each tip is exposed through different areas of the opening 23.

Figure 1G:
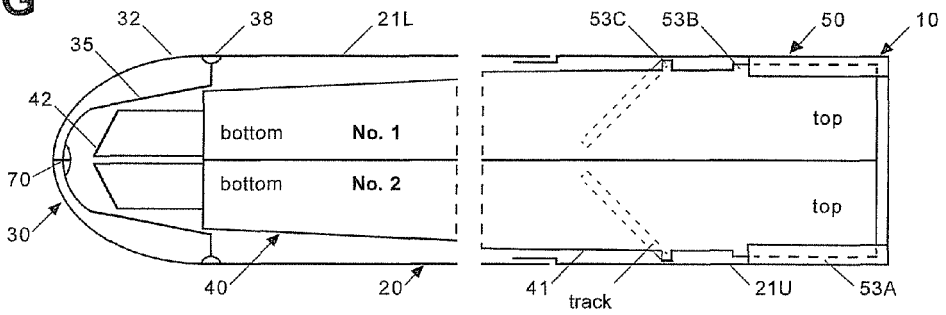
Figure 1H:
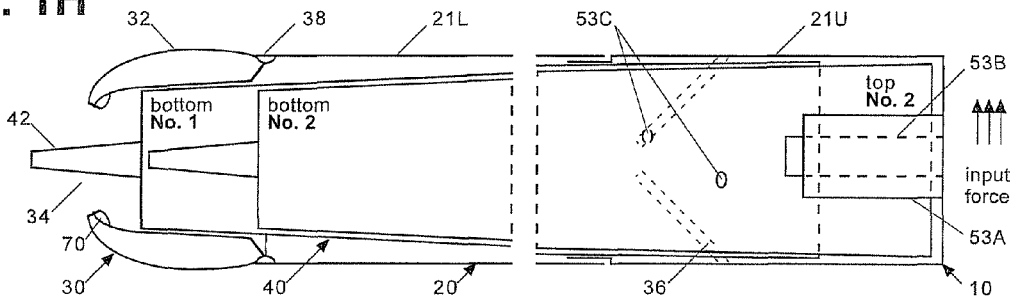

In another example and as shown in FIGS. 1G and 1H, another exemplary multicolor writing tool 10 also has a case member 20, a cap member 30, a cartridge member 40, and an actuator member 50. The case member 20 includes an upper case 21U and a lower case 21L, where the upper case 21U defines an oblong shape and retains a top portion of the cartridge member 40 therein, while the lower case 21L is movably coupled to and disposed over the upper case 21U, thereby allowing one of such cases 21U, 21L to rotate with respect to the other thereof. The upper case 21U also includes a pair of first actuators 53A extending from opposite sides of the inner surfaces thereof into the interior by a preset distance. The upper case 21U further forms a pair of tracks 36 which are angled indentations formed on the inner surfaces thereof by a preset angle and each of which preferably extend in about opposite directions. The cap member 30 includes multiple caps 32 which couple with a bottom end of the lower case 21U. The caps 32 are arranged to rotate or pivot about rotation axes 38 between their off- and on-states in order to respectively close and create a conduit 34 and to respectively close and form fluid communication between the interior and exterior of the case member 20. It is appreciated that such caps 32 constitute a boundary between the interior and exterior of the tool 10, contrary to those shown in FIGS. 1A to 1F in which the caps open and close various areas of the opening which corresponds to such a boundary. Such caps 32 are arranged to abut each other and to enclose the interior from the exterior in their off-state as shown in FIG. 1G, and arranged to open and to expose the cartridge member 40 in their on-state as shown in FIG. 1H. In addition, the caps 32 are tapered to define guides 35 on their inner surfaces in order to be actuated by the cartridge member 40 as will be described in greater detail below.

The cartridge member 40 includes multiple cartridges each with a body 41 and a tip 42 which are generally similar to those of FIGS. 1A to 1F. Such cartridges may have various shapes and sizes and may be movably disposed close to each other while forming a gap from the inner surfaces of the case member 20 when disposed therein. As exemplified in FIG. 1G, such cartridges may be tapered down from top to bottom so that, when disposed inside the interior, they may form a sizable gap near their bottom ends with respect to the case member 20 but may not form any gap near their top ends. Such cartridges may further be disposed close to the case member 20 in a periphery portion of the interior or may define a clearance therefrom as exemplified in these figures.

Contrary to those shown in FIGS. 1A through 1F, the actuator member 50 may not include any handle exposed to the user. Rather, the actuator member 50 includes a pair of second actuators 53B and another pair of third actuators 53C in addition to the first actuators 53A provided to the cartridges as described above. The second actuators 53B are provided as protrusions of the cartridges formed in their top ends. More specifically, such second actuators 53B are shaped and sized to abut the first actuators 53A so that movement of the first actuators 53A caused by rotation of the upper case 21U may actuate the second actuators 53B. In this example, the second actuators 53B are retained by the first actuators 53A as shown in FIG. 1H. The third actuators 53C are similarly provided as protrusions of the cartridges formed below the first actuators 53A. The third actuators 53C are shaped and sized to be movably retained by or inside the angled tracks 36 of the case member 20 so that rotation of the cartridges also causes vertical translation of such cartridges. Although not shown in the figures, the writing tool 10 may include at least one absorber unit and/or divider as described in FIGS. 1A to 1D.

In operation and as shown in FIG. 1G, the cartridge member 40 is movably disposed in its rest position where the first and second cartridges are disposed inside the interior of the case member 20 side by side while defining a gap around the periphery of the interior. The cap member 30 is disposed in its off-state such that its caps 32 abut each other and encloses the tips 42 of the cartridge member inside the interior.

As the user wants to write or draw, he or she first selects one of such cartridges and applies the input force by rotating the upper case 21U with respect to the lower case 21L in a preset direction and/or by a preset angle as exemplified in FIG. 1H. In response thereto, one of the first actuators 53A (one disposed near the first cartridge in this example) begins to abut the second actuator 53B formed on the selected cartridge (the first cartridge in this example) and to push such a cartridge angularly in, e.g., a counterclockwise direction. As the selected cartridge rotates, the third actuator 53C of such a cartridge abuts one of the tracks 36 and is guided by such a track 36. In result, the selected cartridge gradually begins to advance downwardly while rotating in such a direction. As the selected cartridge moves closer to the caps 32, the bottom end of the body 41 of the cartridge contacts a portion of the guide 35 of one of the caps 32 and begins to push and open such a cap 32. By operatively coupling such caps 32 to open and close in unison, the selected cartridge may open the caps 32 while forming a conduit 34 therebetween. As the upper case 21U rotates to the preset angle, the selected cartridge advances to its most downward use position, while the caps 32 define the widest conduit 34 in their on-state, thereby fully exposing the tip 42 of the selected cartridge through such a conduit 34. It is to be understood that the third actuator 53C of another cartridge which is not selected by the input force moves out of another track 36 so that another cartridge does not advance in response thereto. Thus, such a tool 10 may expose only one tip 42 at a time depending upon which direction the user rotates the upper case 21U and/or how much angle the user rotates such an upper case 21U.

Still referring to FIG. 1H and as the user is done with writing or drawing, he or she rotates or otherwise manipulates the upper case 21U again, and delivers similar or different input force thereto. The first actuator 53A of the selected cartridge then rotates the second actuator 53B in an opposite direction, and the third actuator 53C is guided upwardly by the track 36. Accordingly, the selected cartridge rotates along the opposite direction while retracting upwardly into the interior toward its rest position. Similar to those of FIGS. 1A to 1F, a recoil unit is incorporated into the cap member 30 so that the caps 32 gradually close the conduit 34 toward their off-state when the selected cartridge retracts upwardly. As the upper case 51U rotates to the preset angle, the selected cartridge reaches its rest position while disposing its tip 42 inside the interior. In this stage, the caps 32 are arranged to reach their full off-state and to completely close the conduit 34 as depicted in FIG. 1G. Accordingly, both of the tips 42 of the cartridge member 40 may be again enclosed in the interior or fluidly isolated from the exterior, thereby preventing or minimizing evaporation of such marking substances therefrom as such a tool 10 is not in use.

It is appreciated that the exemplary tool 10 of FIGS. 1G and 1H may also be arranged to tilt the selected cartridge by a preset angle as such a cartridge advances downwardly. Accordingly, such a tool 10 may expose each tip 42 through the identical or at least substantially similar conduit 34. In the alternative, the caps 32 may be arranged to form different conduits 34 defining different areas and/or shapes depending upon which cartridge is selected by the input force. In these aspects, the former example is similar to those of FIGS. 1E and 1F, whereas the latter example is similar to those of FIGS. 1A through 1D.

It is appreciated that such an actuator member may incorporate various conventional actuating means capable of receiving the user input force, selecting one of multiple cartridges depending upon a direction of such force and/or a location onto which such force is applied, and advancing the selected cartridge downwardly toward the opening provided in the bottom end of the case member or conduit formed by the cap member. Such actuating means are clearly documented in various prior art, where some examples of such prior art may include U.S. Pat. No. 3,989,389 entitled "Multicolor mechanical writing instrument" and issued to Hashimoto et al., U.S. Pat. No. 3,910,705 entitled "Multicolor writing instrument" and issued to Schumacher, U.S. Pat. No. 3,586,453 entitled "Writing pen" and issued to Anderka, U.S. Pat. No. 3,586,451 entitled "Writing instrument" and issued to Canton, U.S. Pat. No. 3,700,340 entitled "Multicolor ballpoint pen" and issued to Terasaki, U.S. Pat. No. 3,572,955 entitled "Writing pen" and issued to Andreka, U.S. Pat. No. 3,518,017 entitled "Writing instrument" and issued to Schmidt, U.S. Pat. No. 3,025,833 entitled "Multicolor pen or pencil" and issued to Fend, U.S. Pat. No. 3,130,712 entitled "Writing instrument" and issued to Kahn et al., U.S. Pat. No. 3,225,747 which is entitled "Multicolor pen, particularly a multicolor ball point pen" and issued to Schmidt, U.S. Pat. No. 2,837,057 which is entitled "Mechanical multi-color pencil of the ball-writing or lead-writing type" and issued to Morlock et al., U.S. Pat. No. 2,790,422 entitled "Multiple selective ball point pen" and issued to Grumbach et al., U.S. Pat. No. 2,690,738 which is entitled "Ball-point pen" and issued to Andonov, U.S. Pat. No. 2,676,570 which is entitled "Writing instrument" and issued to Fahringer, U.S. Pat. No. 2,494,202 entitled "Retractable polypointed writing utensil" and issued to Rem, and the like.

As exemplified in these figures, various cap members including a single or multiple caps having a variety of shapes and/or sizes may be incorporated into the multicolor writing tools of this invention. The cap members, caps, and/or at least portions thereof may be installed inside and/or outside various parts of the case member. The cap members, caps, and/or at least portions thereof may be disposed away from, near, over, below, and/or across an opening of the case member, and may also fixedly or movably couple with and/or may be supported by various members of the multicolor writing tools such as, e.g., the case, cartridge, and/or actuator members. As will be described in detail below, such cap members, caps, and/or at least portions thereof may preferably be arranged to enclose or isolate tips of the cartridge members from the exterior in their off-states, and to allow such tips to be exposed out of the case members in their on-states. Although not mandatory, at least portions of the cap members or their caps may be disposed inside the case members for aesthetic reasons and/or installed outside such members for visual attention. Similarly, at least portions of such cap members or their caps may also be disposed inside the case members for mechanical protection or to minimize damages thereto. Conversely, if at least portions of the cap members or caps may have to be disposed outside the case members, such portions may preferably have sturdy and foolproof configuration.

Various exemplary cap members and caps thereof have been disclosed in the aforementioned co-pending Applications. Some of the cap members include a single cap, while others employ multiple caps. Some of such cap members define planar capping surfaces, whereas others form non-planar, curved capping surfaces. Some of such cap members may obstruct or clear identical portions of the openings, while others may obstruct or clear different areas of the openings. Similarly, some of such cap members may form or close identical conduits, while others may form or close different conduits. Regardless of detailed configurational and/or operational characteristics, such cap members and their caps may be incorporated into the multicolor writing tools of this invention. Following FIGS. 2A to 2N and FIGS. 3A to 3P illustrate some exemplary embodiments of such cap members and their caps. It is to be understood, however, that other cap members and their caps which have been disclosed in the foregoing co-pending Applications may be similarly applied to and/or modified for the multicolor writing tools of the present invention.

Accordingly and in another aspect of the present invention, various cap members may include various caps in order to dispose one of multiple tips of multiple cartridges at a time therethrough. Such cap members may be arranged to obstruct and clear identical or different portions of the openings or, in the alternative, to form and close identical or different conduits. It is appreciated that following FIGS. 2A to 2N and FIGS. 3A to 3P include openings and that various cap members may be used to obstruct and clear such openings. However, such cap members may be alternatively used to form and close the conduits as well. In general, FIGS. 2A to 2N are schematic views of exemplary cap members having a single or multiple caps each defining a planar capping surface and moving between its off- and on-states, whereas FIGS. 3A to 3P depict schematic views of exemplary cap members including a single or multiple caps each of which may define a non-planar capping surface and may move between its off- and on-states according to the present invention.

Figure 2A:
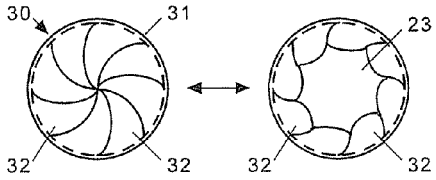
FIGS. 2A to 2N are schematic views of exemplary cap members including a single or multiple caps each defining a planar capping surface and moving between its off- and on-states according to the present invention.
Figure 3A:
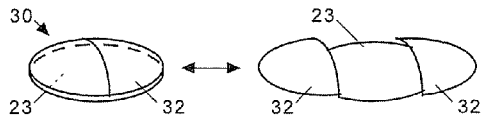
FIGS. 3A to 3P are schematic views of exemplary cap members including a single or multiple caps each having a non-planar capping surface and moving between its off- and on-states according to aspects of the present invention.

In one exemplary embodiment of this aspect of the invention and as depicted in FIG. 2A, a cap member 30 includes a frame 31 and multiple caps 32, where the frame 31 has a shape of an annular ring, while the caps 32 are movably disposed with respect to the frame 21 and shaped and/or sized similar to a diaphragm of a conventional reflex camera. Thus, such caps 32 are generally identical to each other, and arranged to obstruct an opening 23 when they are disposed adjacent to each other in their off-state and to clear such an opening 23 in their on-state as they move away from each other outwardly or in the centripetal direction. The caps 32 may begin to clear the opening 23 from a center of the frame 31 while moving centrifugally from their off-state to on-state, and to obstruct the opening 23 from a periphery of the frame 31 while moving centripetally from their on-state to off-state. It is to be understood that such an embodiment is similar to that of FIG. 2A of the co-pending Applications.

Figure 2B:
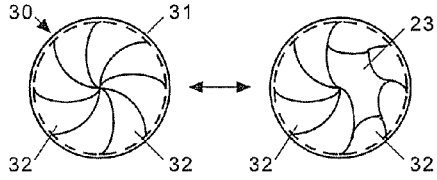

In a related exemplary embodiment of this aspect of the invention and as described in FIG. 2B, a cap member 30 has the similar frame 31 and caps 32. Such caps 32 are arranged to form multiple groups and each group of the caps 32 move between their off- and on-states depending upon which one of the cartridges is selected by an user. In this example, the caps 32 form a left group and a right group, where the latter is moving to its on-state while clearing a right half of the opening 23, whereas the former is kept in its off-state while obstructing a left half of the opening 23.

Figure 2C:
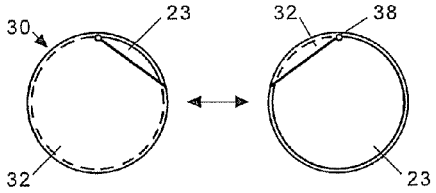

In another exemplary embodiment of this aspect of the invention and as described in FIG. 2C, a cap member 30 includes a frame 31 and a single cap 32 pivoting around a rotation axis 38 between its off- and on-states. The cap 32 typically clears an opening 23 from one to the other end of the frame 31, and obstructs such an opening 23 along a reverse direction similar to conventional sliding gates. It is appreciated that such an embodiment is similar to that of FIG. 2D of the co-pending Applications.

Figure 2D:
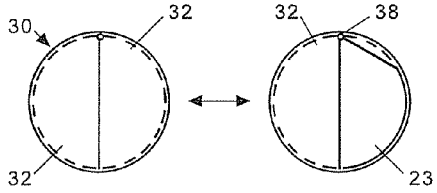

In a related exemplary embodiment of this aspect of the invention and as described in FIG. 2D, a cap member 30 includes the similar frame 31 but a pair of caps 32, where such caps 32 may move between their off- and on-states depending upon which cartridge may be chosen by the user. In this example, the right cap 32 is disposed in its on-state and clears a right half of the opening 23, while the left cap 32 is in its off-state and obstructs a left half of the opening 23.

Figure 2E:
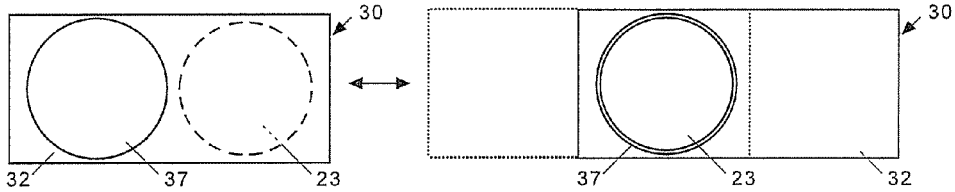

In another exemplary embodiment of this aspect of the invention and as described in FIG. 2E, a cap member 30 has a single cap 32 which defines an oblong shape and forms a hole 37 therealong. Such a cap 32 is arranged to be disposed away from an opening 23, thereby obstructing the opening 23 in its off-state, and to translate to be disposed over the opening 23, thereby clearing such in its on-state. Such an embodiment is similar to that of FIG. 2K of the co-pending Applications.

Figure 2F:
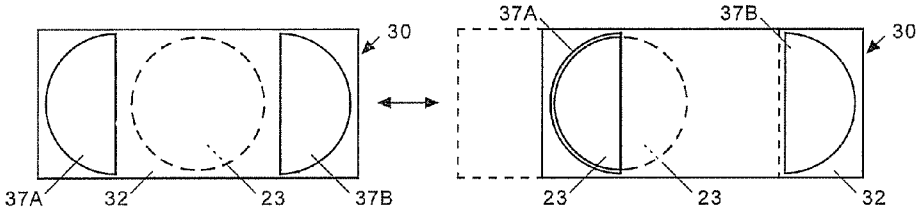

In a related exemplary embodiment of this aspect of the invention and as depicted in FIG. 2F, a cap member 30 includes a single cap defining therealong a pair of symmetric semi-circular holes 37A, 37B. The cap 32 in its off-state is arranged to dispose the opening 23 away from and between such holes 37A, 37B, thereby obstructing the opening 23. In its on-state, the cap 32 translates to the right (or to the left) and align the left hole 37A (or right hole 37B) over such an opening 32, thereby clearing a left (or right) half area of the opening 23 while obstructing the other half thereof.

Figure 2G:
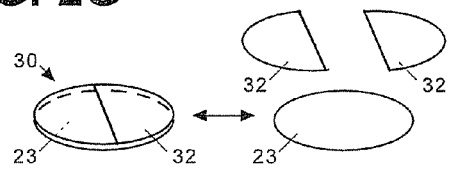

In another exemplary embodiment of this aspect of the invention and as described in FIG. 2G, a cap member 30 includes a pair of semi-circular caps 32 which may be shaped and/or sized enough to obstruct an opening 23 in their off-position, and to be disposed away from the opening 23 by moving away from each other in their on-state. Such caps 32 clear the opening 23 from its center portion and obstruct the opening 23 from opposing ends thereof. It is appreciated that this embodiment is similar to that of FIG. 3B of the co-pending applications.

Figure 2H:
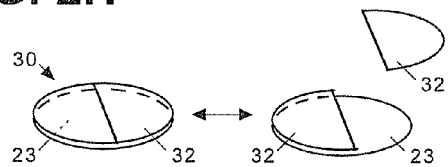

In a related exemplary embodiment of this aspect of the invention and as depicted in FIG. 2H, a cap member includes similar caps 32 which abut each other and obstruct the opening 23 in their off-state. The caps 32 may move away from the opening 23 one at a time in response to input force from the user and clear different areas of the opening 23 in their on-state. In this example, the right cap 32 is disposed away from the left cap 32 in its on-state, thereby clearing the right half of the opening 23, whereas the left cap 32 is disposed over and obstructs the left half of the opening 23.

Figure 2I:
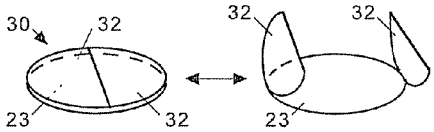

In another exemplary embodiment of this aspect of the invention and as described in FIG. 2I, a cap member 30 includes a pair of caps 32 similar to those of FIG. 2G but arranged to rotate or pivot in opposite directions toward their on-state. Therefore, such caps 32 may clear the opening 23 from its center portion and obstruct the opening 23 in an opposite direction. Such an embodiment is similar to that of FIG. 3D of the co-pending Applications.

Figure 2J:
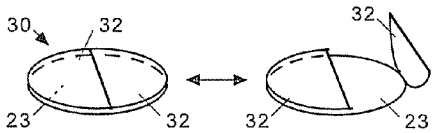

In a related exemplary embodiment of this aspect of the invention and as depicted in FIG. 2J, a cap member 30 includes similar caps 32 abutting each other to obstruct such an opening 23 in their off-state. Each cap 32 may rotate or pivot away from the opening 23 one at a time and clear different areas of the opening 23 in their on-state. In this example, the right cap 32 rotates or pivots away from the left cap 32 in its on-state, thereby clearing the right half of the opening 23, whereas the left cap 32 is disposed over and obstructs the left half of the opening 23.

Figure 2K:
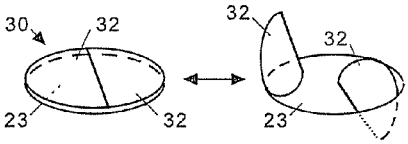

In another exemplary embodiment of this aspect of the invention and as described in FIG. 2K, a cap member 30 includes a pair of caps 32 similar to those of FIG. 2I but rotating or pivoting in opposite directions such as, e.g., one cap 32 pivoting upwardly or inwardly into the case to its on-state, while the other cap 32 pivoting downwardly or outwardly from the case to its on-state. It is noted that such an embodiment is similar to that of FIG. 3F of the co-pending applications.

Figure 2L:
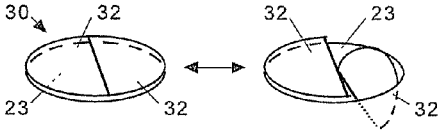

In a related exemplary embodiment of this aspect of the invention and as depicted in FIG. 2L, a cap member 30 has similar caps 32 abutting each other to obstruct the opening 23 in their off-state. Each cap 32 may rotate or pivot away from the opening one at a time and clear different areas of the opening 23 in its on-state. In this example, the right cap 32 rotates or pivots away from the left cap 32 in its on-state, thereby clearing the right half of the opening 23, whereas the left cap 32 is disposed over and obstructs the left half of the opening 23.

Figure 2M:
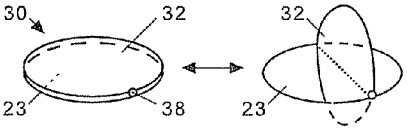
Figure 2N:
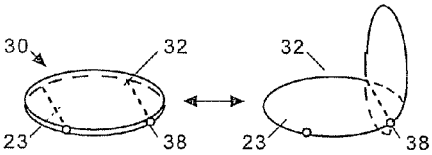

In another exemplary embodiment of this aspect of the invention and as described in FIG. 2M, a cap member 30 includes a single cap 32 pivoting about a rotation axis 38 which extends from one to an opposite edge of an opening 23. Accordingly, different portions of the cap 32 disposed opposite to each other with respect to the rotation axis 38 move into different directions toward their on-state so that one portion moves inwardly and the other portion moves outwardly with respect to the case. It is appreciated that such an embodiment is similar to that of FIG. 3G of the co-pending Applications.

In a related exemplary embodiment of this aspect of the invention and as depicted in FIG. 2N, a cap member includes a similar cap 32 which, however, may rotate or pivot about one of two rotation axes 38 at a time while clearing different areas of the opening 23. In this example, the cap 32 rotates about the right rotation axis 38, thereby substantially clearing at least the left half of the opening 23 but at least partly obstructing at most the right half thereof.

In another exemplary embodiment of this aspect of the invention and as described in FIG. 3A, a cap member 30 includes two caps 32 similar to those of FIG. 2G but has a curvature of being concave upward or downward. Such caps 32 match each other and are also shaped and sized to obstruct an opening 23 in their off-state. The caps 32 are then arranged to move away from each other in parallel but opposite directions toward their on-state so as to clear such an opening 23. Such an embodiment is similar to that of FIG. 4A of the co-pending Applications.

Figure 3B:
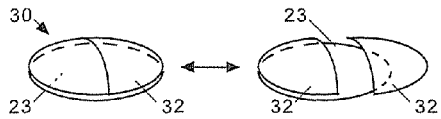

In a related exemplary embodiment of this aspect of the invention and as depicted in FIG. 3B, a cap member 30 has similar caps 32 which abut each other and obstruct the opening 23 in their off-state. Each cap 32 may translate away from the other one at a time and clear different areas of such an opening 23 in its on-state. In this example, the right cap 32 translates away from the left cap 32 in its on-state, thereby clearing the right half of the opening 23, whereas the left cap 32 is disposed over and obstructs the left half of the opening 23.

Figure 3C:
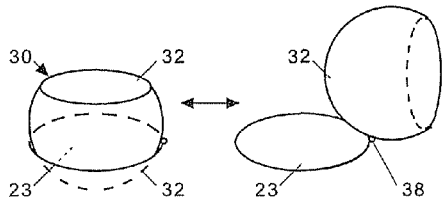

In another exemplary embodiment of this aspect of the invention and as described in FIG. 3C, a cap member 30 includes a single cap 32 having a shape of a truncated sphere and shaped and sized to completely obstruct an opening 23 in its off-position. Such a cap 32 is arranged to rotate or pivot by a preset angle about a rotation axis toward its on-state and clears at least a substantial area of the opening 23 in its on-state. This embodiment is similar to that of FIG. 4E of the co-pending application.

Figure 3D:
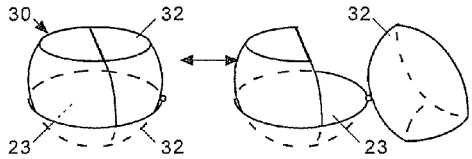

In a related exemplary embodiment of this aspect of the invention and as depicted in FIG. 3D, a cap member 30 includes a pair of symmetric caps 32 each corresponding to one half of the truncated sphere of FIG. 3C. Such caps 32 mat rotate or pivot about its rotation axis 38 one at a time and away from each other in response to input force. In this example, the right cap 32 is rotated to the right and clears the right half of the opening 23 in its on-state, while the left cap 32 is disposed in its off-state, thereby obstructing the left half of the opening 23.

Figure 3E:
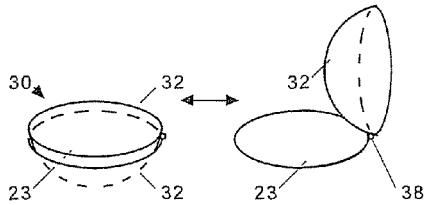
Figure 3F:
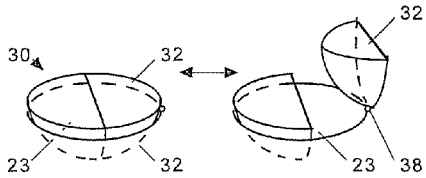

In another exemplary embodiment of this aspect of the invention and as described in FIG. 3E, a cap member 30 is similar to that of FIG. 3C, except that its cap 32 defines a shape of a lens. Such an embodiment is similar to that of FIG. 4F of the co-pending Applications. In a related embodiment shown in FIG. 3F, a cap member 30 is similar to that of FIG. 3D, except that each of its caps 32 may form one half of the lens of FIG. 3E.

Figure 3G:
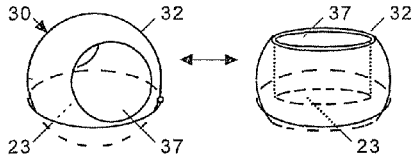

In another exemplary embodiment of this aspect of the invention and as described in FIG. 3G, a cap member 30 includes a single cap 32 generally having a shape of a sphere and defining a hole 37 therethrough. Such a cap 32 is disposed, in its off-state, to align its hole 37 transverse to an opening 23 and obstructs the opening 23. Thereafter, the cap 32 is arranged to rotate or pivot to align such a hole 37 with the opening 23 in its on-state so as to expose a tip of a cartridge therethrough. Such an embodiment is similar to that of FIG. 4H of the co-pending applications.

Figure 3H:
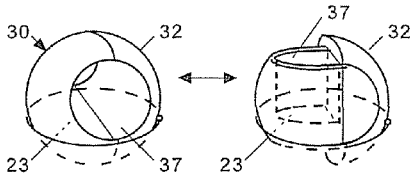

In a related exemplary embodiment of this aspect of the invention and as depicted in FIG. 3H, a cap member 30 includes a pair of symmetrical caps 32 each corresponding to one half of the sphere of FIG. 3G and including one half of the hole of FIG. 3G. Each cap 32 is arranged to vertically rotate or pivot in order to align and misalign its half-hole with each half of the opening 23. In this example, the right cap 32 is maintained in its off-state, thereby obstructing the right half of the opening 23, while the left cap 32 is rotated to its on-state, thereby clearing the left half of the opening 23.

Figure 3I:
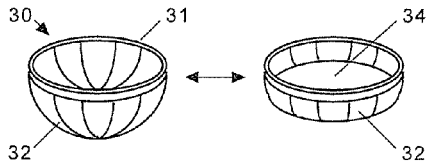

In another exemplary embodiment of this aspect of the invention and as described in FIG. 3I, a cap member 30 includes a frame 31 with a shape of an annular ring and multiple caps 32 arranged or disposed radially along a circumference of such a frame 31. Such caps 32 may abut or overlap each other in order to enclose an entire area inside the frame 31 in their off-state, and translate away from each other and over or across the frame 31 in order to form a conduit 34 through a center part of the frame 31 in their on-state. This embodiment is similar to that of FIG. 5A of the co-pending application.

Figure 3J:
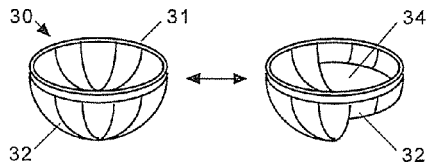

In a related exemplary embodiment of this aspect of the invention and as depicted in FIG. 3J, a cap member 30 includes similar caps 32 forming multiple groups and each group of the caps 32 moves between their off- and on-states depending upon which one of the cartridges is selected by an user. In this example, the caps 32 form a left group and a right group, where the latter moves to its on-state while clearing the right half of the opening 23, while the former is kept in its off-state while obstructing the left half of the opening 23.

Figure 3K:
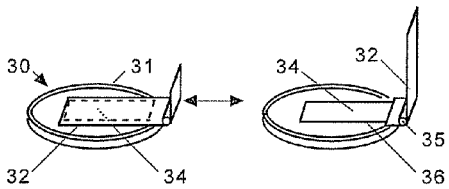

In another exemplary embodiment of this aspect of the invention and as described in FIG. 3K, a cap member 30 includes a frame 31 and a single cap 32, where the frame 31 defines an aperture in a center portion thereof and forms a track 36 along edges of such an aperture. The cap 32 is arranged to reciprocate along the track 36 while forming a conduit 34 by translating away from the aperture to its on-state along the track 36 and closing the conduit 34 in its off-state by moving back to its original position. An optional guide 35 may be included around or along the track 36 so as to guide translating movement of the cap 32. Such a track 36 may be arranged to be movably coupled to the cap 32, to movably retain the cap 32 therein, and the like, in order to ensure airtight sealing between the cap 32 and aperture. Such an embodiment is similar to that of FIG. 5C of the co-pending Applications.

Figure 3L:
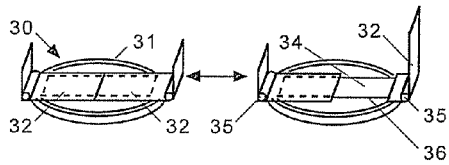

In a related exemplary embodiment of this aspect of the invention and as depicted in FIG. 3L, a cap member 30 includes the similar frame 31, guide 35, and track 36. The cap member 30, however, includes a pair of caps 32 abutting each other to close the conduit 34 in their off-state. Each of such caps 32 is arranged to translate away from each other one at a time, thereby forming the conduits 34 across different areas of an interior of the frame 31 in their on-state. In this example, the right cap 32 translates to its on-state and forms the conduit 34 on a right side of the frame 31, while the left cap 32 remains in its off-state and closes a left side of the frame 31.

Figure 3M:
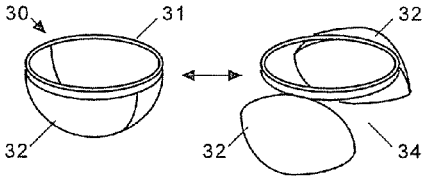

In another exemplary embodiment of this aspect of the invention and as described in FIG. 3M, a cap member 30 includes an annular circular frame 31 and a pair of caps 32 each forming a non-planar or spherical capping surface. The caps 32 movably couple with opposing, ends of the frame 31, and rotate or pivot toward and away from each other about rotation axes (not shown in the figure) so as to respectively destroy and form a conduit 34 therebetween. This embodiment is similar to that of FIG. 5E of the co-pending Applications.

Figure 3N:
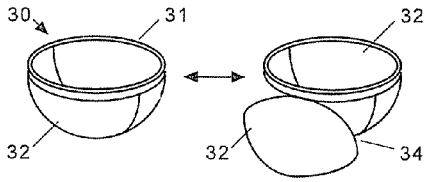

In a related exemplary embodiment of this aspect of the invention and as depicted in FIG. 3N, a cap member 30 includes the similar frame 31 and caps 32. However, each cap 32 may be arranged to move away from and toward each other in order to form different conduits 34. In this example, the left cap 32 rotates toward its on-state and forms the conduit 34 on the left side of the frame 31, while the right cap 32 remains in its off-state and closes the right side of the frame 31.

Figure 3O:
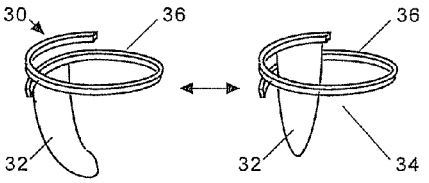
Figure 3P:
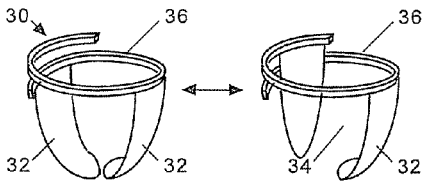

In another exemplary embodiment of this aspect of the invention and as described in FIG. 3O, a cap member 30 includes a single cap 32 and a curvilinear track 36 which has a spiral arrangement of multiple loops. The cap 32 is movably coupled to or supported by the track 36 and arranged to move along the track 36 in order to form a conduit 34 when the cap 32 is pulled upwardly to its on-state and to destroy the conduit 34 when such a cap 32 is pulled downward to its off-state. This embodiment is similar to that of FIG. 5H of the co-pending Applications.

In a related exemplary embodiment of this aspect of the invention and as depicted in FIG. 3P, a cap member includes the similar track 36 to which multiple caps 32 are movably coupled in opposite sides of the track 36. Such caps 36 are also arranged to be pulled upwardly one at a time in order to form the conduit 34 in different portions with respect to the track 36. In this example, the left cap 32 is pulled upwardly and forms the conduit 34 on the left side of the track 36 in its on-state, while the right cap 32 is kept in its off-state.

In other exemplary embodiments of such an aspect of the present invention, various caps may be arranged to maintain shapes and/or sizes of their planar capping surfaces beyond and/or out of an area over, below, projected upward, and/or projected downward the frame and/or opening or, in the alternative, to change or to reduce their shapes and/or sizes beyond and/or out of the aforementioned area. Such caps may also be arranged to form the conduits having various shapes and/or sizes and disposed in various areas with respect to the frames of the cap members. Other configurational and operational variations and modifications of the above embodiments of the exemplary cap members and their caps described in FIGS. 2A through 3P also fall within the scope of this invention, where such variations and modifications are provided in the co-pending Applications.

In another aspect of the present invention, multiple cartridges of such multicolor writing tools of the present invention may be arranged to be exposed through various accesses one at a time through such cap members. Following figures describe some exemplary embodiments of such cartridges and cap member which are operatively coupled to each other so that the cap members may clear identical or different areas of the opening or may form identical or different conduits through each of which the cartridges may be exposed one at a time. FIGS. 4A through 4H are longitudinal cross-sectional views of exemplary cartridge members moving between rest and use positions and exemplary cap members moving between their off- and on-states according to the present invention.

It is to be understood that the cap members and cartridge members exemplified in these figures may be manipulated independently by actuator members or by input force, may be operatively coupled directly to each other, may be coupled to each other through the case member, and the like. It is to be understood that the exemplary cap and cartridge members of the following figures may be arrange so that at least one of such cap and cartridge members may be arranged to move and expose tips of the case members one at a time and enclose such tips inside the interior of such case members. In other words, the cap and cartridge members may move between their off- and on-states and between their rest and use positions or, in the alternative, only cap members may be arranged to move between the off- and on-states thereof with respect to stationary cartridge members or, in another alternative, only cartridge members may be arranged to move between their rest and use positions with respective to cap members moving between their off- and on-states but not changing their positions. It is also to be understood that following exemplary embodiments for coupling mechanisms between such cartridge and cap members are only intended to illustrate various examples of such an aspect of this invention, and not to limit the scope of the present invention.

Figure 4A:
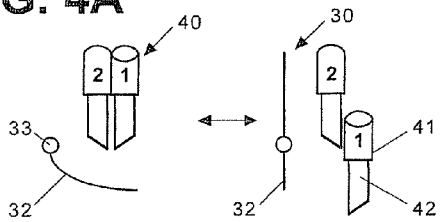
FIGS. 4A to 4H are longitudinal cross-sectional views of exemplary cartridge members moving between rest and use positions and exemplary cap members moving between their off- and on-states according to aspects of the present invention.

In one exemplary embodiment of such an aspect of the invention and as described in FIG. 4A, a multicolor writing tool includes a cap member 30 and a cartridge member 40, where the cap member 30 has a single cap 32 and a single stationary support 33, while the cartridge member 40 has a body 41 and a tip 42. The cap 32 may translate or slide above, below or across the support 33 between its off- and on-states in order to obstruct and clear an opening and/or to destroy and form a conduit such that the tip 42 may be enclosed and exposed therethrough. It is noted that the cap member 30 of such an embodiment generally clears the same area of the opening or forms the same conduit regardless of which cartridge is selected by the user. Such an embodiment is typically a modification of that of FIG. 8A of the co-pending Applications.

Figure 4B:
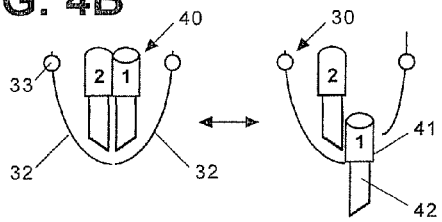

In another exemplary embodiment as shown in FIG. 4B, a multicolor writing tool includes a cap member 30 and a cartridge member 40, where the cap member 30 includes a pair of caps 32 each of which is arranged to vertically translate through each support 33 between its off- and on-states one at a time in order to obstruct and clear an opening and/or to close and form a conduit therethrough. In this example, a right cap 32 is in its on-state and a tip 42 of a first cartridge is exposed therethrough, while a left cap 32 is in its off-state while enclosing a second cartridge in an interior. In general, such an embodiment is a modification of that of FIG. 8B of the co-pending Applications.

Figure 4C:
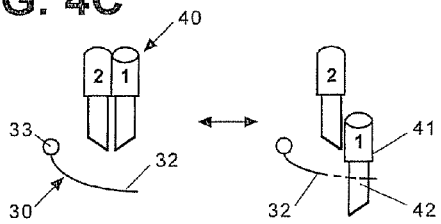

In another exemplary embodiment as shown in FIG. 4C, a multicolor writing tool includes a cap member 30 and a cartridge member 40, where the cap member 30, where the former 30 has a single cap 32 and a single stationary support 33, while the latter 40 has a body 41 and a tip 42. The cap 32 is arranged to pivot or rotate about the support 33 horizontally between its off- and on-states, thereby obstructing and clearing an opening and/or closing and forming a conduit therebetween so that the tip 42 may be enclosed and exposed. Similar to that of FIG. 4A, such a cap member 30 clears the same area of the opening or forms the same conduit regardless of which cartridge is selected by the user. This embodiment is typically a modification of that of FIG. 8E of the co-pending Applications.

Figure 4D:
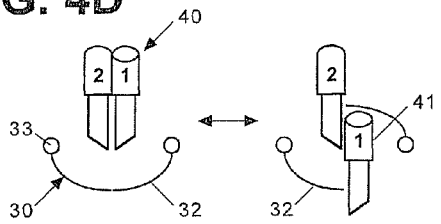

In another exemplary embodiment as shown in FIG. 4D, a multicolor writing tool includes a cap member 30 and a cartridge member 40, where the cap member 30 has a pair of caps 32 and a pair of stationary supports 33. The caps 32 are arranged to pivot or rotate about the supports 33 between their off- and on-states one at a time, thereby obstructing and clearing different areas of the opening and/or closing and forming different conduits therebetween so that different tips 42 may be exposed through different areas of the opening or different conduits. It is appreciated that such caps 32 may be arranged to rotate or pivot in the same or opposite directions. This embodiment is a modification of that of FIG. 8F of the co-pending Applications.

Figure 4E:
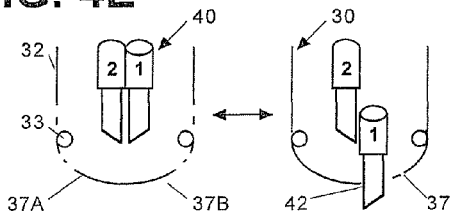

In another exemplary embodiment as shown in FIG. 4E, a multicolor writing tool includes a cap member 30 and a cartridge member 40, where the former 30 includes a cap 32 and multiple supports 33. The cap 32 is shaped as a strip or belt, defines a pair of holes 37A, 37B therealong, and arranged to translate while being movably supported or guided by such supports 33. Thus, the cap member 30 may obstruct an opening or close a conduit by disposing the holes 37A, 37B away from the opening, and may then clear different areas of the opening or form different conduits by aligning each of such holes 37A, 37B below the tips 42 of the cartridge member 40. In general, this embodiment is typically a modification of that of FIG. 8K of the co-pending Applications.

Figure 4F:
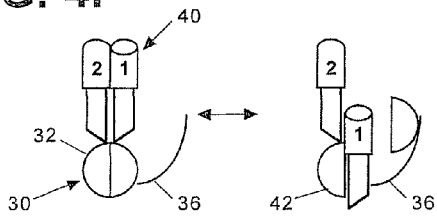

In another exemplary embodiment as shown in FIG. 4F, a multicolor writing tool includes a cap member 30 and a cartridge member 40, where the cap member 30 has a pair of hemispherical caps 32 which are arranged to translate, slide, and/or roll along tracks 36 between their off- and on-states in order to respectively obstruct and clear different areas of an opening and/or close and form different conduit therebetween. Such tracks 36 may be arranged to extend vertically and/or to wind spirally so that the caps 32 move away from the opening and/or conduit to their on-state. Such an embodiment is a modification of that of FIG. 8L of the co-pending Applications.

Figure 4G:
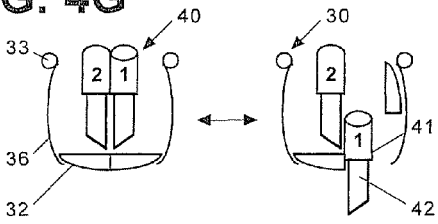

In another exemplary embodiment as shown in FIG. 4G, a multicolor writing tool includes a cap member 30 and a cartridge member 40, where the cap member 30 includes lens-shaped or truncated spherical caps 32 arranged to translate, slide, and/or roll along tracks 36 between their off- and on-states in order to respectively obstruct and clear different areas of an opening and/or to destroy and form different conduits therebetween. Such tracks 36 may be provided similar to those of FIG. 4F. In general, such an embodiment is a modification of that of FIG. 8M of the co-pending Applications.

Figure 4H:
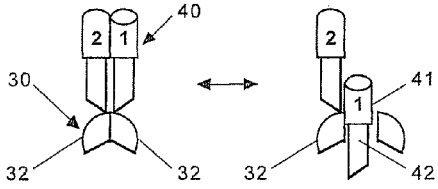

In another exemplary embodiment as shown in FIG. 4H, a multicolor writing tool includes a cap member 30 and a cartridge member 40, where the cap member 30 includes at least two caps 32 each forming a sphere or a truncation thereof when assembled and where convex capping surfaces of the caps 32 are arranged to face upward. Such caps 32 are also arranged to translate, rotate, pivot or otherwise move between their off- and on-states in order to obstruct and clear different areas of an opening and/or to destroy and form different conduits. Such an embodiment is a modification of that of FIG. 8N of the co-pending Applications.

In another aspect of the present invention, various multicolor writing tools may include multiple cartridges inside the interior of the case member and may incorporate various actuating mechanisms for exposing the tips of the cartridges one at a time. It is to be understood that selection of a specific actuating mechanism is typically a matter of choice of one of ordinary skill in the art, although there are a few criteria to be referred to when selecting such a mechanism.

The first criterion is that the actuating mechanism preferably allows the cartridges to contain a maximum amount of the marking substances in their bodies. Contrary to ball-point pens, highlighters or markers dispense a greater amount of marking substances per unit length of mark. Thus, a volume of the marking substances inside the body of the cartridge is an important design factor and also decides a life span of one tool. In order to maximize the amount of such marking substances contained in each of such cartridges, it is preferred to shape the cartridges to at least substantially fill the interior of the case member. It then follows that the cartridges have to dispose its tip through different areas of the opening or different conduits formed in different positions with respect to the bottom end of the case member. Accordingly, this embodiment has a downside of requiring an user to rotate the writing tool whenever she or he wants to use a different cartridge.

The second criterion is that the actuating mechanism preferably allows each of the cartridges to expose its tip through an identical opening and/or conduit which may be aligned with a center axis or a longitudinal axis of the case member. To this end, such cartridges must form a gap therebetween or another gap with the inner surfaces of the case member so that each cartridge when selected by the user may position itself toward such an axis and dispose its tip through such an opening and/or conduit. Accordingly, the user does not have to rotate the writing tool while exposing different tips of different cartridges. However, this embodiment has a downside of providing at least one gap inside the interior of the case member, thereby decreasing the total amount of marking substances contained in such cartridges and necessitating the user to replace such cartridges more often than otherwise.

As will be described in the following figures, the above conflicting criteria may be optimized in each of the following embodiments. FIGS. 5A to 5I show axial cross-sectional views (shown in left panels) and longitudinal cross-sectional views (shown in right panels) of various exemplary cartridge members exposing two tips one at a time through an opening or different areas of such an opening in their use positions (shown in upper panels) and enclosing all tips inside the case members in their rest positions (shown in lower panels) through different actuating mechanisms according to the present invention. It is appreciated that the following FIGS. 5A through 5I exemplify various multicolor writing tools each including two cartridges of the same shape and size but that such actuating mechanisms may readily be applied to other multicolor writing tools with three or more cartridges with the same or different shapes and/or sizes. It is also appreciated in all of those examples that an interior of a case member may define a center and a periphery, and may form a center portion in and/or around such a center and a periphery portion on and/or around the periphery. It is further appreciated in all of those examples that such a case member defines an opening in its bottom end and that the cap member (not shown in the figure) obstructs and clear an identical or different areas of the opening. However, the actuating mechanisms for such an opening may also be incorporated to the cap member which may be arranged to form and close an identical or different conduits.

Figure 5A:
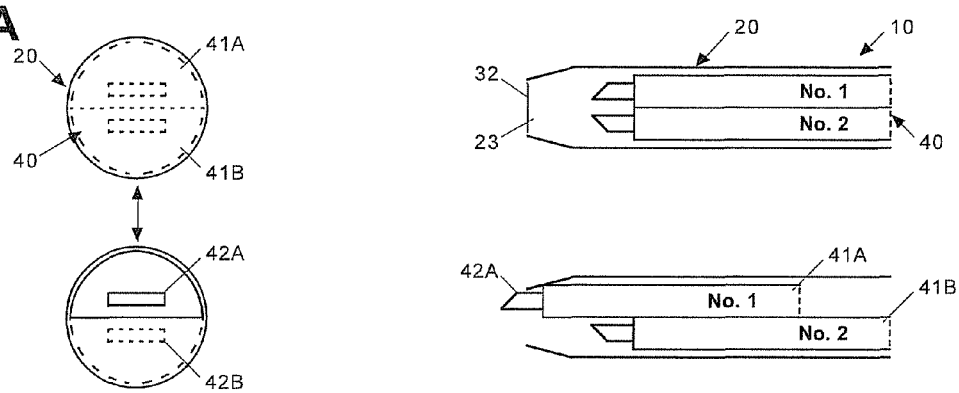
FIGS. 5A to 5I show axial cross-sectional views (shown in left panels) and longitudinal cross-sectional views (shown in right panels) of exemplary cartridge members exposing two tips one at a time through an opening or different areas of such an opening in their use positions (shown in upper panels) and enclosing all tips inside the case members in their rest positions (shown in lower panels) through different actuating mechanisms according to aspects of the present invention.
Figure 5B:
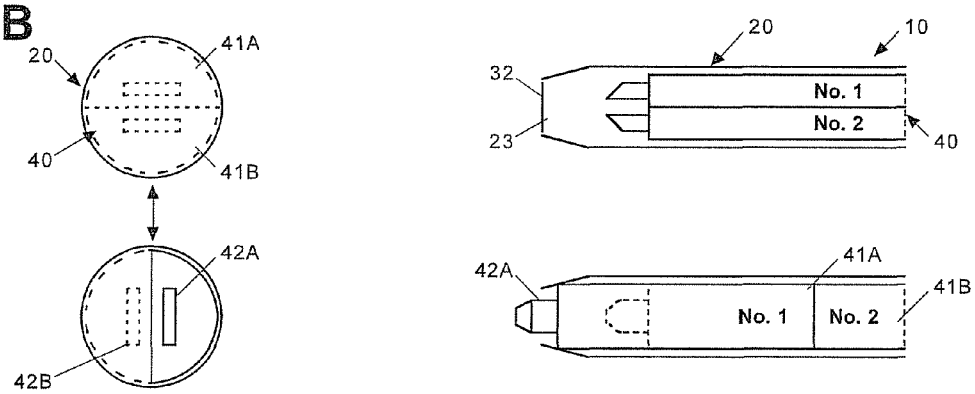

In one exemplary embodiment of such an aspect of the invention and as described in FIG. 5A, a multicolor writing tool 10 includes a case member 20 and a cartridge member 40, where the latter 40 includes a first cartridge and a second cartridge each respectively having a first body 41A and a first tip 42A and a second body 41B and a second tip 42B. The cartridges in their rest position are placed inside an interior of the case member 20 side by side, more particularly, close to each other in a center of the interior, and close to an inner surface of the case member 20 along a periphery of the interior. One of such cartridges (the first cartridge in this example) selected by input force from an user may advance downwardly while maintaining proximity with the other cartridge as well as with the inner surface. Thus, each tip 42A, 42B of the cartridges is exposed one at a time through different areas of an opening 23, while maximizing the amount of marking substances contained in the cartridges. In general, this embodiment is similar to that of FIGS. 1A to 1D. In another exemplary embodiment of such an aspect of the invention and as described in FIG. 5B, a tool 10 includes a similar case and cartridge members 20, 40. However, the first and second cartridges of this embodiment are arranged to rotate while advancing downwardly and to expose their tips 42A, 42B one at a time through different areas of the opening 23. Such an embodiment also maximizes the amount of marking substances contained inside the cartridges and its actuating mechanism is generally similar to that of FIGS. 1G and 1H.

Figure 5C:
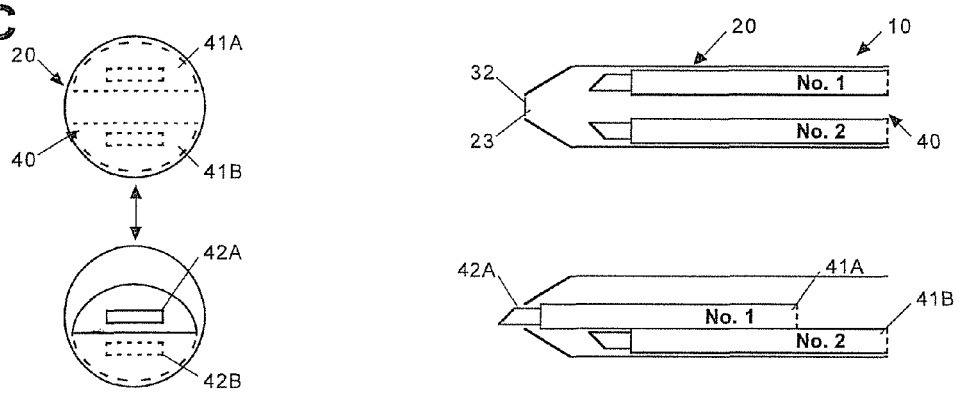
Figure 5D:
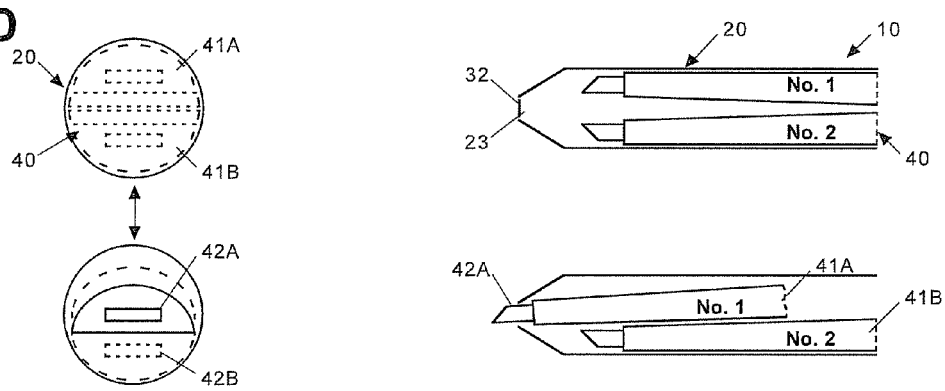
Figure 5E:
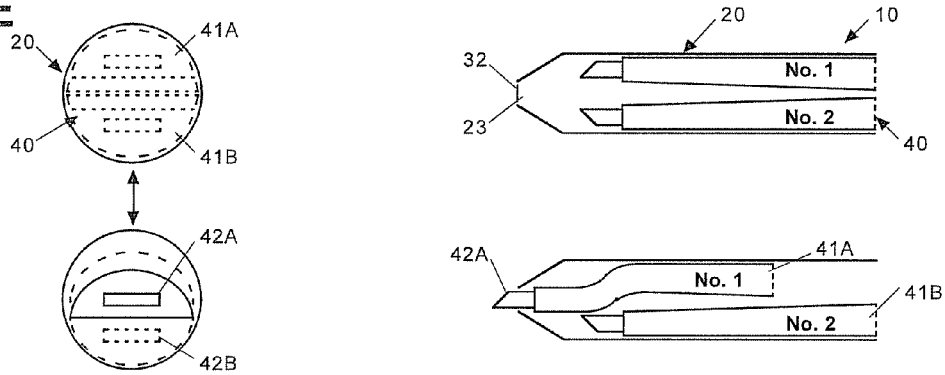

In another exemplary embodiment of such an aspect of the invention and as shown in FIG. 5C, a multicolor writing tool 10 includes a case member 20 and a cartridge member 40, where the latter 40 includes similar first and second cartridges. Such cartridges in their rest position are disposed inside the interior side by side, more particularly, away from each other by a preset distance in the center of the interior while defining a center gap therebetween, but close to the inner surface in the periphery. One of such cartridges (the first cartridge in this example) selected by input force from an user may advance downwardly while translating toward the center and close to the other cartridge in parallel to a longitudinal axis of the case member and while aligning its tip 42A with the opening 23. Accordingly, each tip 42A, 42B of the cartridges is exposed one at a time through the same area of an opening 23, although the amount of marking substances contained in such cartridges may be smaller than those of FIGS. 5A and 5B. In a related exemplary embodiment of FIG. 5D, a tool 10 may include similar case and cartridge members 20, 40, except that the first and second cartridges are tapered from their bottom to top ends to have greater cross-sectional areas therealong. Such cartridges in their rest position form a gap in the center which is the greatest near the bottom ends of the cartridges and decreasing in its size upwardly toward their top ends due to the taper. The selected cartridge (the first cartridge in this example) may advance downwardly while tilting its bottom portion at about an acute angle toward the center and approaching the other cartridge and aligning its tip 42A with the opening 23. Thus, each tip 42A, 42B of the cartridges is exposed one at a time through the same area of an opening 23, although the amount of marking substances contained in such cartridges is also smaller than those of FIGS. 5A and 5B. It is appreciated, however, that such cartridges with tapered bodies 41A, 42A may contain more marking substances therein than those of FIG. 5C. In another related exemplary embodiment of FIG. 5E, a tool 10 includes the case and cartridge members 20, 40 which are generally similar to those of FIG. 5D. However, the bottom ends of such cartridges are made or and/or include flexible materials and/or structure so as to bent at least portions thereof when abutted or pushed by various actuators and/or guides such as, e.g., the second actuators 53B of FIGS. 1E and 1F. Accordingly, the selected cartridge (the first cartridge in this example) advances downwardly while bending its bottom portion toward the center and close to the other cartridge and aligning its tip 42A with the opening 23. Thus, each tip 42A, 42B of the cartridges is exposed one at a time through the same area of an opening 23, although the amount of marking substances contained in such cartridges is also smaller than those of FIGS. 5A and 5B. It is appreciated, however, that such cartridges with tapered bodies 41A, 42A may contain more marking substances therein than those of FIG. 5C.

Figure 5F:
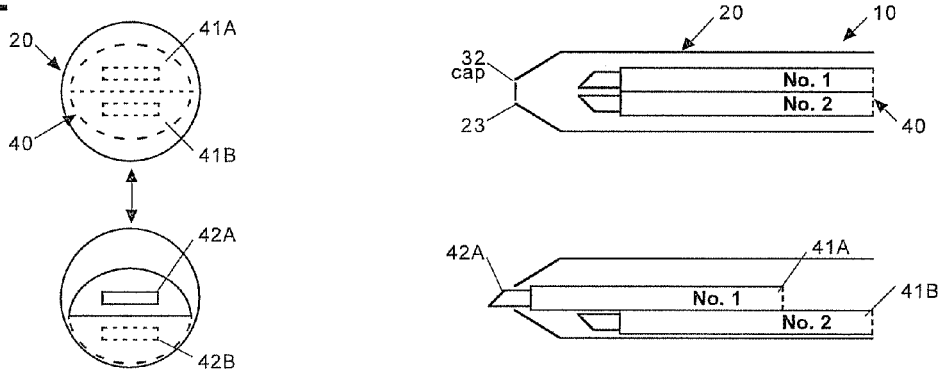
Figure 5G:
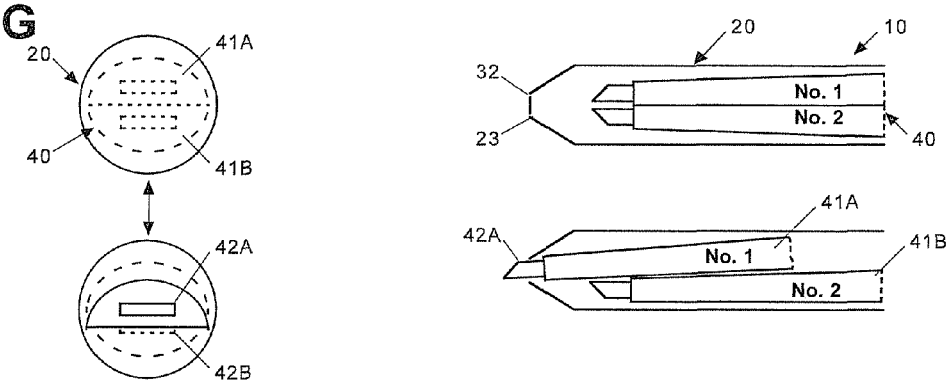

In another exemplary embodiment of such an aspect of the invention and as described in FIG. 5F, a multicolor writing tool 10 includes a case member 20 and a cartridge member 40, where the latter 40 has similar first and second cartridges. The cartridges in their rest position are disposed inside the interior side by side, more particularly, close to each other in the center of the interior but away from the inner surface by a preset distance while defining a periphery gap in the periphery. In response to input force, both cartridges translate in unison toward a portion of the case member 20 in parallel to a longitudinal axis of the cartridge member while positioning the selected cartridge (the first cartridge in this example) near the center and while also aligning its tip 42A with the opening 23. Thereafter, the selected cartridge advances downwardly. Therefore, each tip 42A, 42B of the cartridges is exposed one at a time through the same area of an opening 23, although the amount of marking substances in such cartridges may be smaller than those of FIGS. 5A and 5B. In a related exemplary embodiment of FIG. 5G, a tool 10 may include similar case and cartridge members 20, 40, except that such cartridges are tapered from their bottom to top ends to have greater cross-sectional areas therealong. Contrary to those of FIGS. 5D and 5*e* where the bodies have tapered surfaces facing the center of the interior, the cartridges of this embodiment include such tapered surfaces facing the inner surface of the case member 20. The cartridges in their rest position form a gap in the periphery which is the greatest near the bottom ends of the cartridges and decreasing in its size upwardly toward their top ends due to the taper. In response to the input force, both cartridges tilt their bottom ends toward the case member by about an acute angle while positioning the selected cartridge (the first cartridge in this example) near the center and while also aligning its tip 42B with the opening 23. Accordingly, the other cartridge (the second cartridge in this example) moves close to the case member as well. Thereafter, the selected cartridge may advance downwardly. Thus, each tip 42A, 42B of the cartridges may be exposed one at a time through the same area of an opening 23, although the amount of marking substances in such cartridges is smaller than those of FIGS. 5A and 5B but larger than that of FIG. 5F.

Figure 5H:
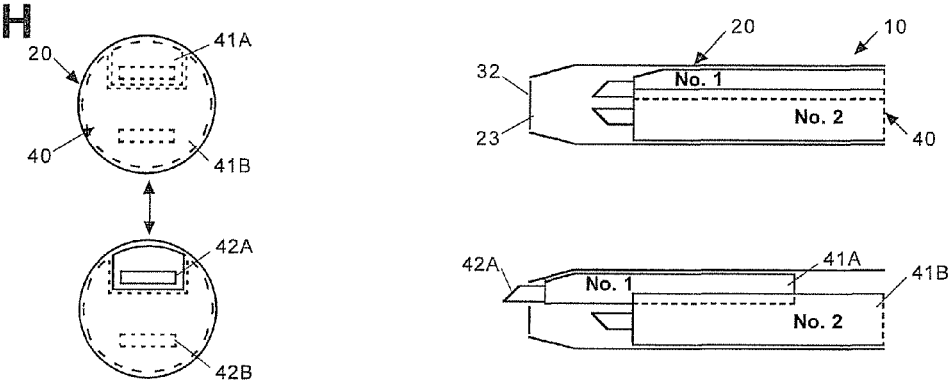

In another exemplary embodiment of such an aspect of the invention and as shown in FIG. 5H, a multicolor writing tool 10 includes a case member 20 and a cartridge member 40, where the latter 40 ha the first and second cartridges. More specifically, such a second cartridge is arranged to movably enclose and/or retain at least a portion of the first cartridge therein so that the second cartridge may contain more marking substances therein than the first cartridge. Such cartridges in their rest position are placed inside an interior of the case member 20 side by side, more particularly, close to or abutting each other in the center, and close to the inner surface in the periphery. The selected cartridge (the first cartridge in this example) advances downwardly while keeping proximity with the other cartridge as well as with the inner surface. Thus, each tip 42A, 42B of the cartridges is exposed one at a time through different areas of an opening 23, while maximizing the amount of marking substances in such cartridges. When desirable, the second cartridge may be arranged to completely enclose or surround an entire body 41A of the first cartridge in order to increase a volume thereof. In addition, the first and second cartridges may be arranged to abut each other at an angle in the center so that each cartridge may advance at the angle with respect to the other, thereby exposing each tip 42A, 42B one at a time through the same area of the opening 23.

Figure 5I:
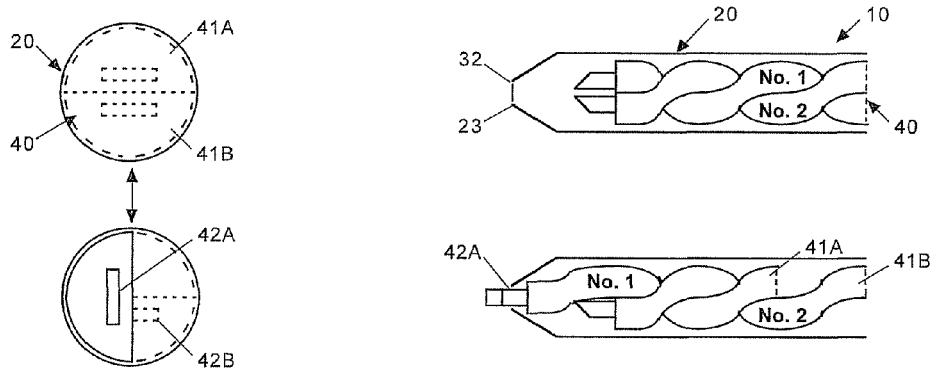

In another exemplary embodiment of such an aspect of the invention and as shown in FIG. 5I, a multicolor writing tool 10 includes a case member 20 and a cartridge member 40, where the latter 40 ha the first and second cartridges. More specifically, such cartridges are arranged to intertwine and to form a double helical structure. Such cartridges in their rest position are placed inside an interior of the case member 20, more particularly, intertwining each other along their entire lengths. The selected cartridge (the first cartridge in this example) advances downwardly while rotating around the second cartridge and while maintaining approximately identical distances from the second cartridge and from the inner surface. Therefore, each tip 42A, 42B of the cartridges is exposed one at a time through the same area of the opening 23.

The foregoing actuating mechanisms may be applied to other cartridge members including more than two cartridges. For example, FIGS. 6A to 6E depict axial cross-sectional views of an exemplary cartridge member which includes four cartridges and exposes one tip at a time through an identical or different areas of an opening in its use position (shown in right panels) and then enclosing all four tips inside the case member in its rest positions (shown in left panels) through one of the above actuating mechanisms according to the present invention.

Figure 6A:
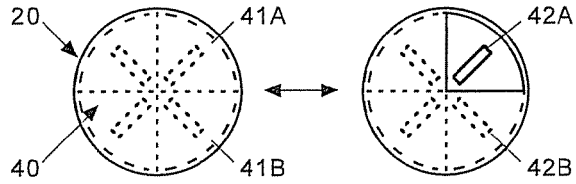
FIGS. 6A to 6E are axial cross-sectional views of exemplary cartridge members exposing one of four tips at a time through an opening or different areas of the opening in the use positions (shown in right panels) and then enclosing all four tips inside the case members in the rest positions (shown in lower panels) through different actuating mechanisms according to aspects of the present invention.
Figure 6B:
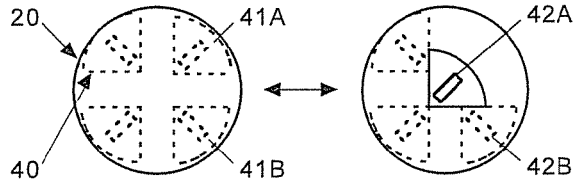

In FIG. 6A, a cartridge member 20 has four identical cartridges disposed close to each other in a center of an interior of a case member 20 and close to an inner surface of the case member 20 in a periphery of the interior. Each of such cartridges may be actuated between its rest and use positions similar to those of FIG. 5A. In FIG. 6B, a cartridge member 20 has four cartridges which are disposed away from each other in the center but close to the inner surface in the periphery. The cartridges are actuated between their rest and use positions similar to those of FIG. 5C.

Figure 6C:
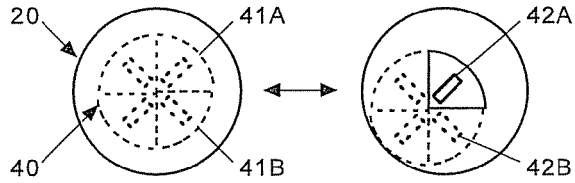
Figure 6D:
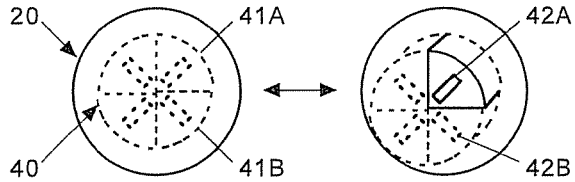
Figure 6E:
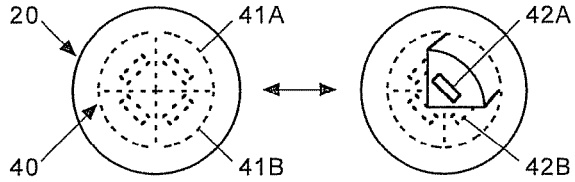

In FIG. 6C, a cartridge member 20 has four cartridges which are disposed close to each other and move together between their rest and use positions while moving a selected cartridge toward the center, similar to those of FIG. 5F. In FIG. 6D, a cartridge member 20 includes four cartridges disposed close to each other and moving together between their rest and use positions while tilting a selected cartridge toward the center, similar to those of FIG. 5G. In the alternative, such a selected cartridge of this embodiment may be bent toward the opening. Another embodiment of FIG. 6E is typically similar to that of FIG. 6D, except that the cartridges include tips aligned in a direction transverse to that of other tips of FIGS. 6A to 6D.

Configurational and/or operational variations and/or modifications of the above embodiments of such multicolor writing tools and/or various members thereof described in FIGS. 5A to 5I and FIGS. 6A to 6E also fall within the scope of this invention.

The foregoing actuating mechanisms may be applied to other cartridge members including more than four cartridges such as, e.g., six, eight, and so on, and to other cartridge members including odd numbers of cartridges such as, e.g., three, five, seven, and the like. Regardless of the exact number of such cartridges of the cartridge member, such cartridges may be disposed symmetrically along an angular direction around the periphery of the interior whether or not forming the peripheral gap and/or center gap. In this example, the cartridges may be arranged in an uniform or different intervals. In the alternative, one or more cartridges may be disposed in or near the center of the interior, while the rest of the cartridges may be arranged around the center cartridge(s) at an uniform or different distances. In another alternative, such cartridges may be disposed concentrically, where the peripheral cartridge may enclose or surround an entire portion or only a portion of the inner cartridge.

Although the above embodiments generally include multiple cartridges having the same shapes and sizes, such cartridges may have different shapes and/or sizes. For example, one cartridge with the most frequently used marking substance may be arranged to be bigger than other cartridges with less frequently used marking substances. In addition, although the above embodiments actuates all of the cartridges by a single actuating mechanism, it is also feasible to fabricate the multicolor writing tool which actuates multiple cartridges by multiple different mechanisms.

When desirable, two or more cartridges may be exposed simultaneously through the opening of the case member or conduit of the cap member. The tips of such cartridges may be exposed in the same lengths or in different lengths. The tips of the cartridges may be disposed at different angles in order to expose such tips through the same area of the opening or the same conduit. It is appreciated that exact shapes and/or sizes of such cartridges and/or tips thereof may be determined by various factors such as, e.g., dynamic characteristics of the actuating mechanisms, shapes and/or sizes of the cap and/or actuator members, disposition of such members, and the like.

Figure 7A:
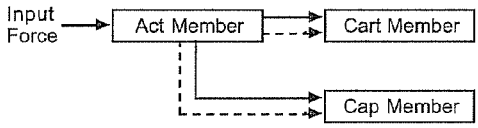
FIGS. 7A to 7T are schematic diagrams of exemplary writing tools for receiving input force and for transmitting such force through various members thereof according to the present invention.

In another aspect of the present invention, a multicolor writing tool may receive input force by one or more of its various members and/or to transmit such input force from one to the other members in one of various sequences. FIGS. 7A to 7T are schematic diagrams of exemplary multicolor writing tools for receiving input force and transmitting such force through various members thereof according to the present invention, where solid lines represent paths for direct transmission of such input force (i.e., transmission of such force without altering an amplitude and a direction of such force), whereas dotted lines denote paths for indirect transmission of such input force (i.e., transmission of such force while and/or after altering its amplitude and/or direction). In either of direct or indirect transmissions of such force, lengths and paths of movements of a first member of the multicolor writing tool receiving such force from the user and those of a second member receiving such force from the first member may or may not be arranged to be identical to each other. It is appreciated that following exemplary embodiments of various force receiving and/or transmitting mechanisms are only intended to illustrate various examples of this aspect of the present invention and not to limit the scope of this invention.

Figure 7B:
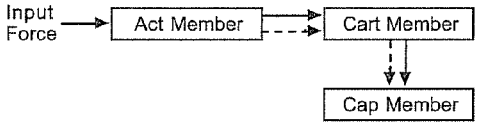
Figure 7C:
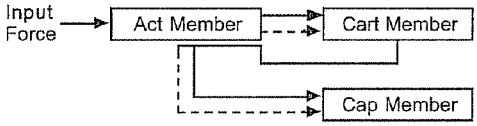
Figure 7D:
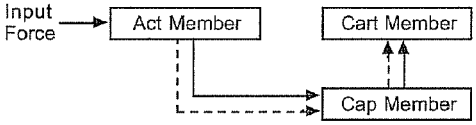
Figure 7E:
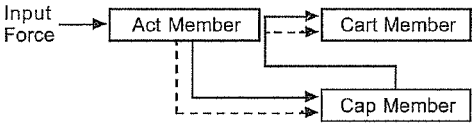
Figure 7F:
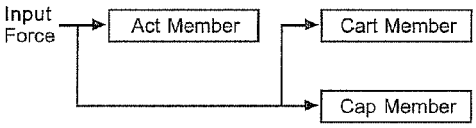

In a first group of exemplary embodiments of such an aspect of the invention and as shown in FIGS. 7A to 7F, a multicolor writing tool initially may receive the input force through its actuator member which may then transmit the input force to one, two or more members of the tool. In FIG. 7A, such an actuator member transmits the input force to the cartridge and cap members directly or indirectly with or without altering the amplitude and/or direction of such input force. In FIG. 7B, an actuator member transmits the input force to the cartridge member which then transmits at least a portion of such force to the cap member, either directly or indirectly with or without altering the amplitude and/or direction of such force. In FIG. 7C, the actuator member transmits the input force to the cartridge member which then either directly or indirectly transmits at least a portion of such force to the cap member by at least a partial intervention or participation of the actuator member. In FIG. 7D, the actuator member transmits the input force to the cap member which then transmits at least a portion of the force to the cartridge member, either directly or indirectly with or without altering the amplitude and/or direction of the force. In FIG. 7E, the actuator member transmits the input force to the cap member which then either directly or indirectly transmits at least a portion of such input force to the cartridge member by at least a partial intervention or participation of the actuator member. In FIG. 7F, the actuator receives the input force, while at least one of such cap and/or cartridge members also receives the input force directly and is actuated thereby. It is appreciated that such an actuator member may also transmit at least a portion of the input force to the case member which may then transmit at least a portion of the other members either directly or indirectly. These embodiments are to be illustrated in greater detail below.

Figure 7G:
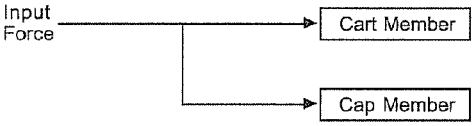
Figure 7H:
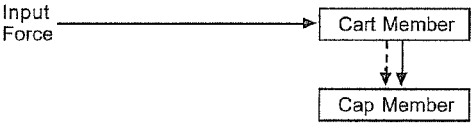
Figure 7I:
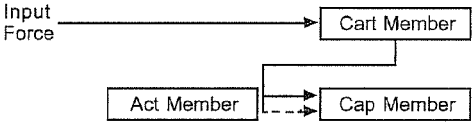
Figure 7J:
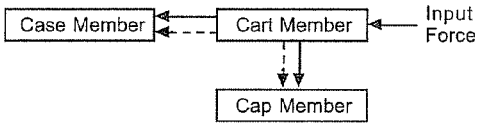
Figure 7K:
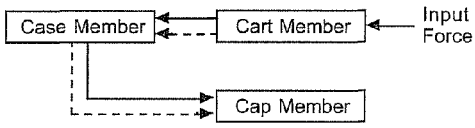
Figure 7P:
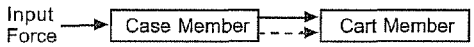

In a second group of exemplary embodiments of this aspect of the invention and as shown in FIGS. 7G to 7K, a multicolor writing tool may not include any separate actuator member and, therefore, may receive the input force through its cartridge member which may then transmit such force to one, two or more members of the tool. In FIG. 7G, the cartridge member receives the input force, while the cap member also directly receives such input force and is actuated thereby. In FIG. 7H, the cartridge member transmits the force to the cap member either directly or indirectly. In FIG. 7I, such a cartridge member transmits the force to the cap member by at least a partial intervention or participation of the actuator member. In FIG. 7J, the cartridge member may transmit the force to both of the cap and case members either directly or indirectly. In FIG. 7K, the cartridge member transmits the force to the case member which may then transmit at least a portion of such force to the cap member, either directly or indirectly and with or without altering the direction and/or amplitude of such force.

Figure 7L:
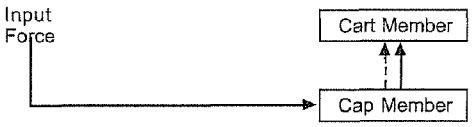
Figure 7Q:
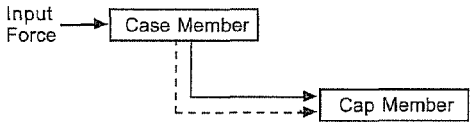
Figure 7M:
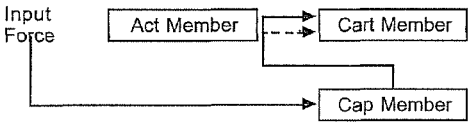
Figure 7R:
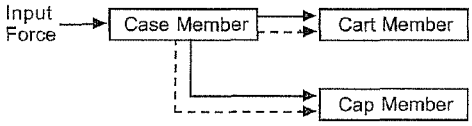
Figure 7N:
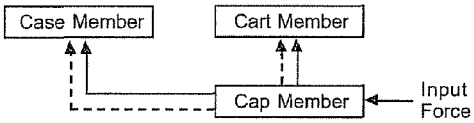

In a third group of exemplary embodiments of this aspect of the invention and as described in FIGS. 7L to 7O, a multicolor writing tool may not include any separate actuator member and, therefore, may receive the input force through its cap member which may then transmit such force to one, two or more members of such a tool. In FIG. 7L, the cap member transmits the input force to the cartridge member either directly or indirectly. In FIG. 7M, the cap member transmits such force to the cartridge member either directly or indirectly through at least a partial intervention or participation of the actuator member. In FIG. 7N, the cap member transmits the input force independently to both of the case and cartridge members either directly or indirectly. And in FIG. 7O, the cap member transmits such force to the case member which then transmits at least a portion of the force to the cartridge member either directly or indirectly.

Figure 7S:
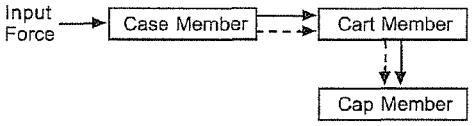
Figure 7O:
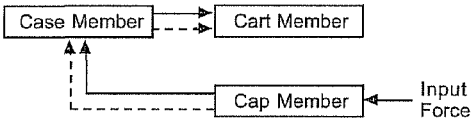
Figure 7T:
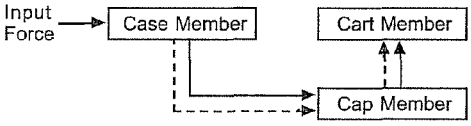

In the last group of exemplary embodiments of this aspect of the invention and as described in FIGS. 7P to 7T, a multicolor writing tool may not include any separate actuator member and, therefore, may receive the input force through its case member which may then transmit such force to one, two or more members of such a tool. In FIG. 7P, the case member transmits the input force to the cartridge member either directly or indirectly with or without altering the amplitude and/or direction of such input force. In FIG. 7Q, the case member instead transmits the input force to the cap member either directly or indirectly. In FIG. 7R, the case member transmits the input force independently to the cartridge and cap members either directly or indirectly. In FIG. 7S, the case member transmits the input force to the cartridge member which then transmits at least a portion of such input force to the cap member either directly or indirectly with or without altering the amplitude and/or direction of such input force. In FIG. 7T, the case member transmits such force to the cap member which then transmits at least a portion of such force to the cartridge member either directly or indirectly with or without altering the amplitude and/or direction of such input force.

Configurational and/or operational variations and/or modifications of the above embodiments of such multicolor writing tools and/or various members thereof depicted in FIGS. 7A through 7T also fall within the scope of this invention.

As described above, one, two or more members of the multicolor writing tool may be arranged to receive at least a portion of the input force, and to translate, rotate or otherwise move in response thereto, with or without transmitting at least a portion of the input force to one, two or more members either directly or indirectly, with or without altering the amplitude and/or direction of such force. When desirable, one or more of such members may be arranged to receive the input force independently (or redundantly) and/or in corporation therebetween.

As described above, the multicolor writing tool of this invention includes the case member, the cap member, the cartridge member, and the optional actuator member. Thus, various force receiving and force transmitting mechanisms or sequences may be provided through various permutation of the above three or four members. It is appreciated that the cap member has to move between its off- and on-states in order to respectively enclose and expose the tips of the cartridge members. Accordingly, such a cap member has to receive at least a portion of the input force directly or indirectly and has to be actuated directly by such force and/or through one or more of the other members. In contrary, the case member may not necessarily include any movable part and, accordingly, may or may not have to receive at least a portion of such force either directly or indirectly. When the case member includes at least one mobile part, then the case member need to receive at least a portion of such force as well. The cartridge member generally has to move each of its cartridges to expose its tip out of the interior in its use position. However, when the cartridges are arranged to be exposed by the mobile caps of the cap member, the cartridges may be designed stationary and may not have to receive such force. As described above, such a multicolor writing tool of this invention may optionally include the actuator member. In this case, at least a portion of the actuator member is preferably arranged to move as a response to the input force. However, such a tool may not include any actuator member, where at least one part of the actuator member may be incorporated into one or more of the other members of the tool. Further configurational and/or operational characteristics of force receiving and transmitting mechanisms and/or sequences of each member are provided in the co-pending Applications.

Various force reception and/or transmission mechanisms as exemplified in FIGS. 7A to 7T and their modifications which have been described hereinabove may be practiced in various embodiments. To this end, the case members, cap members, cartridge members, and optional actuator members of the multicolor writing tools and their parts may be arranged to have various shapes and/or sizes, to be fixedly or movably disposed based on various arrangements, to make various movements, to undergo various configurational changes or deformations, and so on. Following FIGS. 8A through 8P exemplify various modes of receiving the input force through case and/or actuator members, FIGS. 9A through 9H exemplify various cartridge members which actuate various cap members. FIGS. 10A through 10H exemplify various cap-cartridge assemblies, and FIGS. 11A to 11H exemplify various cap members for actuating various cartridge members.

Figure 8A:
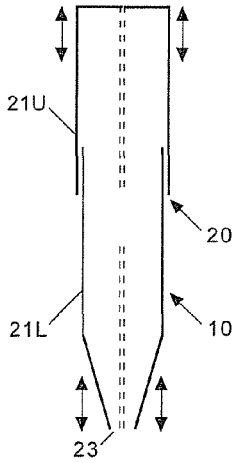
FIGS. 8A to 8P are longitudinal cross-sectional views of exemplary actuator members and their actuating mechanisms for receiving various input forces through different portions thereof which may be exposed through case members or which may be incorporated into the case members according to aspects of the present invention.
Figure 8C:
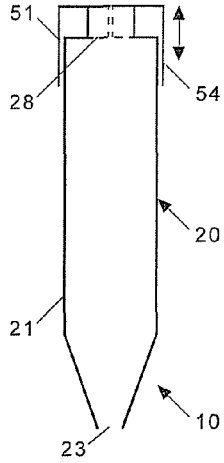
Figure 8E:
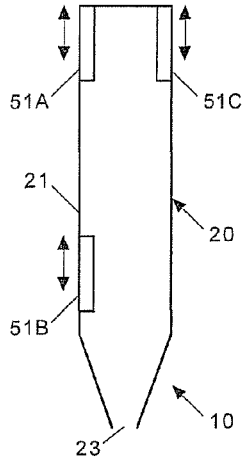

Accordingly and in another aspect of the present invention, various actuator members may be incorporated into and/or exposed through the case members in order to receive the input force and to transmit at least a portion of such force to other member(s) such as, e.g., the cap members, cartridge members, and the like. FIGS. 8A to 8P show longitudinal cross-sectional views of exemplary actuator members and their actuating mechanisms for receiving various input forces through different portions thereof which may be exposed through or incorporated into various case members according to the present invention. Upon receiving the input force, the actuator and/or case members are arranged to transmit at least a portion of such input force onto other members and/or their parts, e.g., in order to move the cap member from its off- to on-state and to also advance and expose the tip of the selected cartridge out of the interior through the opening or conduit. In all of the following embodiments, a case member defines at least one case and an opening is provided in a bottom end of such a case. It is to be understood that following exemplary embodiments of various force receiving and/or transmitting mechanisms are only intended to illustrate various examples of this aspect of this invention and not to limit the scope of this invention. Accordingly, the following embodiments may be applied to other case members having different shapes and/or sizes and to other multicolor writing tools capable of forming and closing various conduits instead of defining the openings.

Figure 8B:
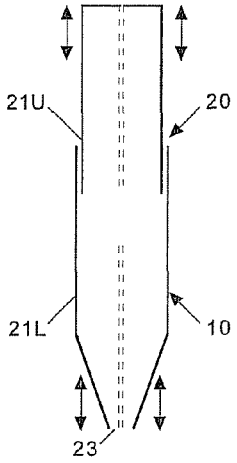

In one exemplary embodiment of this aspect of the invention and as shown in FIGS. 8A and 8B, a multicolor writing tool 10 has multiple cases such as an upper case 21U and a lower case 21L. At least one of such cases 21U, 21L is arranged to receive the input force and to vertically translate with respect to the other. In FIG. 8A, a bottom end of the upper case 21U is arranged to movably retain a top end of the lower case 21L, whereas an arrangement is reversed in FIG. 8B. In both examples, the cases 21U, 21L may form multiple bodies one of which may vertically translate to its use position upon receiving such force, while the rest of the bodies may stay in their rest position until they are selected one at a time. In all of such embodiments, such cases 21U, 21L are assigned and coupled to different cartridges so that vertical translation of one of such cases 21U, 21L or bodies thereof may actuate one cartridge from its rest to use position.

Figure 8D:
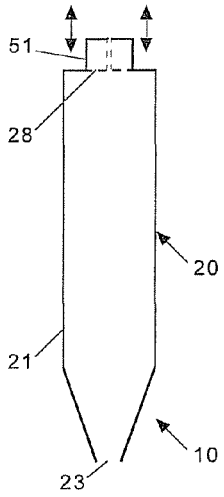

In another exemplary embodiment of this aspect of the invention and as shown in FIGS. 8C and 8D, a tool 10 includes a handle (or actuator) 51 and a case member 20 with a case 21. The handle 51 is movably inserted through a top end of the case 21 through a top aperture 28. In FIG. 8C, the handle 51 includes an exterior cover 54 enclosing the top end of the case 21, while the handle 51 does not have such a cover in FIG. 8D. In both examples, the handle 51 may have multiple bodies one of which may vertically translate to its use position upon receiving the force, while the rest of such bodies may stay in their rest position until they are selected one at a time. In all embodiments, such a handle or its bodies are assigned and coupled to multiple cartridges so that vertical translation of the handle or one of its bodies may actuate one cartridge from its rest to use position.

Figure 8F:
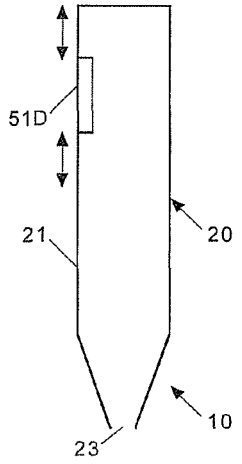

In another exemplary embodiment of this aspect of the invention and as shown in FIGS. 8E and 8F, a tool 10 has at least one handle (or actuator) 51 and a similar case member 20. The handle 51 is movably disposed on and/or exposed through various locations of the case 21 and arranged to move vertically between its rest and use positions. In FIG. 8E, such a tool 10 has two or more handles 51A, 51B, 51C each assigned and coupled to a different cartridge so that vertical translation of each handle 51 moves each cartridge between its use and rest positions. In contrary, the tool 10 of FIG. 8F has a single handle 51D assigned to multiple cartridges. For example, upward translation of the handle 51D may move one cartridge, while downward translation thereof may move another cartridge.

Figure 8G:
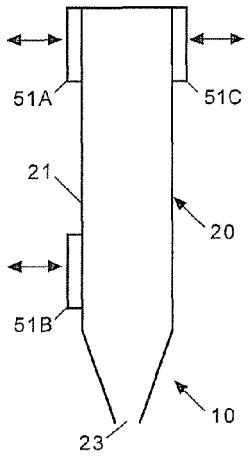
Figure 8I:
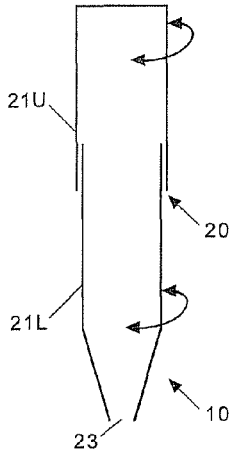
Figure 8K:
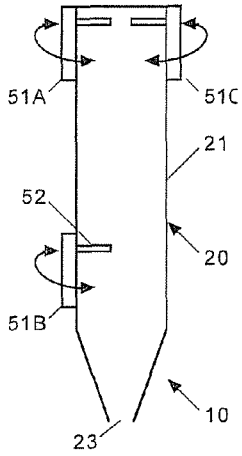
Figure 8H:
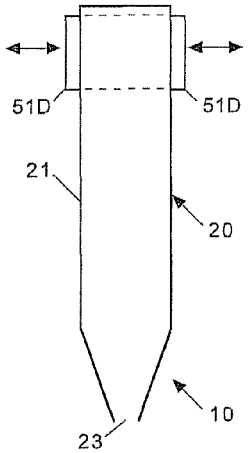

In another exemplary embodiment of this aspect of the invention and as shown in FIGS. 8G and 8H, a tool 10 has at least one handle (or actuator) 51 and a similar case member 20. The handle 51 is disposed or exposed similar to those of FIGS. 8E and 8F but arranged to move horizontally between its rest and use positions. In FIG. 8G, the tool 10 has two or more handles 51A, 51B, 51C each assigned and coupled to a different cartridge and horizontal translation of each handle 51 moves each cartridge between its use and rest positions. In contrary, the tool 10 of FIG. 8H has a single handle 51D which is assigned to multiple cartridges. For example, pressing the handle 51D in one direction moves one cartridge, while pressing the handle 51D in an opposite direction moves another cartridge.

Figure 8J:
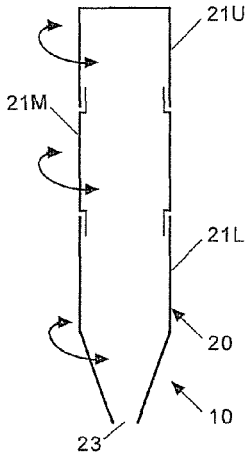

In another exemplary embodiment of this aspect of the invention and as shown in FIGS. 8I and 8J, a multicolor writing tool 10 has multiple cases at least one of which is arranged to receive the input force and to rotate or pivot with respect to the other. In FIG. 8I, such a case member 20 includes an upper case 21U and a lower case 21L, while the case member 20 includes an additional middle case 21M in FIG. 8J. In all of these examples, such cases are assigned and coupled to different cartridges such that rotation of one case actuates one cartridge from its rest to use position.

Figure 8L:
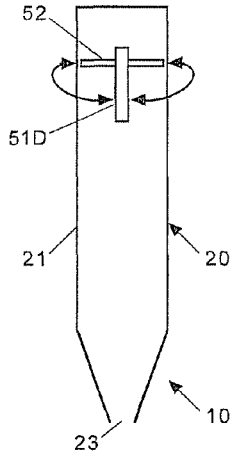

In another exemplary embodiment of this aspect of the invention and as shown in FIGS. 8K and 8L, a tool 10 has at least one handle (or actuator) 51 and a similar case member 20. The handle 51 is disposed or exposed similar to those of FIGS. 8G and 8H, but arranged to rotate angularly between its rest and use positions along a track 52. In FIG. 8K, such a tool 10 includes two or more handles 51A, 51B, 51C each assigned and coupled to a different cartridge so that rotation of each handle 51 moves each cartridge between its use and rest positions. In contrary, the tool 10 of FIG. 8L includes a single handle 51 assigned to multiple cartridges. For example, rotating the handle 51D in one direction moves one cartridge, while rotating such a handle 51D along an opposite direction moves another cartridge.

Figure 8M:
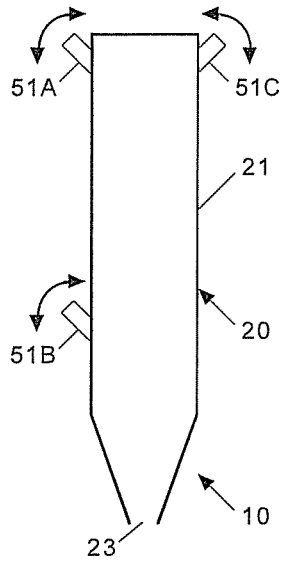
Figure 8O:
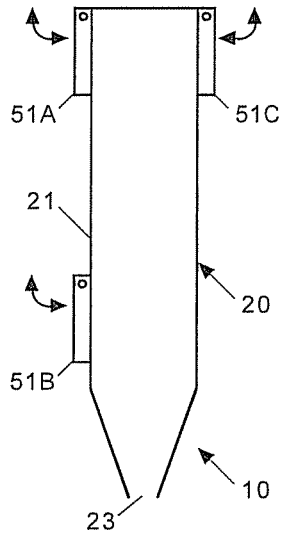
Figure 8N:
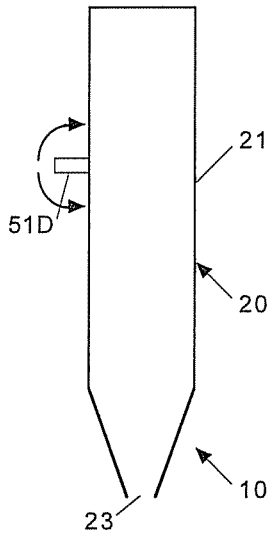
Figure 8P:
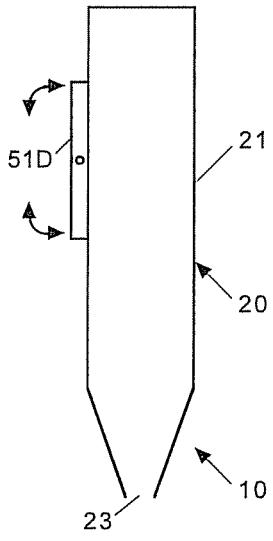

In another exemplary embodiment of this aspect of the invention and as shown in FIGS. 8M to 8P, a tool 10 has at least one handle (or actuator) 51 and a similar case member 20, where the handle 51 is similar to those of FIGS. 8G and 8H, but arranged to move angularly or pivot between its rest and use positions. In FIGS. 8M and 8O, such tools 10 include two or more handles 51A, 51B, 51C each of which is assigned and coupled to a different cartridge and angular movement (FIG. 8M) or pivoting or rotation (FIG. 8O) of such about rotation axes may move each cartridge between their use and rest positions. In contrary and in FIGS. 8N and 8P, each tool 10 includes a single handle 51D assigned and coupled to multiple cartridges so that upward angular movement the handle 51D of FIG. 8N moves one cartridge and downward angular movement moves another cartridge or that pressing an upper part of the handle 51D with respect to the rotation axes moves one cartridge and pressing a lower part of the handle 51D with respect thereto moves another cartridge.

Configurational and/or operational variations and/or modifications of the above embodiments of such multicolor writing tools and/or various members thereof depicted in FIGS. 8A through 8P also fall within the scope of this invention.

The above actuating mechanisms may be applied to other case members which include cases having different shapes and/or sizes, those having same, similar or different cross-sectional areas in a vertical direction, and so on. When the case member includes multiple cases, each of such cases may be arranged to have same, similar or different dimensions. In addition, one case may be arranged to enclose another case by overlapping at least a portion thereof. In the alternative, two cases may be arranged to abut each other at opposing ends and coupled to each other through a coupler which is generally disposed inside such cases.

In order to provide visual aid, each cases of the case member or each handle of the actuator member may be color-coded. Alternatively, such cases or handles may be arranged to have different shapes, to be disposed in different elevations, and the like.

Instead of employing multiple cases and/or actuators, a single case and/or actuator may also be arranged to select each of multiple cartridges. As described in FIGS. 8F, 8H, 8L, 8N, and 8P, one handle may be arranged to translate, rotate or otherwise move in different directions so as to actuate (or select) different cartridges one at a time. Alternatively, a single case or actuator may be arranged to receive the same or different input forces successively while actuating each of multiple cartridges in an alternating mode. Further details of such force receiving and transmitting mechanisms are also provided in the co-pending Applications.

In another aspect of the present invention, the cartridge members may be arranged to actuate the cap members. Such cartridge members may move from their rest to use position by receiving the input force directly from the user or indirectly therefrom through the case and/or actuator members, and may actuate the cap members from their off- to on-state in order to expose tips of the cartridges one at a time through openings of the case members or through conduits formed by the cap members. It is to be understood that any cap members and caps thereof described hereinabove and hereinafter may be applied or modified to this end, as far as the cartridge and/or cap members may be arranged to operatively couple with each other and the cartridge members may be able to manipulate operations of such cap members between off- and on-states thereof. It is also appreciated that such cartridge members may be arranged to manipulate the cap members directly or indirectly through other members of the tool such as, e.g., the case members, actuator members, and the like. FIGS. 9A to 9H describe longitudinal cross-sectional views of exemplary cartridge members directly or indirectly actuating cap members and/or caps thereof between their off- and on-states according to the present invention. It is to be understood that the following exemplary embodiments of various members are only intended to illustrate various examples of this aspect of the present invention, and not to limit the scope of this invention.

Figure 9A:
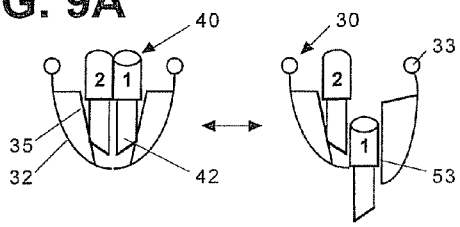
FIGS. 9A to 9H are longitudinal cross-sectional views of exemplary cartridge members directly or indirectly actuating cap members and/or caps thereof between their off- and on-states according to aspects of the present invention.
Figure 9B:
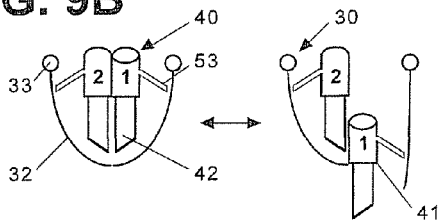
Figure 9C:
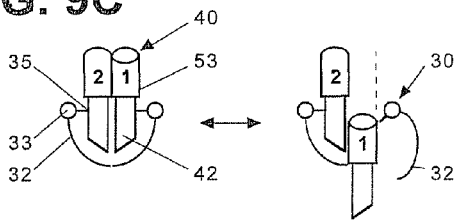

In one exemplary embodiment of this aspect of the invention and as shown in FIGS. 9A to 9C, a tool 10 has a cap member 30 and a cartridge member 40, where the latter includes two cartridges and the former includes two caps 32 in their off-state each disposed below the tips 42 of such cartridges in their rest position. In FIG. 9A, the caps 32 define guides in their inner surfaces shaped and sized to be abutted by the tips 42 and such caps 32 are forced to open toward their on-state when the tips 42 advance downwardly. In FIG. 9B, each cartridge includes an actuator 53 extending outwardly from a bottom end of its body 41. Such actuators 53 are shaped and sized so as to push and open the caps 32 toward their on-state when the cartridges advance downwardly. In FIG. 9C, the caps 32 include guides 35 and are arranged to rotate or pivot about supports 33. Each guide 35 is shaped and sized so as to be actuated by the body 41 of the cartridge. Accordingly, the advancing cartridge may push the guide 35 downwardly to its off-state which in turn rotates and opens the corresponding cap 32.

Figure 9D:
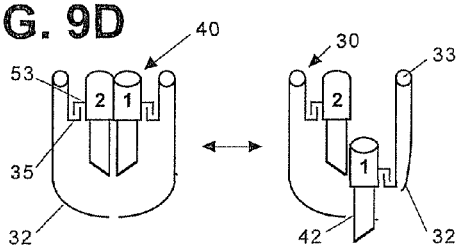
Figure 9E:
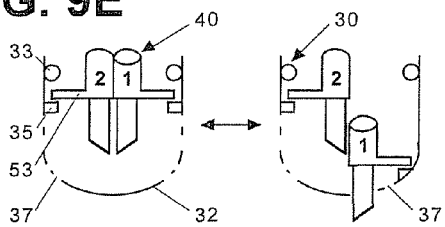

In another exemplary embodiment of this aspect of the invention and as described in FIGS. 9D and 9E, a tool 10 includes similar cap and cartridge members 30, 40. In FIG. 9D, each cap 32 extends upwardly, turns around a support 33, and terminates with a guide 35, similar to those of FIGS. 4A and 4B. The cartridge includes on its body an actuator 53 shaped and sized to catch and to pull the guide 35. Accordingly, the cap 32 may move toward its on-state while the cartridge advances downwardly and pulls the guide 35 therewith. In FIG. 9E, the cap 32 is constructed similar to that of FIG. 4E, and a pair of guides 35 are provided to opposing sides thereof and also above the holes 37. The cartridge includes an actuator 53 shaped and sized to abut the guide 35 so as to push and translate the cap 32 and to align one of the holes 37 with a path of the selected cartridge.

Figure 9F:
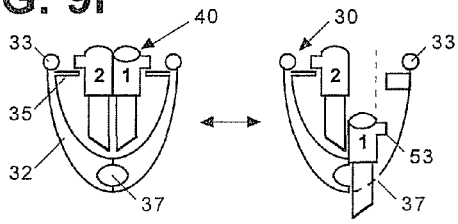
Figure 9G:
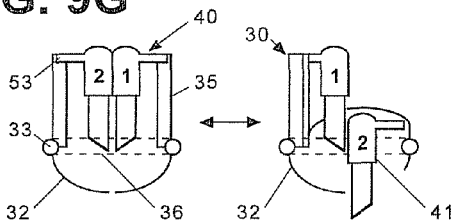
Figure 9H:
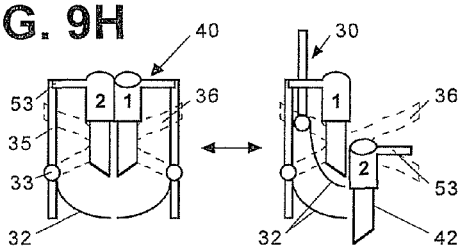

In another exemplary embodiment of this aspect of the invention and as described in FIGS. 9F to 9H, a tool 10 includes similar cap and cartridge members 30, 40. In FIG. 9F, each cap 32 defines a semi-circular aperture so as to form a circular hole 37 when two caps 32 are disposed side by side in their off-state. The caps 32 also include guides 35 in their top ends and are arranged to rotate about supports 33. Each cartridge includes an actuator 53 shaped and sized so as to abut the guides 35 as the cartridge advances downwardly. At least one of the guide 35 and actuator 53 is also disposed at an acute angle such that the cap 32 may pivot along sides (i.e., into and out of the paper) as abutted by the actuators 53. In FIG. 9G, the cap member 30 defines a circular track 36 along which each cap 32 is arranged to rotate. The cap member 30 also include guides 35 vertically extending from the caps 32. The cartridges have actuators 53 shaped and sized to horizontally and angularly rotate the guides 35 so that the bottom end of the selected cap 32 may be pulled angularly and away from the opening when the selected cartridge advances downwardly while rotating by a preset angle. The actuating mechanism of FIG. 9H is generally similar to that of FIG. 9G, except that a pair of tracks 36 are formed for each cam 32 and such tracks 36 are disposed at a preset angle. Accordingly, the caps 32 may be pulled angularly and upwardly as well as away from the opening when the selected cartridge moves downwardly while rotating.

Instead of employing multiple caps and/or actuators, a single cap and/or actuator may also be arranged to actuate each of multiple cartridges. As described in the co-pending applications, a single cap may move between its off- and on-states in order to obstruct and clear a similar or identical area of the opening or to form a similar or identical conduit, through each of which any cartridges expose their tips one at a time. Alternatively, a single cap or actuator may be arranged to receive the same or different input forces successively while actuating each of multiple cartridges in an alternating mode. In another alternative, a single cap may also be arranged to obstruct and clear different areas of the opening or to form different conduits such that each cartridge may expose its tip through a different area of the opening or different conduit. Further details of such cartridge and cap members are also provided in the co-pending applications.

In another aspect of the present invention, the cartridge members may be arranged to include at least a portion of the cap and/or actuator members, where the cartridge members may actuate the cap members. The cartridge members may move from their rest to use position by receiving the input force directly from the user or indirectly from the user through the case and/or actuator members, and may actuate the cap members from their off- to on-state to expose tips of the cartridges one at a time through openings of the case members or conduits formed by the cap members. It is appreciated that such cartridge and cap (and/or actuator) members are characterized by their physical integrity as an assembly as will be described below. In this context, such assemblies may be regarded as a special case of the cap and cartridge members described herein. Any cap members or their caps described hereinabove and hereinafter may be applied or modified to this end, as far as the cap and/or cartridge members may operatively couple with each other and the cartridge members may actuate operations of the cap members between their off- and on-state. It is appreciated that the cartridge members may be arranged to manipulate the cap members directly or indirectly through other members such as, e.g., the case members, actuator members, and the like. FIGS. 10A to 10H are longitudinal cross-sectional views of exemplary cartridge members fixedly or movably incorporating cap members thereinto and actuating such cap members and/or caps thereof between their off- and on-states according to the present invention.

Figure 10A:
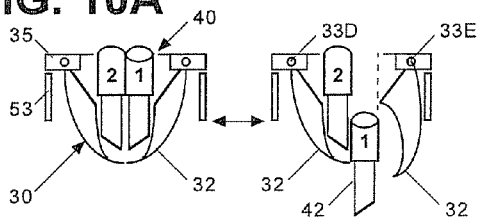
FIGS. 10A to 10H are also longitudinal cross-sectional views of exemplary cartridge members fixedly or movably incorporating cap members thereinto and actuating such cap members and/or caps thereof between their off- and on-states according to the present invention.

In one exemplary embodiment of this aspect of the invention and as described in FIGS. 10A to 100, a multicolor writing tool 10 includes a cap member 30 and a cartridge member 40. It is noted that the embodiments of FIGS. 10A to 10C are respectively similar to those of FIGS. 9A to 9C, except that the cap members 30 of FIGS. 10A to 10C may include other parts such as extra supports or actuators so as to fixedly or movably couple various parts of the cap and/or actuator members to the cartridge members 40. Further configurational and/or operational characteristics of such tools 10 are similar to those of FIGS. 9A to 9C as well as those FIGS. 10A to 10C of the co-pending Applications.

Figure 10E:
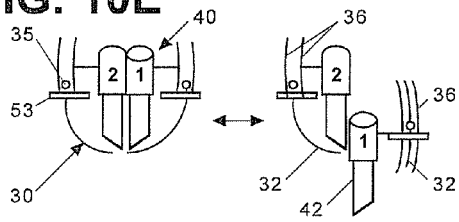
Figure 10B:
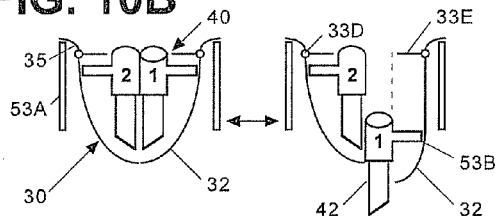
Figure 10F:
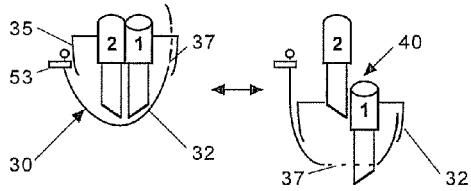
Figure 10C:
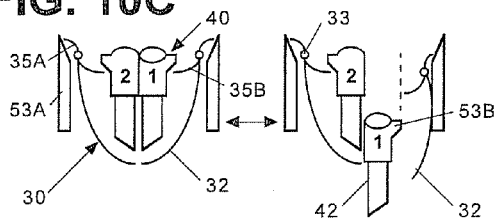
Figure 10G:
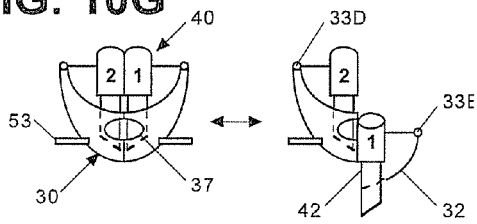
Figure 10D:
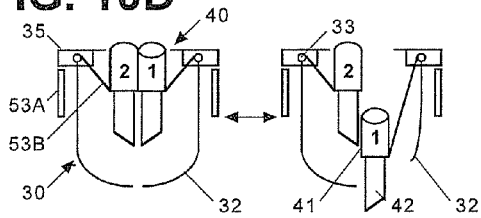

In another exemplary embodiment of this aspect of the invention and as described in FIGS. 10D to 10F, a tool 10 has similar cap and cartridge members 30, 40. The embodiment of FIG. 10D is similar to that of FIG. 9D, except that top ends of such caps 32 are directly coupled to or connected to bottom ends of the cartridges so that movement of the cartridges directly actuates the caps 32 one at a time between their off- and on-states. In FIG. 10E, the cap member 30 includes a pair of tracks 36 which are arranged to movably retain the caps 32 while changing the configuration thereof. Accordingly, as the selected cartridge advances downwardly and pushes the actuator 53 therewith, such tracks 36 moves the cap 32 away from the tip 42 of the cartridge. In FIG. 10F, the cap member 30 has a single cap 32 defining a single hole 37 therealong, while the cartridge member 40 has the guide 35 extending outwardly and actuated by either cartridge. Accordingly, downward advancement of each cartridge may cause configurational change of the cap 32 while aligning the hole 37 with the opening. Further configurational and/or operational characteristics of such tools 10 are similar to those of FIGS. 9D and 9E as well as those FIGS. 10D, 10F, and 10H of the co-pending Applications.

Figure 10H:
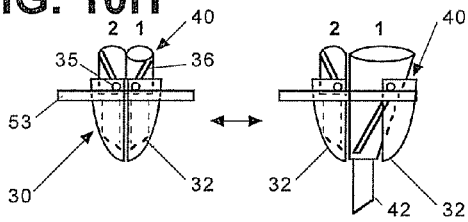

In another exemplary embodiment of this aspect of the invention and as described in FIG. 10G, the cap and cartridge members 30, 40 are provided similar to that of FIG. 9F, except the cap member 30 includes extra actuators 53. In yet another exemplary embodiment of this aspect of the invention and as described in FIG. 10H, the cartridges define the tracks 36 thereon at a preset angle into which the caps 32 are movably disposed. When the selected cartridge advances downwardly, the cap 32 may translate horizontally and outwardly, thereby clearing the opening or forming the conduit. Further configurational and/or operational characteristics of such tools 10 of FIGS. 10G and 10H are similar to those of FIGS. 9F to 9H as well as those FIGS. 10E and 10G of the co-pending Applications.

Configurational and/or operational variations and/or modifications of the above embodiments of such multicolor writing tools and/or various members thereof shown in FIGS. 10A through 10H also fall within the scope of this invention.

As shown in the figures, such cartridge-cap (and/or actuator) assemblies include at least one actuator which are provided external to the caps. The actuators may be utilized to be manipulated by other members or parts thereof such as, e.g., the case member or their cases, other actuators such as the handle, and so on. This embodiment is useful when such other members and/or their parts are arranged to actuate the cap members between their off- and on-states.

Instead of employing multiple caps and/or actuators, a single cap and/or actuator may also be arranged to actuate each of multiple cartridges, similar to those of FIGS. 9A to 9H. As described in the co-pending Applications, a single cap may move between its off- and on-states so as to obstruct and clear a similar or identical area of the opening or to form and close a similar or identical conduit through each of which the cartridge exposes its tips one at a time. In the alternative, a single cap or actuator may be arranged to receive the same or different input forces successively while actuating each of multiple cartridges in an alternating mode. In another alternative, a single cap may also be arranged to obstruct and clear different areas of the opening or to form different conduits so that each cartridge may expose its tip through a different area of the opening or different conduit. Further details of such cartridge and cap members are also provided in the co-pending Applications.

In another aspect of the present invention, the cap members may also be arranged to actuate the cartridge members. Such cap members may move from their off- to on-state by receiving the input force directly from the user or indirectly from the user through the case and/or actuator members, and may actuate the cartridge members from their rest to use position to expose tips of the cartridges one at a time through openings of the case members or through conduits formed by the cap members. It is to be understood that any cap members and caps thereof described hereinabove and hereinafter may be applied or modified to this end, as long as such cap and/or cartridge members may be arranged to operatively couple with each other and the cap members may be able to manipulate operations of the cartridge members between rest and use positions thereof. It is appreciated that such cap members may be arranged to manipulate the cartridge members directly or indirectly through other members of the tool such as, e.g., the case members, actuator members, and the like.

FIGS. 11A to 11H represent longitudinal cross-sectional views of exemplary cap members directly or indirectly actuating cartridge members between their rest- and use-positions according to the present invention. It is appreciated that the following exemplary embodiments of various members are only intended to illustrate various examples of this aspect of the present invention, and not to limit the scope of this invention.

Figure 11A:
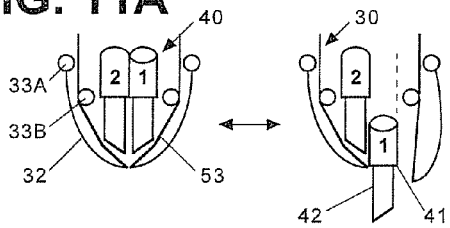
FIGS. 11A to 11H are longitudinal cross-sectional views of exemplary cap members directly or indirectly actuating cartridge members between their rest- and use-positions according to aspects of the present invention.
Figure 11B:
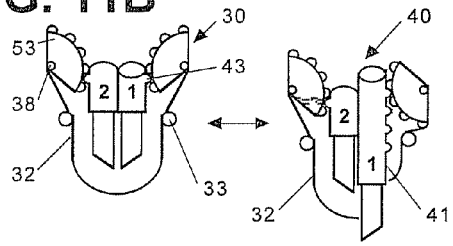
Figure 11C:
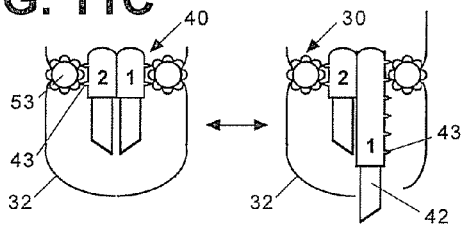

In one exemplary embodiment of this aspect of the invention and as described in FIGS. 11A to 11C, a tool 10 include a cap member 30 and a cartridge member 40 operatively coupled to each other by various actuators 53. In FIG. 11A, such members 30, 40 are directly connected to each other by the actuator 53. When one of the caps 32 of the cap member 30 is selected and pulled open to its on-state, such an actuator 53 is stretched, and such stretching is converted to downward force which advances the selected cartridge downwardly to expose its tip 42 through the opening or conduit. In FIG. 11B, the cap member 30 includes cam-shaped actuators 53 forming multiple teeth thereon, while the cartridge includes multiple guides 43 which are shaped, sized, and spaced to be actuated by the actuators 53. As the actuator 53 is rotated about the rotation axis 38, the cap 32 is pulled upwardly, while the teeth of the actuator 53 may push the selected cartridge downwardly. In FIG. 11C, the cap member 30 includes circular actuators 53 having multiple teeth therearound. The caps 32 of such a member 30 are movably disposed around the actuators 53 and arranged to move as the actuators 53 rotate. Thus, as the selected actuator 53 rotates, the cap 32 is pulled upwardly to its on-state, while the teeth of the actuator 53 pushes the selected cartridge downwardly toward its use position. Other configurational and/or operational characteristics of such tools 10 of FIGS. 11A to 11C are similar to those of FIGS. 11A to 11C of the co-pending Applications.

Figure 11D:
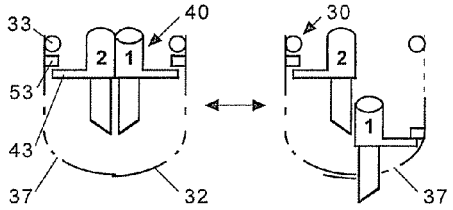
Figure 11E:
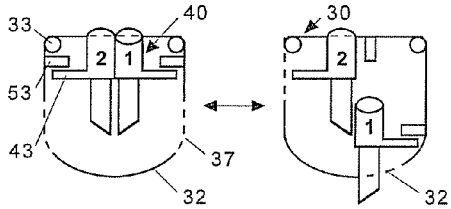
Figure 11F:
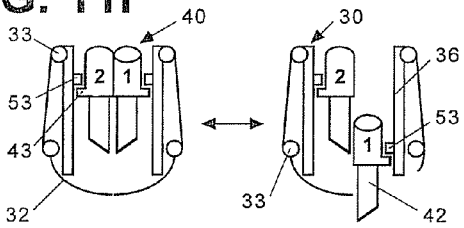

In another exemplary embodiment of this aspect of the invention and as described in FIGS. 11D to 11F, a tool 10 includes a cap member 30 capable of actuating a cartridge member 40. In FIG. 11A, the cartridges have guides 43, while the cap member 30 has actuators 53 disposed along the caps 32 and shaped and sized to abut and push the guides 43. Thus, when the selected cap 32 moves while aligning one of such holes 37 with the opening, the actuator 53 may also push the selected cartridge downwardly. The embodiment of FIG. 11E is generally similar to that of FIG. 11D, except that the cap member 30 includes a single 32 encircling the caps 32 therein and defining two holes 37 therealong. Other characteristics of this embodiment are similar to those of FIG. 11D. In FIG. 11E, the cap member 30 includes the caps 32 wrapped around the supports 33 and the actuators 53 which are coupled to the top ends of such caps 32. The cartridges includes the guides 43 shaped and sized to be actuated by such actuators 53. Thus, when the selected actuator 53 moves downwardly, the cap 32 is pulled upwardly to clear the opening and the actuator 53 also advances the selected cartridge downwardly. Other configurational and/or operational characteristics of the tools 10 of FIGS. 11D to 11F are similar to those of FIGS. 9D and 9E and also to those of FIGS. 11D to 11F of the co-pending Applications.

Figure 11G:
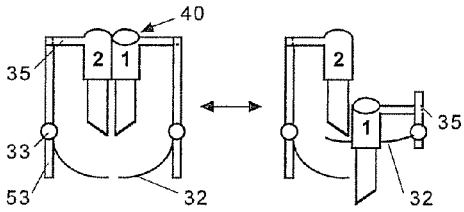
Figure 11H:
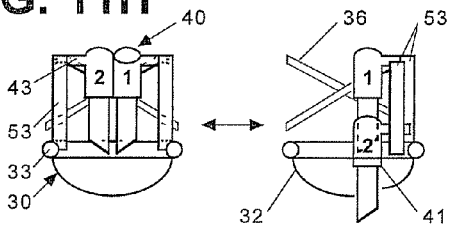

In another exemplary embodiment of this aspect of the invention and as described in FIGS. 11G and 11H, a tool 10 includes a cap member 30 and a cartridge member 40, where the former may rotate to actuate the latter. In FIG. 11G, the cap member 30 includes 53 actuators 53 coupled to the top ends of the caps 32, while the cartridges include the guides 35 shaped and sized to be abutted and moved by the actuators 53. Accordingly, when the selected actuator 53 receives the input force and rotates along a vertical direction into and out of the paper about the support 33, the cap 32 is displaced along the same direction, while the selected cartridge advances downwardly. The embodiment of FIG. 11H is similar to that of FIG. 11G, except that the actuator 53 rotates horizontally and angularly and that the selected cartridge may advance downwardly while rotating and being guided by the track 36. Further configurational and/or operational characteristics of such tools 10 of FIGS. 11G and 11H are similar to those of FIGS. 9G and 9H and also to those of FIGS. 11G and 11H of the co-pending Applications.

Instead of using multiple caps and/or actuators as exemplified in FIGS. 11A to 11H, a single cap and/or actuator may be arranged to actuate each of multiple cartridges, similar to those of FIGS. 9A to 9H. As stated in the co-pending Applications, a single cap may move between its off- and on-states in order to obstruct and clear a similar or identical area of the opening or to form and close a similar or identical conduit through each of which the cartridge exposes its tips one at a time. In the alternative, a single cap or actuator may be arranged to receive the same or different input forces successively while actuating each of multiple cartridges in an alternating mode. In another alternative, a single cap may also be arranged to obstruct and clear different areas of the opening or to form different conduits so that each cartridge may expose its tip through a different area of the opening or different conduit. Further details of such cartridge and cap members are also provided in the co-pending Applications.

Configurational and/or operational variations and/or modifications of the above embodiments of the multicolor writing tools and/or various members thereof described in FIGS. 1A through 11H also fall within the scope of this invention.

The multicolor writing tool of this invention may include at least one recoil unit arranged to store at least a portion of mechanical energy such as the input force supplied by the user and to release the portion of energy thereafter. Any conventional elastic articles may be used to form such recoil units. Such a tool may also include at least one release unit which may operatively couple with the recoil unit and manipulate the recoil unit to release the stored energy in a preset temporal pattern, e.g., releasing the stored energy instantaneously with or without any limit in its peak force, releasing such energy at a preset rate with or without such a limit, and the like. The user may supply a command signal to the release unit which may then manipulate the recoil unit to release the stored energy, which may cause one of the foregoing movements of the case, cap, cartridge, and/or actuator members from one to the other of their off- and on-states and/or from one to the other of their rest and use positions. Further details of such recoil units, their disposition, and operative coupling with other members are provided in the co-pending Applications, specifically in FIGS. 12A to 12H and accompanying text thereof.

It is appreciated that some writing tools of the present invention may not include a cap member. For example, a portion of the case member may be arranged to move to form and close an opening in order to allow the tip of the cartridge member to be exposed out of and/or enclosed inside the case of the case member. In this embodiment, such a portion of the case member may be viewed as the cap member as well.

It is also appreciated that the above caps of various cap members may be generally arranged to provide fluid communication between the interior which is formed in the case member and exterior thereof. Some tips of the cartridge members, however, may be shaped and/or sized in order to match the opening and, therefore, substantially block such an opening in the use positions of the tips and/or in the on-states of the caps. Although such tips may completely block the openings, they may usually allow such fluid communication between the inner space and exterior while they move from their rest positions to their use positions. The same may also apply to those caps which are arranged to define the conduits in their on-states. In this context, the caps of the cap members and tips of the cartridge members of the present invention are to be deemed to provide such fluid communication between the inner space and exterior in the on-states of the caps and in the use positions of the cartridge member, regardless of whether the tips may block the opening of the case member and/or conduits of the cap member.

First, various caps of the present invention which may be arranged to move between their off- and on-states may be replaced by deformable caps which may deform between their unstressed and stressed positions. For example, such caps may be arranged to deform in response to the input force and/or other members of the writing tools which may transmit the input force or its portion to the caps. Therefore, the deformable caps may be arranged to have shapes and/or sizes in their unstressed (or stressed) positions which may generally correspond to shapes and/or sizes of various movable caps of this invention in their off-states, and to have shapes and/or sizes in their stressed (or unstressed) state which may correspond to shapes and/or sizes of various movable caps of this invention in their on-states. Such deformable configurations may be incorporated into all of the above caps of the first class and/or the foregoing caps of the first class may also be modified to incorporate the deformable configurations.

As briefly described hereinabove, various caps of the present invention may also be arranged to expose at least portions thereof so that such an exposed portion may define a part of an exterior of the writing tool. Contrary to many caps described hereinabove, the exposed caps of this embodiment may be arranged to form openings by moving or deforming to their on-states, and to destroy or close the openings by moving or deforming to their off-states. Accordingly, such openings may correspond to conduits in such an embodiment. In general, all of the above features described in conjunction with the caps of the first class may be applied to such exposed caps of the second class.

Various caps of the writing tool of this invention may be arranged to move in various directions along various paths. As exemplified above, such members, units, and/or their parts may be arranged to move along directions and/or paths similar to those of the input force in response thereto directly or, alternatively, through the transmission of such force through other members, units, and/or their parts. In the alternative, such members, units, and/or parts thereof may be arranged to move along directions and/or paths which may be different from those of the input force. In such an embodiment, the writing tool is provided with the actuator member which may include at least one support and/or guide about which the cap and/or actuator may be disposed at different angles in order to change the direction of the transmission of such force. In the alternative, such an actuator member may include one or more gears, gear assemblies, universal joints, and/or other conventional force transmission and conversion devices which may change one or more of the directions of such force transmission, speeds thereof, and/or modes thereof. Accordingly, such an actuator may be arranged to convert the translating input forces into the rotating and/or pivoting movements of the case, cap, and/or cartridge members or vice versa. In this context, all of the cap members described herein which translate between their off- and on-states may be modified to rotate or pivot about the rotation points or axes as exemplified in FIG. 9B.

Regardless of the exact modes of movements between their off- and on-states such as, e.g., translation, rotation, pivoting, deformation, and so on, various caps of the writing tool of this invention may be arranged to move with or without maintaining their shapes in their off-states. In this embodiment, such caps may be arranged to change their configurations while moving from at least one to the other of their off- to on-states through various provisions. In one example, the caps may change their shapes and/or sizes while being guided by various guides and/or supports as described above, where such guides and/or supports may be arranged to movably or fixedly fold, roll, bend, stack, deform, and/or otherwise change configurations of at least portions of such caps during movements thereof. In another example, such caps may be arranged to fold, roll, bend, stack, deform, and/or otherwise change configurations of at least portions thereof while at least partially conforming to portions of the case and/or cartridge members such as, e.g., along inner walls of various cases of the case member, outer surfaces of the body of the cartridge member, and the like.

As described above, such cap members and/or caps thereof may be incorporated into various members, units, and/or their parts of the writing tool, and at least portions thereof may move between their off- and on-states. When desirable, such cap members and/or caps thereof may be designed to be disposable and/or replaceable so that the user may exchange the used cap members and/or caps with the new ones. To this end, the cap members and/or their caps may be arranged to be releasably or detachably coupled to such members, units, and/or parts of the writing tool so as to allow the user to readily remove and install such cap members and/or caps. Alternatively, such cap members and/or caps may instead be incorporated into the disposable or replaceable case and/or cartridge members.

It is to be understood that various members and/or their units and parts of the multicolor writing tool of this invention may be arranged to serve as other members and/or their units and parts as long as such may perform multiple functions. In one exemplary embodiment, various members and/or their units and parts may be arranged to serve as the cap and/or as its portion. Examples of such member and/or unit and part thereof may include, but not be limited to, various absorber units, actuators, recoil units, and so on. In another exemplary embodiment, various members and/or their units and parts may be arranged to serve as the actuator member and/or as its portion. Examples of such member and/or unit and part thereof may include, but not be limited to, various frames, supports, guides, and/or tracks of the cap members, various parts of the bodies of the cartridge members, various cases of the case members, and so on. In another exemplary embodiment, various members and/or their units and parts may be arranged to serve as the cartridge member and/or as its portion. Examples of such member and/or their unit and part may include, but not be limited to, various actuators, supports, guides, and/or tracks. In another exemplary embodiment, various members and/or their units and parts may serve as the case member and/or its case, where examples of such member and/or unit and part thereof may include, but not limited to, various frames, caps, supports, guides, and/or tracks of the cap members, various actuators, and the like. Accordingly, a specific part of the tool may be classified to belong to more than one member and, more importantly, such classification may not generally matter as long as such a part may perform its intended function.

Unless otherwise specified, various features of one embodiment of one aspect of the present invention may apply interchangeably to other embodiments of the same aspect of this invention and/or embodiments of one or more of other aspects of this invention. Therefore, any cap members of FIGS. 2A to 2N and FIGS. 3A to 3P may be used in conjunction with any case members of FIGS. 8A to 8P. In addition, any of the foregoing actuating mechanisms may also be incorporated into any combination of the case, cap, cartridge, and actuator members.

It is also appreciated that any aspects, embodiments, and/or features described in conjunction with various members and/or parts designed for the writing tool including a single cartridge member of the above application may be similarly applied to various members and/or parts of the writing tools of this invention which are designed to include multiple cartridge members.

Further details of configurational and/or operational variations and/or modifications of such a multicolor writing tool is provided in the co-pending Applications. It is to be understood, however, that any feature described in the co-pending Applications may be directly incorporated to this invention for obstructing and clearing the same or similar area of the opening or for forming and closing the same or similar conduit. In addition, any feature of the co-pending Applications may be similarly modified so as to obstruct and clear different areas of the opening or to form and close different conduits.

It is noted that various members or units of the multicolor writing tools of this invention may be incorporated into various conventional pens to form novel multicolor writing tools which also fall within the scope of this invention, where selected examples of such conventional pens may include, but not be limited to those disclosed in U.S. Pat. Nos. 6,830,402 B2 (to Sunatori), 8,773,185 B1 (to Hsieh), 6,752,557 B1 (to Hsieh), 6,623,136 B1 (to Kuo), 6,609,846 B1 (to Lai at al.), 6,379,068 B1 (to W-P Yu), 6,305,865 B1 (to Yoshii et al.), 6,273,627 B1 (to Mittersinker et al.), 6,213,661 B1 (to Coon), 6,155,733 (to Holbrook et al.), 6,092,951 (to Greene et al.), 5,997,204 (to Ducrocq), 5,984,559 (to Shiobara et al.), 5,967,684 (to Huang et al.), 5,913,629 (to Hazzard), 5,888,007 (to Nicoll et al.), 5,673,996 (to Ducker), 5,564,849 (to Greer, Jr.), 5,518,330 (to Gervais), 5,221,151 (to Kuo), 5,203,638 (to Redmond, Jr.), 5,174,814 (to Burwell), 5,206,190 (to Longarzo), 4,969,764 (to Gregory), 4,759,650 (to Granoff), 4,711,592 (to Gregory), 4,595,307 (to Heyden), 4,560,298 (to Oki et al.), 4,540,300 (to Midorikawa), 4,378,171 (to Schmidt), 4,343,559 (to Silver), 4,272,206 (to Treen), 4,269,525 (to Melikian), 4,227,823 (to Kitzerow), 4,115,015 (to Torii), 3,944,371 (to Schenk), U.S. Pat. Appl. Pub. No. US 2002/0192007 A1 (to Lee), and the like, all of which are to be incorporated herein by reference.

It is noted that various members or units of the multicolor writing tools of this invention may be also incorporated into various conventional multicolor pens to form novel multicolor writing tools which also fall within the scope of this invention, where selected examples of such conventional pens may include, but not be limited to those also disclosed in U.S. Pat. Nos. 5,844,577, 5,841,455, 5,812,165, 5,767,828, 5,760,761, 5,751,268, 5,750,594, 5,739,801, 5,659,345, 5,602,574, 5,583,545, 5,518,534, 5,440,327, 5,368,405, 5,354,140, 5,306,092, 5,293,184, 5,091,005, 5,039,232, 4,972,947, 4,948,285, 4,944,624, 4,872,027, 4,702,633, 4,692,046, 4,673,954, 4,614,952, 4,545,819, 4,527,176, 4,517,576, 4,504,838, 4,405,931, 4,359,291, 4,274,102, 4,236,418, 4,080,077, 4,022,535, 3,989,389, 3,917,416, 3,910,705, 3,887,287, 3,856,420, 3,700,340, 3,586,453, 3,586,451, 3,572,955, 3,518,017, 3,292,594, 3,225,747, 3,130,712, 3,025,833, 2,837,057, 2,790,422, 2,781,741, 2,690,738, 2,676,570, 2,608,953, 2,494,202, and the like, all of which are to be incorporated herein by reference. As manifest in some of these conventional pens, the multicolor writing tools of this invention may also be employed as pens for various writing or printing devices.

It is to be understood that, while various aspects and embodiments of the present invention have been described in conjunction with the detailed description thereof, the foregoing description is intended to illustrate and not to limit the scope of the invention, which is defined by the scope of the appended claims. Other embodiments, aspects, advantages, and modifications are within the scope of the following claims.

What is claimed is:

1. A method of inserting a plurality of cartridges into a writing tool, wherein said writing tool includes a case member defining an interior therein, wherein each of said cartridges contains therein a volatile marking substance with a preset color, includes in one end thereof a tip through which said marking substance is applied onto an article, and is shaped and sized to be retained into said interior, wherein said color is characterized by a color hue, a color value, and a color chroma, and wherein said writing tool includes a cap member and an actuator member which are capable of enclosing said tips of all of said cartridges in said interior in order to prevent drying of said tips when said tool is not in use and then capable of exposing said tip of each of said cartridges out of said interior one at a time while enclosing said tips of the rest of said cartridges in said interior in order to prevent drying of said tips of said rest of said cartridges when said tool is in use, said method comprising the steps of:

forming a portion of said tool by assembling said case, cap, and actuator members;

disposing a first cartridge of said cartridges in said interior while allowing said first cartridge to operatively couple with at least one of said case member, cap member, and actuator member for said exposing and enclosings; and disposing a second cartridge of said cartridges in said interior while allowing said second cartridge to operatively couple with at least one of said case member, cap member, and actuator member for said enclosings and exposing.

2. The method of claim 1, further comprising the step of:

manipulating said disposings such that said hue, value, and chroma of said second cartridge are different respectively from those of said first cartridge.

3. The method of claim 1, further comprising the step of:

manipulating said disposings such that at least one of said hue, value, and chroma of said second cartridge are respectively similar to those of said first cartridge.

4. The method of claim 1, further comprising the step of:

manipulating said disposings such that at least one of said hue, value, and chroma of said second cartridge are respectively identical to those of said first cartridge.

5. The method of claim 1, further comprising the steps of:

enclosing said tips of said first and second cartridges to prevent said drying before said disposings;

exposing said tips of said first and second cartridges immediately before said disposings; and performing said disposings.

6. The method of claim 1, further comprising the steps of:

providing said first and second cartridges as separate articles; and performing said disposings one after another.

7. The method of claim 1, further comprising the steps of:

coupling said first and second cartridges before said disposings; and performing said disposings while maintaining at least a portion of coupling.

8. The method of claim 1, further comprising the steps of:
color-coding at least a portion of said case member; and
performing said disposings while matching said colors of said cartridges with said color-coding.

9. The method of claim 1, further comprising the steps of:
color-coding at least a portion of said actuator member; and
performing said disposings while matching said colors of said cartridges with said color-coding.

10. The method of claim 1, further comprising the step of:
configuring at least one portion of said case member to visually represent said colors of said cartridges, thereby providing a user with a visual aid of said colors of said cartridges.

11. The method of claim 1, further comprising the step of:
disposing a third cartridge of said cartridges in said interior while allowing said third cartridge to operatively couple with said first and second cartridges and with at least one of said case member, cap member, and actuator member for said enclosings and exposing.

12. The method of claim 11, further comprising the step of:
manipulating said disposings such that said hue, value, and chroma of said third cartridge are respectively different from those of said first and second cartridges.

13. The method of claim 11, further comprising the step of:
manipulating said disposings such that at least one of said hue, value, and chroma of said third cartridge is respectively similar to those of at least one of said first and second cartridges.

14. The method of claim 11, further comprising the step of:
manipulating said disposings such that at least one of said hue, value, and chroma of said third cartridge is respectively identical to those of at least one of said first and second cartridges.

15. A method of inserting a plurality of cartridges into a writing tool, wherein said writing tool includes a case member defining an interior therein, wherein each of said cartridges contains therein a volatile marking substance with a preset color, includes in one end thereof a tip through which said marking substance is applied onto an article, and is shaped and sized to be retained into said interior, wherein said color is characterized by a color hue, a color value, and a color chroma, and wherein said writing tool includes a cap member and an actuator member which are capable of enclosing said tips of all of said cartridges in said interior in order to prevent drying of said tips when said tool is not in use and then capable of exposing said tip of each of said cartridges out of said interior one at a time while enclosing said tips of the rest of said cartridges in said interior in order to prevent drying of said tips of said rest of said cartridges when said tool is in use, said method comprising the steps of:
selecting at least one of said cartridges to be replaced;
removing said one cartridge out of said interior while keeping the rest of said cartridges in said interior; and
disposing at least one new cartridge inside said interior while allowing said new cartridge to operatively couple with at least one of said case member, cap member, and actuator member for both of said exposing and enclosings.

16. The method of claim 15, further comprising the step of:
manipulating said disposing such that said hue, value, and chroma of said new cartridge are respectively identical to those of said one cartridge.

17. The method of claim 15, further comprising the step of:
manipulating said disposing such that said hue, value, and chroma of said new cartridge are respectively at least similar to those of one of said rest of said cartridges.

18. The method of claim 15, further comprising the step of:
manipulating said disposing such that said hue, value, and chroma of said new cartridge are respectively different from those of said one cartridge and from each of those of said rest of said cartridges.

19. The method of claim 15, further comprising the steps of:
enclosing said tip of said new cartridge to prevent said drying before said disposing;
exposing said tip of said new cartridge immediately before said disposings; and
performing said removing and then disposing.

20. The method of claim 15, further comprising the steps of:
color-coding at least a portion of said case member; and
performing said disposings while matching said colors of said cartridges with said color-coding.

21. The method of claim 15, further comprising the steps of:
color-coding at least a portion of said actuator member; and
performing said disposings while matching said colors of said cartridges with said color-coding.

22. The method of claim 15, further comprising the step of:
configuring at least one portion of said case member to visually represent said colors of said cartridges, thereby providing a user with a visual aid of said colors of said cartridges.

23. A method of inserting a plurality of cartridges into a writing tool, wherein said writing tool includes a case member defining an interior therein, wherein each of said cartridges contains therein a volatile marking substance with a preset color, includes in one end thereof a tip through which said marking substance is applied onto an article, and is shaped and sized to be retained into said interior, wherein said color is characterized by a color hue, a color value, and a color chroma, and wherein said writing tool includes a cap member and an actuator member which are capable of enclosing said tips of all of said cartridges in said interior in order to prevent drying of said tips when said tool is not in use and then capable of exposing said tip of each of said cartridges out of said interior one at a time while enclosing said tips of the rest of said cartridges in said interior in order to prevent drying of said tips of said rest of said cartridges when said tool is in use, said method comprising the steps of:
configuring said actuator member to form a first portion for receiving an input force, a second portion for operatively coupling with at least one of said cartridges, and a third portion for operatively coupling with said cap member;
forming a part of said tool by assembling said case member and cap member;
providing said first portion and second portion of said actuator member on each of a first and a second of said cartridges;
disposing said first cartridge in said interior while allowing said first cartridge to operatively couple with at least one of said case member and cap member for said exposing and enclosings; and
disposing said second cartridge in said interior while allowing said second cartridge to operatively couple with at least one of said case member and cap member for said enclosings and exposing.

24. The method of claim 23, further comprising the step of:
manipulating said disposings such that said hue, value, and chroma of said second cartridge are different respectively from those of said first cartridge.

25. The method of claim 23, further comprising the step of:

manipulating said disposings such that at least one of said hue, value, and chroma of said second cartridge are respectively similar to those of said first cartridge.

26. The method of claim 23, further comprising the step of:

manipulating said disposings such that at least one of said hue, value, and chroma of said second cartridge are respectively identical to those of said first cartridge.

27. The method of claim 23, further comprising the steps of:

enclosing said tips of said first and second cartridges to prevent said drying before said disposings;

exposing said tips of said first and second cartridges immediately before said disposings; and performing said disposings.

28. The method of claim 23, further comprising the steps of:

providing said first and second cartridges as separate articles; and performing said disposings one after another.

29. The method of claim 23 further comprising the steps of:

coupling said first and second cartridges before said disposings; and performing said disposings while maintaining at least a portion of coupling.

* * * * *